US007734242B2

(12) United States Patent
Hatakeyama et al.

(10) Patent No.: US 7,734,242 B2
(45) Date of Patent: Jun. 8, 2010

(54) PROTECTIVE LAYER SETTING UNIT, PROCESS CARTRIDGE, AND IMAGE FORMING APPARATUS USING SAME

(75) Inventors: Kumiko Hatakeyama, Sagamihara (JP); Toshiyuki Kabata, Yokohama (JP); Masahide Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/168,336

(22) Filed: Jul. 7, 2008

(65) Prior Publication Data

US 2009/0016769 A1 Jan. 15, 2009

(30) Foreign Application Priority Data

Jul. 6, 2007 (JP) ..... 2007-178814
Feb. 29, 2008 (JP) ..... 2008-050667

(51) Int. Cl.
*G03G 21/00* (2006.01)

(52) U.S. Cl. ..... 399/346; 399/111; 399/123; 399/159

(58) Field of Classification Search ..... 399/346
See application file for complete search history.

(56) References Cited

U.S. PATENT DOCUMENTS 7,218,879 B2 5/2007 Enoki et al.
7,315,711 B2 1/2008 Ariizumi et al.
2001/0031411 A1* 10/2001 Kojima et al. ..... 430/58.05
2004/0165919 A1* 8/2004 Nishida ..... 399/346
2005/0169668 A1 8/2005 Koichi et al.
2008/0226365 A1* 9/2008 Hatakeyama et al. ..... 399/346

FOREIGN PATENT DOCUMENTS

JP 2002-97483 4/2002
JP 2004-198662 7/2004
JP 2005-4051 1/2005
JP 2005-17469 1/2005
JP 2005-249901 9/2005
JP 2005-274737 10/2005

* cited by examiner

*Primary Examiner*—David M Gray
*Assistant Examiner*—Roy Yi
(74) *Attorney, Agent, or Firm*—Oblon, Spivak, McClellland, Maier & Neustadt, L.L.P.

(57) ABSTRACT

A protective layer setting unit includes a protective agent and an application unit configured to apply the protective agent to an image carrying member in a manner sufficient to satisfy equations (1) and (2). A surface condition of the image carrying member is determined by an applied-agent amount index "X" and an agent coating ratio "Y," and a ratio of "X/Y" is set to 0.020 or less after applying the protective agent for 120 minutes.

applied-agent amount index $X=Sb/Sa$ (1)

agent coating ratio $Y=(A_0-A)/A_0\times100(\%)$ (2).

19 Claims, 15 Drawing Sheets

| | START AND END POINT OF BACKGROUND | | INTEGRATION AREA OF PEAK | |
|---|---|---|---|---|
| PEAK Pa1 (1770cm$^{-1}$) | 1801.3cm$^{-1}$ | 1751.1cm$^{-1}$ | 1785.8cm$^{-1}$ | 1764.6cm$^{-1}$ |
| PEAK Pb1 (2850cm$^{-1}$) | 2867.8cm$^{-1}$ | 2821.5cm$^{-1}$ | 2856.2cm$^{-1}$ | 2842.7cm$^{-1}$ |

FIG. 15

| EXAMPLE/ COMPARATIVE EXAMPLE | APPLICATION UNIT | | | | | | | | | | | | |
|---|---|---|---|---|---|---|---|---|---|---|---|---|---|
| | APPLI-CATION UNIT NO. | PROTEC-TIVE AGENT BAR NO. | BRUSH | | | | ANALYSIS RESULT | | | | | | |
| | | | BRUSH NO. | DIAM-ETER (μm) | NUM-BER OF FIBERS | PRES-SURE (N) | X | Y | X/Y | NUMBER OF PRINTED SHEETS | JUDG-MENT RESULT | NUMBER OF PRINTED SHEETS | JUDG-MENT RESULT |
| EX. 1 | 1 | 1 | 3 | 39 | 50000 | 4.8 | 0.254 | 77 | 0.0033 | 150 | ○ | 6000 | ○ |
| EX. 2 | 2 | 1 | 2 | 33 | 50000 | 4.8 | 0.250 | 100 | 0.0025 | 150 | ○ | 6000 | ○ |
| COMP.EX. 1 | 3 | 2 | 1 | 39 | 100000 | 6.0 | 2.42 | 100 | 0.0242 | 150 | △ | 6000 | × |
| COMP.EX. 2 | 4 | 2 | 1 | 39 | 100000 | 5.0 | 2.20 | 100 | 0.0220 | 150 | △ | 6000 | × |
| EX. 3 | 5 | 2 | 2 | 33 | 50000 | 3.5 | 1.41 | 100 | 0.0141 | 150 | ○ | 6000 | △ |
| EX. 4 | 6 | 1 | 1 | 39 | 100000 | 6.0 | 0.55 | 93 | 0.0059 | 150 | ○ | 6000 | ○ |

FIG. 16

| PROTECTION AGENT BAR | FT115 (WEIGHT PART) | TOPAS-TM (WEIGHT PART) | MONOSORBITAN STEARATE (WEIGHT PART) | NORMAL PARAFFIN (WEIGHT PART) |
|---|---|---|---|---|
| NO. 1 | 88 | 12 | - | - |
| NO. 2 | - | - | 40 | 60 |

PROTECTIVE LAYER SETTING UNIT, PROCESS CARTRIDGE, AND IMAGE FORMING APPARATUS USING SAME

CROSS-REFERENCE TO RELATED APPLICATIONS

This application claims priority from Japanese Patent Application Nos. 2007-178814, filed on Jul. 6, 2007, and 2008-050667, filed on Feb. 29, 2008 in the Japan Patent Office, the entire contents of each of which are hereby incorporated by reference herein.

BACKGROUND OF THE INVENTION

1. Field of the Invention

The present disclosure generally relates to a protective layer setting unit for applying a protective agent to an image carrying member used for an image forming apparatus employing electrophotography, and a process cartridge having the protective layer setting unit.

2. Description of the Background Art

Typically, an image forming apparatus using electrophotography produces an image by sequentially conducting a series of processes such as a charging process, an exposure process, a developing process, and a transfer process to a photoconductor such as an OPC (organic photoconductor). After conducting the transfer process, by-products generated by discharging during the charging process or toner particles remaining on the photoconductor are removed by a cleaning process. The cleaning process can be conducted by using a cleaning blade, such as a rubber blade, which has a relatively simple and inexpensive structure but which cleans well.

However, a cleaning blade has a short lifetime and can itself reduce the useful life of the photoconductor because the cleaning blade is pressed against the photoconductor to remove residual materials remaining on the photoconductor. More specifically, frictional pressure between the cleaning blade and the photoconductor causes abrasion on the rubber blade and a surface layer of the photoconductor.

Further, small-sized toner particles, used for coping with demand for higher quality images, may not be effectively trapped by the cleaning blade, referred to as "passing of toner" or "toner passing." Toner passing is more likely to occur by insufficient dimensional or assembly precision of the cleaning blade or when the cleaning blade vibrates unfavorably due to an external shock or the like. If toner passing occurs, higher quality images may not be produced.

Accordingly, to enhance the lifetime of the photoconductor and to produce higher quality images over time, frictional pressure on the photoconductor or cleaning blade needs to be reduced, and the cleaning performance of the photoconductor needs to be enhanced, by which degradation of the photoconductor or cleaning blade can be reduced and "toner passing" can be reduced.

In view of such frictional pressure reduction and cleaning performance enhancement, in general, a lubricant is applied to the photoconductor to form a lubricant layer on the photoconductor using the cleaning blade. The lubricant layer can protect the surface of the photoconductor from an effect of frictional pressure caused by the cleaning blade pressing against the photoconductor, which abrades the photoconductor, or from a discharge energy effect during a charging process, which degrades the photoconductor. Further, the photoconductor having a lubricant layer can enhance lubricating performance of the photoconductor surface, by which an unfavorable vibration of cleaning blade can be reduced, and thereby the toner passing amount can be reduced.

Because lubricating and protection performance of a lubricant may be affected by an amount of lubricant applied on the photoconductor, the application amount of the lubricant may need to be controlled to a given level. If the application amount of lubricant is too small, the aforementioned photoconductor abrasion by frictional pressure, photoconductor degradation by charging process, and toner passing may not be effectively reduced. Accordingly, the state of the lubricant application on the photoconductor, such as application amount, needs to be evaluated.

In general, a metallic soap such as zinc stearate is used as the lubricant. When zinc stearate is used as the lubricant, the amount of zinc stearate applied to a photoconductor is analyzed using XPS (X-ray photoelectron spectroscopy), in which the amount of zinc element as a percentage of all elements on the surface of photoconductor is measured.

In XPS analysis, elements other than hydrogen existing in a top and a sub-surface of a sample can be detected. When an OPC (organic photoconductor) coated with zinc stearate is analyzed using XPS, an element amount profile detected by XPS varies depending on a coating amount or coating ratio of zinc stearate. For example, when no zinc stearate is applied to the OPC, the element amount profile shows an element distribution of the OPC itself, whereas when zinc stearate is applied to the OPC, the element amount profile shows a mixture of the element distribution of the OPC and the element distribution of the zinc stearate. If the zinc stearate is applied to the entire surface of the OPC (i.e., OPC is coated with zinc stearate 100%), the element amount profile only shows the element distribution of the zinc stearate, and therefore an upper limit of zinc amount or ratio on the OPC becomes a zinc amount or ratio of the zinc stearate. Accordingly, when zinc stearate, which has a chemical composition of $C_{36}H_{70}O_4Zn$, coats the entire surface of the photoconductor, theoretically the ratio of zinc to all elements should be 2.44%, which is computed from the ratio of elements in zinc stearate ($C_{36}H_{70}O_4Zn$) excluding hydrogen.

Recently, a charging process for electrophotography has been employing an AC charging using a charge roller, in which an alternating current voltage is superimposed on the direct current voltage. Such AC charging can charge a photoconductor more uniformly, can reduce generation of oxidizing gas, such as ozone and nitrogen oxide (NOx), and can contribute to size reduction of an image forming apparatus, for example. However, a photoconductor may be increasingly degraded because a discharge of positive and negative voltages repeatedly occurs between a charging device and the photoconductor with a frequency of the applied alternating current voltage, such as several hundred to several thousand times per second. Such degradation of the photoconductor can be reduced by applying a lubricant, such as metallic soap, on the photoconductor because the lubricant can absorb discharge energy of the AC charging so as to prevent the discharge energy effect to the photoconductor.

The lubricant (e.g., metallic soap) may be decomposed by the AC charging. However, the metallic soap is not decomposed completely, but may be decomposed to a lower molecular weight fatty acid, and a friction pressure between the photoconductor and a cleaning blade may increase as the lubricant is decomposed. Such fatty acid and toner may be adhered on the photoconductor as a film, by which image resolution is degraded, the photoconductor is abraded, and uneven image concentration occurs.

In light of this phenomenon, a greater amount of metallic soap may be applied on the photoconductor so as to effectively coat a surface of the photoconductor with metallic soap even if some fatty acid may be generated. However, only some of the metallic soap may actually adhere on the photoconductor even if the photoconductor is supplied with a greater amount of metallic soap, and most of the metallic soap applied on the photoconductor may be transferred with toner, or removed with waste toner, for example. Accordingly, the metallic soap may be consumed rapidly, and the metallic soap may need to be replaced with new metallic soap in a time period, which may be shorter than a lifetime of the photoconductor.

In view of such drawbacks, instead of using metallic soap, higher alcohols having a greater carbon number, such as from 20 to 70, are used as a main component of a lubricant (or protective agent) in one conventional art. When the lubricant is applied to a photoconductor, higher alcohol may accumulate on a leading edge of a cleaning blade as indefinite-shaped particles, and the lubricant has surface wet-ability with the surface of photoconductor, by which the lubricant can be used for a long period of time.

However, if the higher alcohol is used as lubricant, one molecule of higher alcohol may coat a relatively larger area on the photoconductor, and thereby density of higher alcohol molecules absorbed on the photoconductor per unit area may become smaller (i.e., smaller molecular weight per unit area), which is not preferable from a viewpoint of reducing the electrical stress of the AC charging to the photoconductor.

Another art proposes using powder of an alkylene bis alkyl acid amide compound as a lubrication component to supply powder in the surface boundaries between a photoconductor (or image carrying member) and a cleaning blade in a contacting condition with the photoconductor so as to provide smooth lubrication effect on the surface of the photoconductor for a long period. However, if a lubricant having nitrogen atom is used, the lubricant itself may generate decomposition products having ion-dissociative property, such as nitrogen oxide and a compound having ammonium when the lubricant is subjected to the electrical stress of AC charging. Such products then intrude into a lubrication layer, thereby reducing resistance of the lubrication layer under a high-humidity condition and may result in occurrences of grainy images.

Recently, it is known that a protective agent having paraffin as a main component can protect a photoconductor from the electrical stress of AC charging, can reduce a frictional pressure between the photoconductor and a cleaning blade, and can remove toner remaining on the photoconductor, for example. Further, the protective agent having paraffin may not generate fatty acid so much even if the protective agent is oxidized by the electrical stress of AC charging, which is preferable for reducing fluctuation or variation of the frictional pressure between the photoconductor and the cleaning blade.

However, when image forming operations are repeated using a protective agent having paraffin, abnormal images, such as streak image, were produced in some cases, wherein such abnormal images may be caused by abrasion of the photoconductor and the cleaning blade. Based on research, the probability of such abnormal images varies among product lots of protective layer setting units. Research was further conducted for photoconductors, which exhibited or did not exhibit the abnormal images, to find that the abnormal images occurred on an area where a layer thickness of the photoconductor was relatively thinner or an area where toner was attracted with a greater amount on the photoconductor. However, the root causes of such abnormal images are not known yet.

As noted above, paraffin can be effectively used as a protective agent instead of metallic soap. However, when a protective agent, such as paraffin, not containing metal component is subjected to OPC, XPS or XRF analysis, one only observes peak values for carbon (C) and oxygen (O), and therefore the amount of protective agent applied to the photoconductor may not be effectively evaluated. Further, ICP spectroscopic analysis may not be suitable for effectively evaluating the amount of protective agent, not containing metal component, applied to the photoconductor because the ICP spectroscopic analysis is also used for detecting a protective agent (e.g., metallic soap) having metal component. If the amount of protective agent on a photoconductor cannot be effectively evaluated, a photoconductor having an insufficient amount of protective agent may be assembled in a process cartridge or an image forming apparatus, and the photoconductor can cause image quality degradation.

As such, a conventional analysis method may not be suitable for detecting the amount of a protective agent, such as paraffin, that does not include a metal component. In view of such background, a method of effectively evaluating a surface condition of a photoconductor coated with a protective agent not including metal component is desired, as well as a protective layer setting unit configured to apply such a protective agent within the range of efficacy required.

SUMMARY

One object of the present invention is to provide a method by which a protective layer can be efficiently and consistently prepared on an image carrying member using a protective agent having paraffin as a main component.

A further object of the present invention is to provide a protective layer setting unit that can perform the method of the present invention.

A further object of the present invention is to provide a process cartridge containing the protective layer setting unit.

Another object of the present invention is to provide an image forming apparatus that contains the protective layer setting unit.

These and other objects of the present invention, alone or in combinations thereof, have been satisfied by the discovery of a protective layer setting unit, comprising:

a protective agent having paraffin as a main component; and an application unit configured to apply the protective agent to the image carrying member in a manner sufficient to meet the following requirements:

a surface condition of the image carrying member determined by an applied-agent amount index "X" and an agent coating ratio "Y", wherein a ratio of "X/Y" is set to 0.020 or less when the protective agent has been applied for 120 minutes to the image carrying member, wherein the applied-agent amount index "X" is defined by the following equation (1), and the agent coating ratio "Y" is defined by the following equation (2);

$$\text{applied-agent amount index } X = Sb/Sa \quad (1)$$

$$\text{agent coating ratio } Y = (A_0 - A)/A_0 \times 100(\%) \quad (2)$$

wherein in the equation (1),

Sb represents a peak area of a peak Pb at a wavenumber, b, in an IR spectrum of the surface of the image carrying member after applying the protective agent for 120 minutes, wherein the wavenumber b is a peak found in an IR spectrum of the protective agent alone, but not in an IR spectrum of the image carrying member alone, Sa represents a peak area of a peak Pa at a wavenumber, a, in an IR spectrum of the surface of the image carrying member after applying the protective agent for 120 minutes, wherein the wavenumber a is a peak found in an IR spectrum of the image carrying member alone, but not in an IR spectrum of the protective agent alone; and wherein in the equation (2), $A_0$(%) represents a first area value for a peak unique to a material from which the image carrying member is formed, in a C1s X-ray photoelectron spectroscopy (XPS) spectrum, with respect to a total area of the C1s spectrum of the image carrying member, before applying the protective agent, and A(%) represents a second area value for the peak of a C1s X-ray photoelectron spectroscopy (XPS) spectrum with respect to a total area of the C1s spectrum of the image carrying member, after applying the protective agent;

and a method for determining the surface condition of the image carrying member, as well as a process cartridge and image forming apparatus that incorporate the protective layer setting unit.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIGS. 9A and 9B show intensity profiles of binding energy for a surface of a photoconductor after applying a protective agent, the binding energy is detected by XPS analysis, in which FIG. 9A shows a condition having an agent coating ratio of 74%, and FIG. 9B shows a condition having an agent coating ratio of 98%;

FIGS. 15 and 16 show conditions for protective agent bars, protective layer setting units, analysis condition and result and image evaluation.

Figure 1:
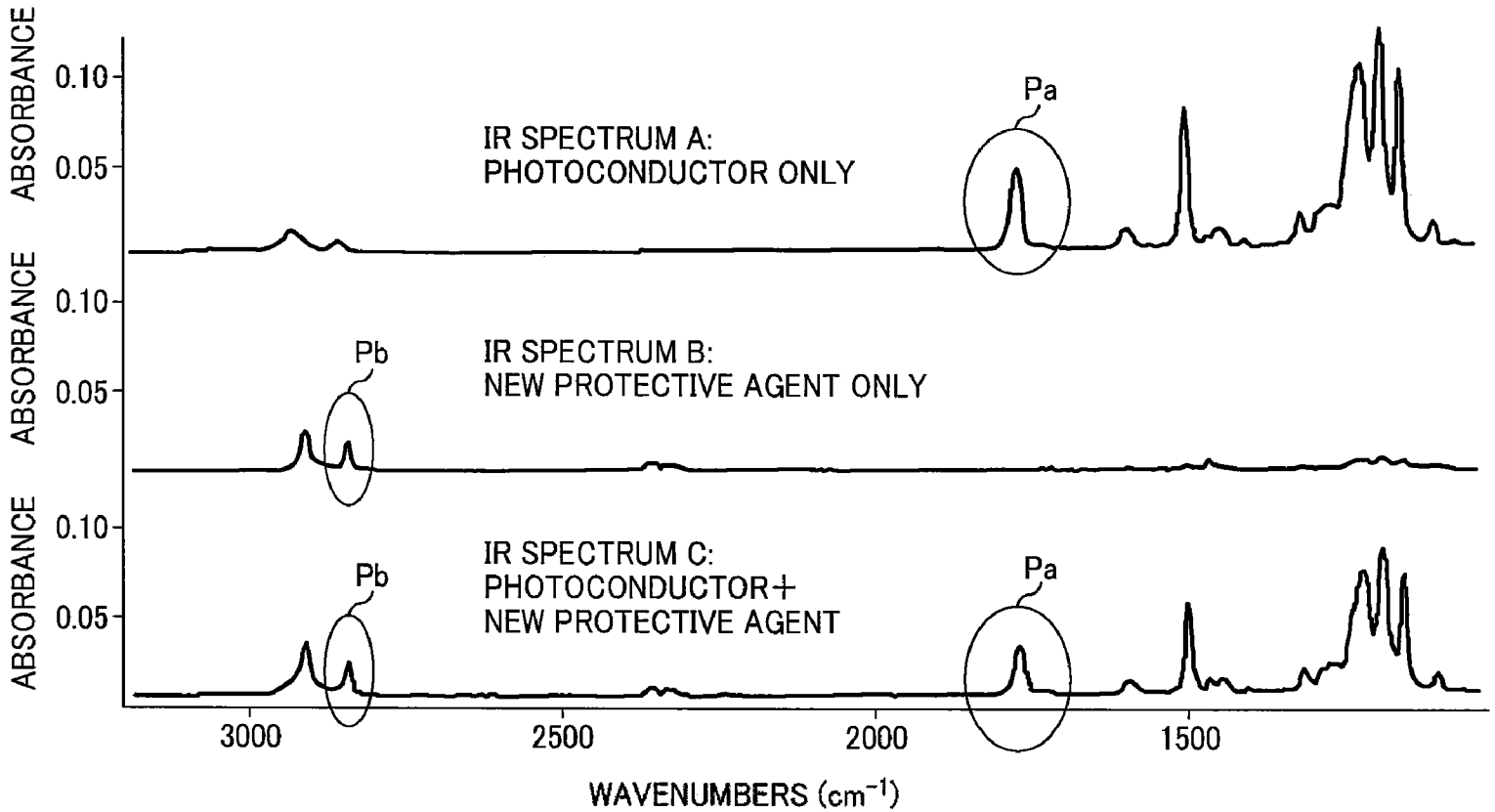
FIG. 1 shows example IR spectrum, in which IR spectrum A is for a photoconductor surface before applying a protective agent, IR spectrum B is for a protective agent alone, IR spectrum C is for a photoconductor surface after applying a protective agent.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

One embodiment of the present invention provides a protective layer setting unit comprising a protective agent having paraffin as a main component; and an application unit configured to apply the protective agent to the image carrying member in a manner sufficient to satisfy the following requirements: When the image carrying member is supplied with the protective agent for 120 minutes, a surface condition of the image carrying member is determined by an applied-agent amount index "X" and an agent coating ratio "Y." The applied-agent amount index "X" is defined by an equation (1), the agent coating ratio "Y" is defined by an equation (2), and a ratio of "X/Y" is set to 0.020 or less when the protective agent is applied for 120 minutes to the image carrying member.

$$\text{applied-agent amount index } X = Sb/Sa \quad (1)$$

$$\text{agent coating ratio } Y = (A_0 - A)/A_0 \times 100(\%) \quad (2)$$

In the equation (1), an attenuated total reflection (ATR) method, which is an infrared absorption spectrum method, is preferably used for detecting a surface condition of the image carrying member using an ATR prism of germanium (Ge) and incident angle of infrared light of 45° as a measurement condition, and an absorbance spectrum obtained by the ATR method is referred as an IR (infrared) spectrum. An IR spectrum A is observed as the IR spectrum of the surface of the image carrying member before applying the protective agent. An IR spectrum B is observed as the IR spectrum of the protective agent alone. An IR spectrum C is observed as the IR spectrum of the surface of the image carrying member after applying the protective agent for 120 minutes. After applying the protective agent for 120 minutes, a peak Pa at a wavenumber, a, which is a peak found in the IR spectrum A of the surface of the image carrying member alone, but not found in the IR spectrum B of the surface protective agent alone, (for example at 1770 $cm^{-1}$ for a polycarbonate containing image carrying member), is detected with a peak area Sa in the IR spectrum C, and a peak Pb at a wavenumber, b, which is a peak found in the IR spectrum B of the surface protective agent alone, but not in the IR spectrum A of the image carrying member alone, (for example at 2850 $cm^{-1}$ for a surface protective agent that contains paraffin), is detected with a peak area Sb in the IR spectrum C. The ratio of peak areas Sb/Sa is then determined to provide X.

In the equation (2), a C1s spectrum of the image carrying member is detected by X-ray photoelectron spectroscopy (XPS) before and after applying the protective agent to the image carrying member. The C1s spectrum includes a plurality of peaks, corresponding to different carbon binding energies, wherein one of the plurality of peaks, that is unique to the material from which the image carrying member is formed, (for example a peak in a binding energy range of 290.3 eV to 294 eV for a polycarbonate based image carrying member), is used as a target peak to determine a coating condition of the image carrying member coated with the protective agent. The peak area of the target peak with respect to a total area of the C1s spectrum of the image carrying member is detected before and after applying the protective agent termed as a first area value $A_0$(%) and a second area value A(%), respectively, to determine a coating condition of the image carrying member. Thus, the first area value $A_0$(%) is detected as a value before applying the protective agent, and the second area value A(%) is detected as a value after applying the protective agent.

In another aspect of the present disclosure, a process cartridge is provided that comprises an image carrying member, and the above described protective layer setting unit.

In another aspect of the present disclosure, an image forming apparatus is provided that comprises the above-described protective layer setting unit.

A description is provided below to an exemplary embodiment of a protective layer setting unit according to the present invention.

As background information, the reason for the occurrence of abnormal images in an image forming apparatus having a protective layer setting unit was examined by observing the surface of a photoconductor coated with the protective agent, using a scanning electron microscope (SEM) under an assumption that the occurrence of abnormal images may be attributed to the amount of the protective agent, such as abnormal images may occur where the protective agent is not applied, and abnormal images may not occur where the protective agent is applied. Although the surface observations confirmed that the protective agent adhered on the photoconductor, the SEM observation was not effective for determining an amount of the protective agent on the photoconductor, by which the reason for occurrence of abnormal images was not determined.

Another SEM observation was then conducted to determine the reason for occurrence of abnormal images under an assumption that abnormal images may occur for different reasons depending on the image types to be formed. Based on SEM observation for observing a portion of the photoconductor where abnormal image occurred, it was found that when a formed image area was small, toner was more likely to adhere to the photoconductor, by which image resolution became lower, and when a formed image area was great, the photoconductor was partially abraded, by which abnormal image was more likely to occur.

Because abnormal image occurs in various manners depending on images to be formed, it was assumed that the surface condition of the photoconductor to which a protective agent had been applied may be correlated to the occurrence or non-occurrence of abnormal images. In other words, the application performance of the protective agent by a protective layer setting unit may be correlated to the occurrence or non-occurrence of abnormal image formation. In view of this, the application amount of the protective agent on the photoconductor was evaluated as follows. Because conditions of protective agent on the photoconductor change depending on formed images, the application amount of the protective agent on the photoconductor was evaluated without forming an image on the photoconductor.

As above noted, a conventional analysis method may not be suitable for detecting an amount of a protective agent, such as paraffin, that does not include a metal component. Thus, an XPS, and an ATR method using fourier transform infrared spectrophotometer (FT-IR) are used for effectively evaluating the surface condition of a photoconductor coated with a protective agent not including a metal component. The ATR method using FT-IR is used for analyzing an organic material, in general.

As noted above, a protective agent not including a metal component may not be effectively detected by the XPS analysis. Accordingly, in an exemplary embodiment, a protective agent, such as paraffin having no metal component, is applied to a photoconductor, and an amount of the applied protective agent is determined not by detecting a component included in the protective agent but, rather, by detecting a component included only in the photoconductor using the XPS analysis. Hereinafter, such component included only in the photoconductor may be referred as "target component" for the simplicity of expression in this disclosure. In an exemplary embodiment, the amount of protective agent, having no metal component, applied to a photoconductor is determined by using an index value attributed to "target component", to be described later. When a protective agent is applied to the photoconductor, the protective agent coats the photoconductor. Accordingly, the greater the amount of protective agent applied or coated on the photoconductor, the smaller the detection value of the "target component" of the photoconductor. In this disclosure, an analysis and its result for tracing or detecting the "target component" included only in the photoconductor using XPS analysis is described at first, and then the ATR method using fourier transform infrared spectrophotometer (FT-IR) is described.

For example, based on experiment results of the XPS analysis, to be described later, as for a photoconductor including a polycarbonate resin, it was found that a peak attributed to polycarbonate detected in a range of 290.3 eV to 294 eV in C1s spectrum can be used to evaluate a surface condition of a photoconductor before and after applying a protective agent.

Specifically, the peak attributed to polycarbonate is detected before applying a protective agent (or before using a photoconductor for an image forming operation) and after applying a protective agent. After applying the protective agent on the photoconductor, a peak value in the same energy range became a smaller intensity compared to before applying the protective agent, or such peak was not detected at all. Further, it was also found by XPS analysis that, after applying the protective agent to the photoconductor, a total peak area in the range of 290.3 eV to 294 eV with respect to the total area of the C1s spectrum became too small compared to before applying the protective agent to the photoconductor.

In this disclosure, a peak preferably means a curve profile shown by a Gaussian function curve or a Lorenz function curve, and a peak top means a top of the curve profile. The curve profile may not be limited to a Gaussian curve or a Lorenz curve, but can include combinations of a Gaussian curve and a Lorenz curve, as well as other suitable function curves, and combinations thereof.

In an exemplary embodiment, the C1s spectrum has one peak area in a range of 290.3 eV to 294 eV, and such peak area (hereinafter, target peak area) is computed before and after applying a protective agent. The target peak area is determined as a ratio with respect to a total area of the C1s spectrum of the photoconductor. Specifically, a target peak area ratio before applying protective agent is referred as a first area value "$A_0$," and a target peak area ratio after applying protective agent is referred as a second area value "A" for the simplicity of expression. In this disclosure, a ratio of the first area value "$A_0$" and the second area value "A" is determined to evaluate a coating condition of a photoconductor. When a protective agent is applied to the photoconductor, the photoconductor is coated with the protective agent, by which the second area value "A" becomes smaller than the first area value "$A_0$." The second area value "A" and first area value "$A_0$" are then compared to each other to evaluate a coating condition of the photoconductor. As described later, it was found that when the second area value "A" becomes smaller than a given value, the photoconductor can be effectively and reliably coated with a protective agent, and the photoconductor can be preferably used for enhancing durability of an image forming apparatus. The coating condition of the photoconductor can be determined using a coating ratio defined by $((A_0-A)/A_0)\times100(\%)$. It was found that higher quality image can be formed if the coating ratio $((A_0-A)/A_0)\times100$ (%) can be set within a given preferred range.

The photoconductor used in an exemplary embodiment may include polycarbonate. A peak obtained in a range of 290.3 eV to 294 eV by XPS analysis is attributed to a carbonate bonding in polycarbonate resin, and $\pi$-$\pi^*$ electron transition of CTM (charge transport material) in the photoconductor and benzene ring in the polycarbonate resin.

As above described, a reduction or disappearance of peak value in a range of 290.3 eV to 294 eV may occur when a protective agent, such as paraffin, is applied and coated on a surface of the photoconductor because the coated photoconductor may reduce in the surface portion not coated with the protective agent (i.e., the exposed surface portion of the photoconductor is reduced).

Accordingly, a ratio of an exposed surface of the photoconductor can be determined based on a ratio of the aforementioned second area value "A" in a range of 290.3 eV to 294 eV (i.e., a value after applying protective agent) with respect to a total area of the C1s spectrum. Specifically, the second area value "A" becomes smaller and smaller when more and more protective agent is applied to the photoconductor. Accordingly, the smaller the ratio of the second area value "A" with respect to the total area of C1s spectrum, the smaller the exposed surface portion of the photoconductor.

With the detection method used for determining a surface condition of a photoconductor coated with a protective agent having no metal component, an exposed surface ratio of the photoconductor (or a coating ratio of the photoconductor) can be measured. Accordingly, a surface condition of a photoconductor coated with the protective agent can be determined even if the protective agent does not include a metal component.

Accordingly, by using the detection method according to an exemplary embodiment in addition to known detection methods used for a protective agent including a metal component, a surface condition of a photoconductor coated with a protective agent can be determined without a limitation on types of protective agents, which is preferable for evaluating a surface condition of a photoconductor used for an image forming apparatus.

When analyzing an application state of the protective agent, a detection depth needs to set to a suitable level. If the detection depth becomes too great and a layer of protective agent formed on a photoconductor is too thin, only the photoconductor may be detected by spectrum analysis. Because the XPS analysis can detect a sub-surface portion, such as 5 nm to 8 nm, as detection depth, the state of a photoconductor supplied with a thin layer of a protective agent can be preferably analyzed.

Further, a state of a photoconductor supplied with a thin layer of a protective agent can be analyzed by the ATR method, which is used for organic material analysis, to evaluate an application amount of the protective agent on the photoconductor, in which the ATR method may be preferably conducted by FT-IR, for example.

An IR spectrum, obtained by FT-IR, indicates a change of intensity profile of sample with respect to a wavenumber (or wavelength) of an infrared light source. The IR spectrum profile is drawn as a curve profile by setting wavenumber ($cm^{-1}$), which is an inverse number of wavelength, in a horizontal axis and setting transmission factor (T) or absorbance (A) in a vertical axis. The transmission factor (T) is a ratio of light energy entering a sample and light energy transmitted from the sample, and the absorbance (A) is obtained by the common logarithm of an inverse number of the transmission factor (T). Because the absorbance is proportional to sample concentration (Lambert-Beer law), peak intensity of absorbance spectrum is used for quantitative determination of sample. As for a peak intensity of the IR spectrum, absorbance is preferably used for quantitative analysis instead of the transmission factor.

In general, an IR spectrum can be measured by two types of machine: diffusion type infrared spectrophotometer and fourier transform infrared spectrophotometer, wherein the fourier transform infrared (FT-IR) spectrophotometer is mainly used for IR spectrum measurement in view of higher efficiency on measurement time, light energy usage, resolution power of wavenumber, and precision of wavenumber. An IR spectrum can be measured with such a machine using methods, such as a transmission method or the like, which can be selected depending on the purpose of measurement, sample shape, or the like. Among the measurement methods, the ATR method is widely used for FT-IR measurement because the ATR method does not need a complex sample treatment for IR spectrum measurement.

In the ATR method, an infrared absorption spectrum is measured using total reflection. Specifically, an ATR prism having a higher refractive index is closely contacted against a sample, an infrared (IR) light is irradiated to the sample via the ATR prism, and then an outgoing light from the ATR prism is analyzed spectrometrically. The infrared light can be totally reflected at a contact face of the ATR prism and the sample (i.e., total reflection) when the infrared light is irradiated to the ATR prism with a given angle or more, wherein such given angle is determined based on a relationship of the refractive index of the ATR prism and the sample. During the IR light irradiation, the IR light reflects from an internal surface of the ATR prism and generates an evanescent wave which projects orthogonally into the sample. Some of the energy of the evanescent wave is absorbed by the sample and the reflected IR light is attenuated and received by a detector, by which an absorption spectrum of the sample can be obtained.

The ATR method can be applied for various samples because an absorption spectrum of the sample can be measured by contacting a portion of the sample against the ATR prism. For example, an absorption spectrum of a thick sample or low-transmittance sample can be measured if the sample can be closely contacted to the ATR prism. In the ATR method, a functional group in the sample can be determined based on wavenumber corresponding to absorbed infrared light, and thereby the ATR method is widely used for qualitative analysis. However, because a peak intensity of the absorption spectrum can vary due to a press-down pressure of the sample, the ATR method may not be used so often for quantitative analysis.

In an exemplary embodiment of the present invention, the ATR method is used for quantitative analysis for evaluating an application amount of a protective agent on a photoconductor by measuring and analyzing the IR spectrum under various conditions.

In an exemplary embodiment, an attenuated total reflection method (hereinafter, referred as ATR method or ATR) is used to evaluate a protective agent not including a metal component, such as paraffin, applied to a photoconductor. In the ATR method, the projection depth of infrared (IR) light into a sample becomes different depending on measurement conditions, such as ATR prism and incident angle, by which results of the measured spectrum of the same sample may become different depending on the measurement conditions. For example, one spectrum result shows only a peak attributed to a photoconductor, another spectrum result shows only a peak attributed to a protective agent, or another spectrum result shows a mixture of a peak attributed to a photoconductor and a peak attributed to a protective agent.

In an exemplary embodiment, a measurement condition which can detect both of a peak attributed to a photoconductor and a peak attributed to a protective agent is determined based on research on measurement conditions, in which conditions of the ATR prism, incident angle, or the like are changed in many values. Under such measurement condition, an infrared (IR) spectrum profile for a photoconductor is measured to evaluate an application amount of the protective agent on the photoconductor.

In the ATR method, a measurement portion of a sample deforms due to a press-down pressure for holding the sample, by which peak intensity of the spectrum may vary. Accordingly, peak intensity of the spectrum alone may not be used for effectively detecting a surface condition of the sample.

In view of such variation of measurement results, a substantially consistent condition is set when setting a sample on a measurement device so as to obtain infrared (IR) spectrum profile under the substantially consistent condition. For example, a gap between a fixing jig for holding the sample and the ATR prism is maintained at a substantially consistent level, or a press-down pressure for holding the sample is maintained at a substantially consistent level. Then, a measurement of the infrared (IR) spectrum profile is conducted for a photoconductor having applied thereto the protective agent, by changing a total application time, and each peak in the IR spectrum profile is evaluated and attributed to a specific material, functional group, or the like. In an exemplary embodiment, a peak area ratio between a peak area attributed to photoconductor and a peak area attributed to protective agent is computed, wherein the peak area ratio becomes greater as an application time of the protective agent increases.

As such, two index values can be obtained in an exemplary embodiment. One index value is an agent coating ratio of the photoconductor obtained by the XPS analysis, in which a coating ratio of the photoconductor is obtained comparing a peak area ratio of a peak attributed to photoconductor and a peak attributed to protective agent obtained by the XPS analysis. Another index value is a peak area ratio of a peak attributed to photoconductor and a peak attributed to protective agent obtained by the ATR method. A ratio of such two index values is used to determine a state of the photoconductor coated with the protective agent in an exemplary embodiment. As described later, when the ratio of such two index values is set in a given range, higher quality images can be produced reliably.

Specifically, a protective layer setting unit of the present invention comprises a protective agent having paraffin as a main component, and an application unit configured to apply the protective agent to the photoconductor in a manner sufficient to satisfy the requirements set forth below.

The following equation (1) indicates "applied-agent amount index" (X) for the protective agent applied to the photoconductor, and the following equation (2) indicates "agent coating ratio" (Y) for the photoconductor coated with the protective agent. A ratio of "X/Y" is preferably used to evaluate the protective layer setting unit in an exemplary embodiment. In an exemplary embodiment, a ratio of (X/Y) is preferably set to 0.020 or less when the protective agent is applied for 120 minutes to the photoconductor.

$$X=Sb/Sa \quad (1)$$

$$Y=(A_0-A)/A0\times100(\%) \quad (2)$$

In the equation (1), an attenuated total reflection (ATR) method, which is an infrared absorption spectrum method, is preferably used for detecting a surface condition of the image carrying member, most preferably using an ATR prism of germanium (Ge) and an incident angle of infrared light of 45° as a measurement condition, for example, and an absorbance spectrum obtained by the ATR method is referred to as the IR spectrum.

An IR spectrum A is observed as the IR spectrum of the surface of the image carrying member before applying the protective agent. An IR spectrum B is observed as the IR spectrum of the protective agent alone. An IR spectrum C is observed as the IR spectrum of the surface of the image carrying member after applying the protective agent for a given time, such as 120 minutes.

After applying the protective agent for 120 minutes, a peak Pa (1770 $cm^{-1}$) for the IR spectrum A, which is not observed in the IR spectrum B (and thus is indicative of the IR spectrum of the image carrying member), is detected with a peak area Sa in the IR spectrum C, and a peak Pb (2850 $cm^{-1}$) for the IR spectrum B, not observed in the IR spectrum A (and thus is indicative of the IR spectrum of the protective agent), is detected with a peak area Sb in the IR spectrum C. An application amount of the protective agent to the image carrying member is evaluated using a peak area ratio of "Sb/Sa" as shown in the equation (1).

In the equation (2), a C1s spectrum of the photoconductor is detected by X-ray photoelectron spectroscopy (XPS) before and after applying the protective agent to the photoconductor. The C1s spectrum including a plurality of peaks, corresponding to different carbon binding energy, and one of the plurality of peaks that is unique to a material contained in the image carrying member (for example, for a polycarbonate containing image carrying member, in a binding energy range of 290.3 eV to 294 eV) may be used as a target peak to determine a coating condition of the photoconductor coated with the protective agent.

A peak area of the target peak with respect to a total area of the C1s spectrum of the photoconductor detected before and after applying the protective agent is termed as a first area value $A_0$(%) and a second area value A(%) to determine a coating condition of the photoconductor. The first area value $A_0$(%) is detected as a value before applying the protective agent. The second area value A(%) is detected as a value after applying the protective agent.

In an exemplary embodiment, when the protective layer setting unit applies the protective agent for 120 minutes to the photoconductor, the ratio of (X/Y) is set from 0.0002 to 0.020, preferably from 0.0002 to 0.016, and more preferably from 0.0002 to 0.014.

If the ratio (X/Y) becomes too great, the protective agent may be excessively applied to the photoconductor, by which the photoconductor may not be charged effectively, or an image blur may occur, which is not preferable. If the ratio (X/Y) becomes too small, the protective agent may not sufficiently protect the photoconductor at an earlier stage (or initial usage timing) of an image forming apparatus, which is not preferable.

In general, the longer the application time for applying the protective agent to the photoconductor, the greater the applied amount of the protective agent. However, the application amount of the protective agent does not increase limitlessly, but the application amount may be saturated at a given level. The application time of 120 minutes may be sufficient to set the application amount of the protective agent at a saturated condition. Accordingly, the ratio (X/Y) is computed after applying the protective agent for 120 minutes to the photoconductor.

In the ATR method, infrared light is not reflected on a boundary face of a sample and an ATR prism, but infrared light projects into an internal portion of a sample (or projects for a projection depth in a sample) and then reflects as total reflection. The projection depth of infrared light is a distance from a surface of a sample, wherein an infrared light intensity at such projection distance becomes 1/e of an infrared light intensity on the surface of the sample, which is defined by the following equation.

$$dp=\lambda/2\pi n_1[\sin^2\theta-(n_2/n_1)^2]^{1/2}$$

dp: projection depth $n_2$ and $n_1$: refractive index of ATR prism and sample

θ: incident angle

λ: wavelength

As indicated in the equation, the projection depth of infrared light into the sample is determined by incident angle, refractive index of ATR prism, and wavelength. Specifically, the greater the incident angle θ, the greater the refractive index of ATR prism, or the smaller the measurement wavelength, the projection depth becomes smaller. If a smaller projection depth is used, a condition closer to the surface of the sample can be obtained as an IR spectrum.

Specifically, the ATR prism is preferably a germanium (Ge) prism having a higher refractive index to obtain condition information closer to the surface of the sample, which in the case of the present invention is a photoconductor before and after coating with the protective agent. Further, an incident angle of infrared light to the sample is set to 45° so as to obtain the evaluation index "Sb/Sa" more precisely. With such preferred conditions of using a germanium (Ge) prism as the ATR prism and setting the incident angle of infrared light to 45°, an application amount of the protective agent on the photoconductor can be determined more precisely.

FIG. 1 shows an example of an IR spectrum obtained by the ATR method, in which a protective agent includes paraffin as a main component. IR spectrum A is for a photoconductor, including polycarbonate, before applying the protective agent. IR spectrum B is for the protective agent including paraffin. IR spectrum C is for the photoconductor after applying the protective agent.

In FIG. 1, a peak Pb is attributed to a methylene group, which is detectable with a sufficient intensity. Accordingly, the peak Pb can be preferably used for evaluating the protective agent on the photoconductor. Further, a peak Pa is attributed to a polycarbonate bond included in the photoconductor, which is detectable with a sufficient intensity. Accordingly, the peak Pa can be preferably used for evaluating the protective agent on the photoconductor. Such peak Pa may be preferably used as an index peak.

Because the peak Pa and the peak Pb can be detected at wavenumbers ($cm^{-1}$), closer to each other, the projection depth of the light used for detection can be set to values closer to each other, by which the evaluation index "Sb/Sa" can be preferably computed with a higher sensitivity and higher reliability.

In general, materials used for detecting peaks, such as peak Pa, may exist in a photoconductor with some concentration variation in a depth direction of a photoconductive layer, and further other materials, such as filler agent, may also be dispersed in a photoconductor with some concentration variation in a depth direction of a photoconductive layer. Accordingly, if the peak Pa and the peak Pb can be detected at wavenumbers ($cm^{-1}$), closer to each other, the projection depth for each of the peak Pa and the peak Pb can be set closer to each other, by which an effect of the above-mentioned concentration variation to detection precision of the peak Pa and the peak Pb can be reduced. Therefore, the closer the projection depth of the peak Pa and the peak Pb, the more reliable for obtaining better evaluation index "Sb/Sa." As for a peak intensity of the IR spectrum, absorbance is preferably used for quantitative analysis instead of the transmission factor.

In the FT-IR analysis, an application amount of the protective agent on the photoconductor may be evaluated by just observing a peak intensity (or area) attributed to a protective agent. However, in the ATR method, it is difficult to effectively evaluate an application amount of the protective agent on the photoconductor by just using peak intensity (or area) alone because the peak area may fluctuate or vary due to a fluctuation or variation of press-down pressure for holding a sample. Instead, a peak area ratio between a peak area attributed to a protective agent and a peak area attributed to a photoconductor is used for evaluating an application amount of the protective agent to the photoconductor so as to conduct an evaluation of an application amount of the protective agent more reliably. Such peak area ratio may be used as an evaluation index.

Figure 2:
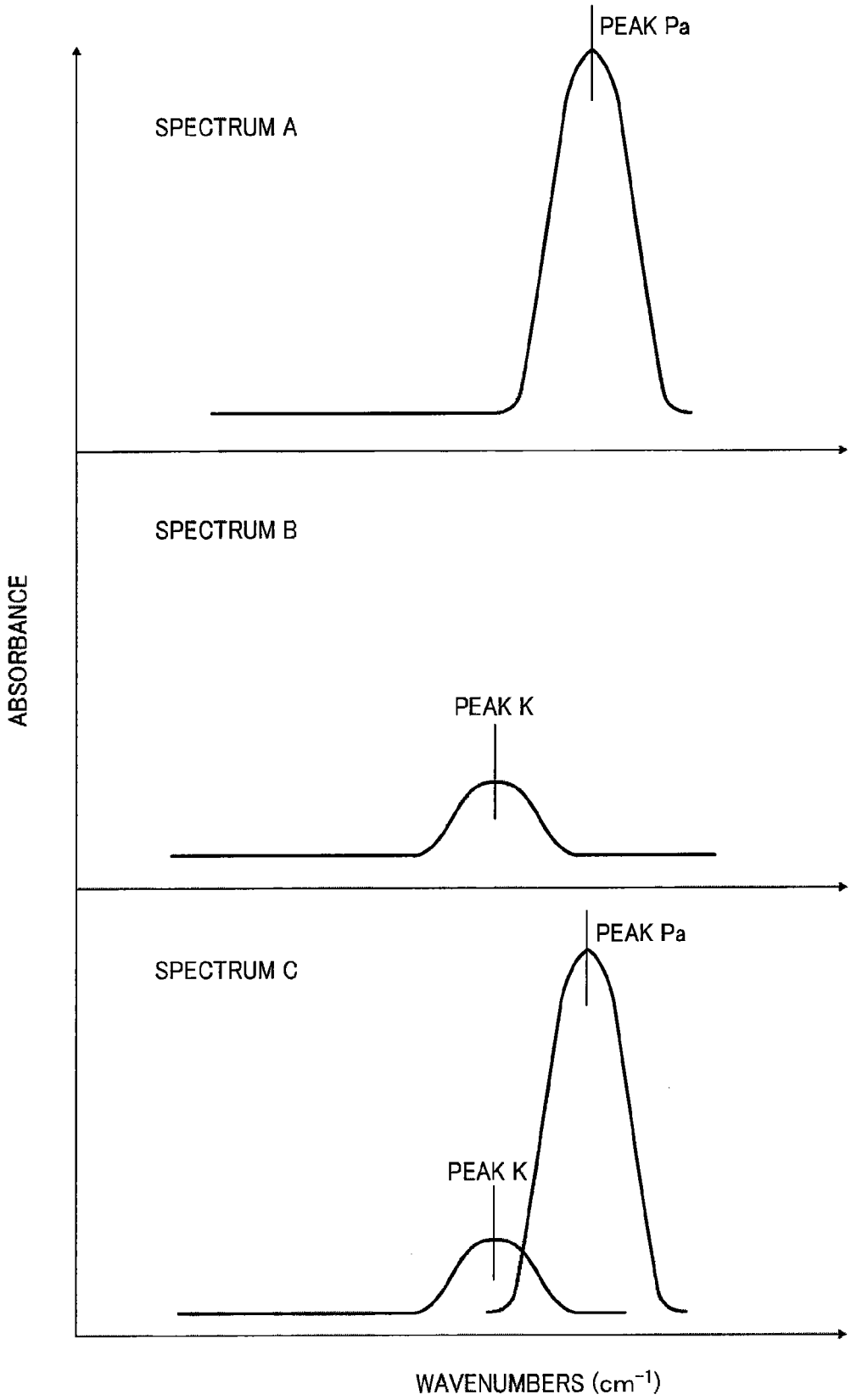
FIG. 2 shows one pattern of IR spectrum A to C used for detection.
Figure 3:
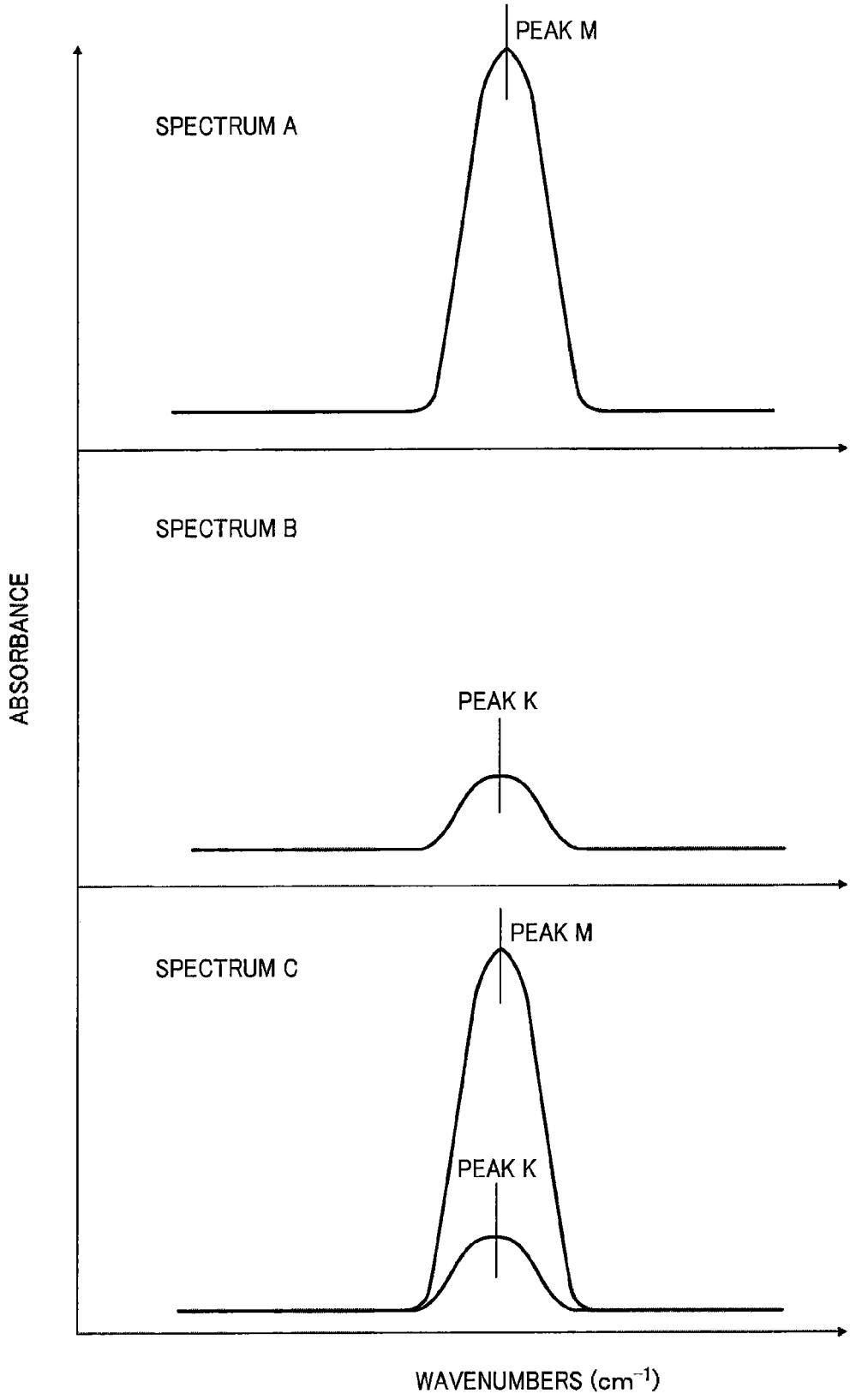
FIG. 3 shows one pattern of IR spectrum peaks, which is not preferable for detection.
Figure 4:
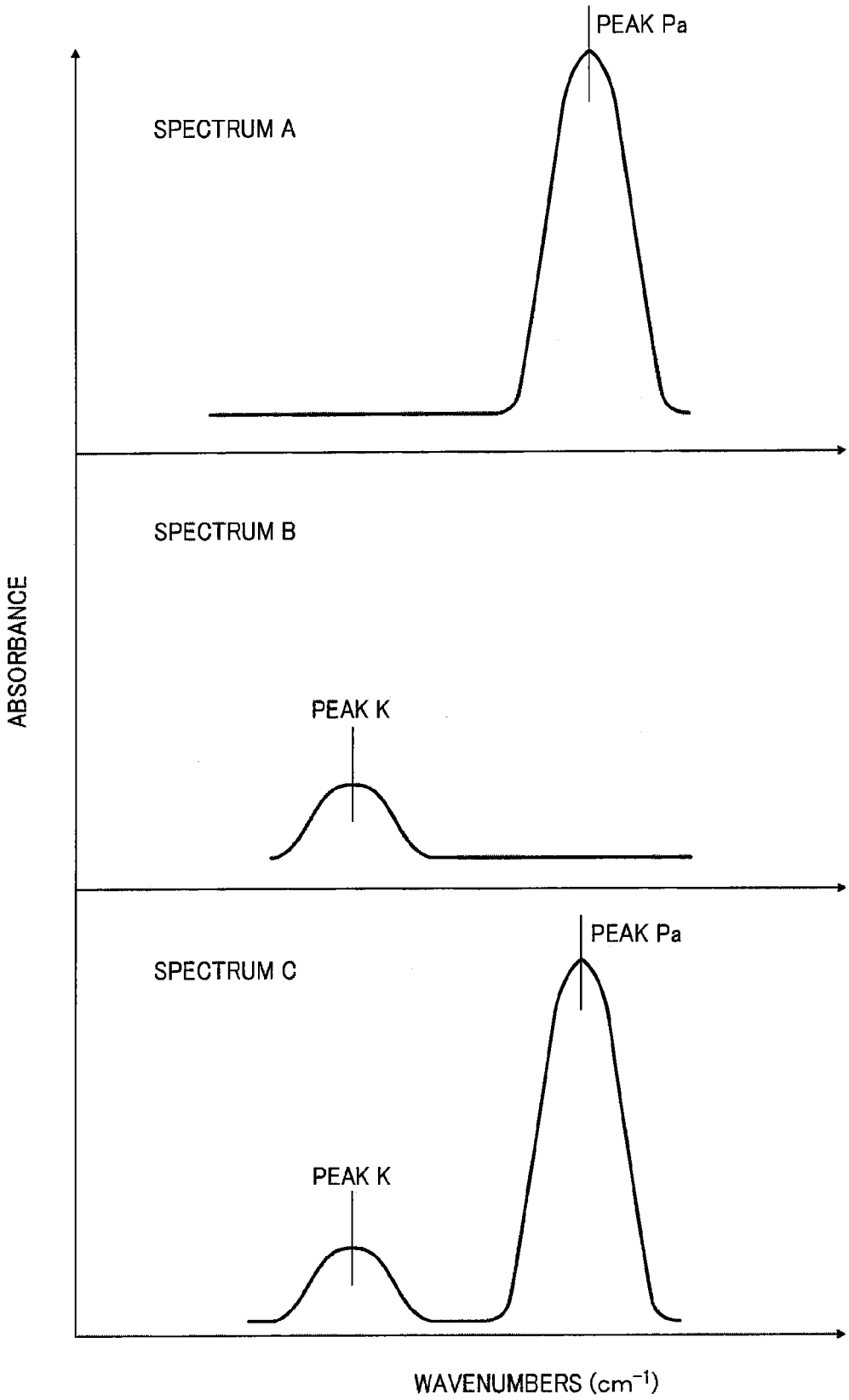
FIG. 4 shows another one pattern of IR spectrum A to C used for detection.

A description is given to a relative position of peaks in the IR spectrum A, the IR spectrum B, and the IR spectrum C with reference to FIGS. 2 to 4. The IR spectrum C indicates a spectrum after applying the protective agent on the photoconductor, and thereby includes components of the IR spectrum A and the IR spectrum B.

In FIG. 2, the peak Pa of the IR spectrum A has a wavenumber, which is not detected in the IR spectrum B. In other words, a peak is not detected in the IR spectrum B at the wavenumber that the peak Pa is detected in the IR spectrum A. If a peak is detected in both of the IR spectrum A and the IR spectrum B at a same wavenumber as shown in FIG. 3, such peak (peak M in FIG. 3) is not preferably used for computing the peak area ratio "Sb/Sa." Preferably, as shown in FIG. 4, the peak Pa in the IR spectrum A and a given specific peak (peak K) in the IR spectrum B have no overlapping area. In other words, it is preferable that the peak Pa and the peak K do not overlap each other at peak top or tail of each peak.

If the peak Pa and the peak K overlap each other at peak top or tail of each peak as shown in FIG. 2, a differential spectrum of the IR spectrum C and the IR spectrum B needs to be computed, in which a peak area of the peak K is subtracted from the IR spectrum C to obtain a correct value of the peak Pa, by which the peak area ratio "Sb/Sa" can be computed effectively by eliminating an effect of the peak K of the IR spectrum B. However, such subtraction step can be omitted if the peak Pa has an area, which is too great compared to the peak K, even if the peak Pa and the peak K overlap each other at peak top or tail of each peak. If such subtraction step can be omitted, a computation of the peak area ratio "Sb/Sa" can be simplified and a computation can be conducted more precisely.

Further, the peak Pb in the IR spectrum C is attributed to one peak in the IR spectrum B, which means the peak Pb does not substantially exist in the IR spectrum A.

Figure 5:
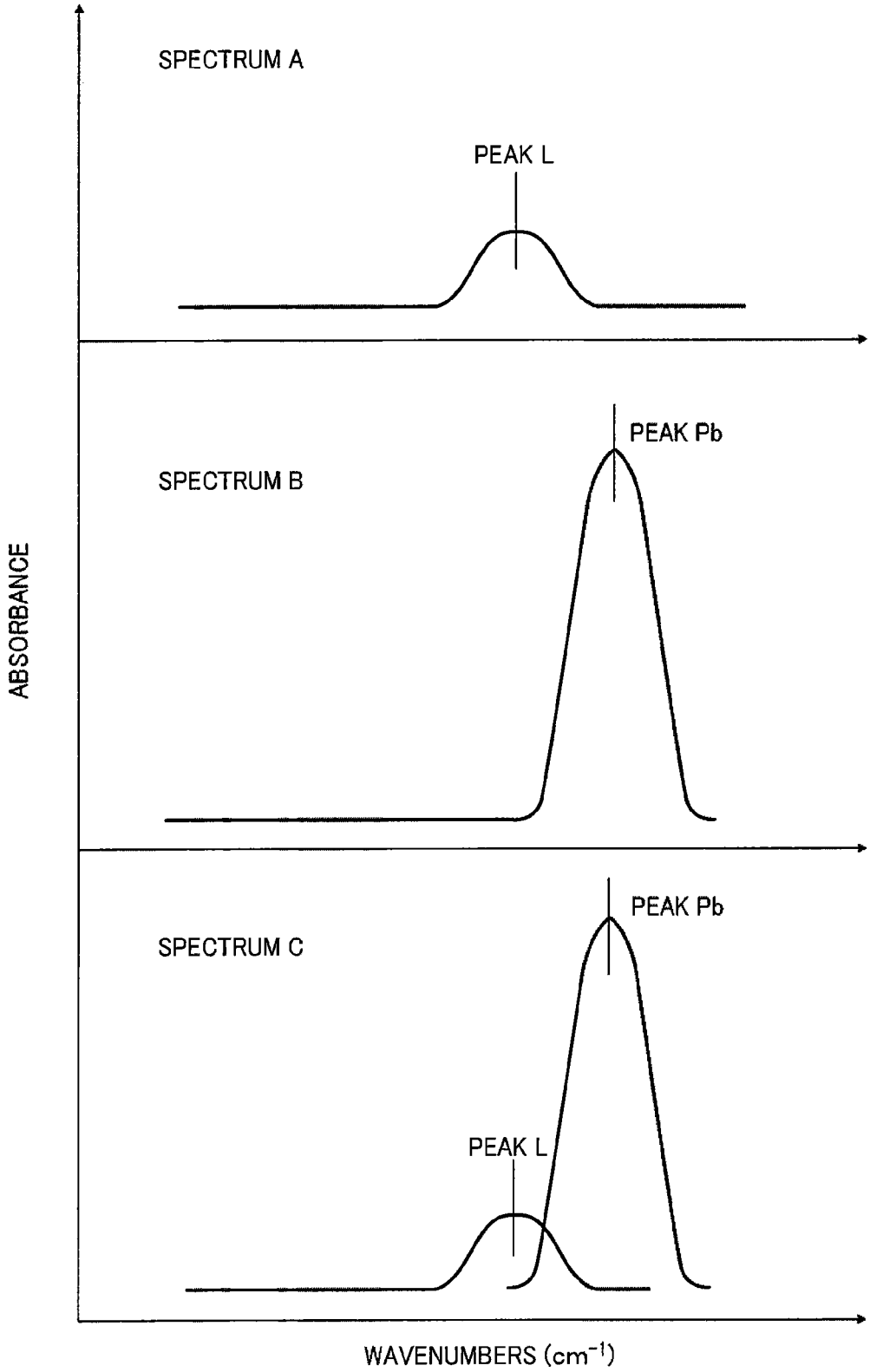
FIG. 5 shows another pattern of IR spectrum A to C used for detection.
Figure 6:
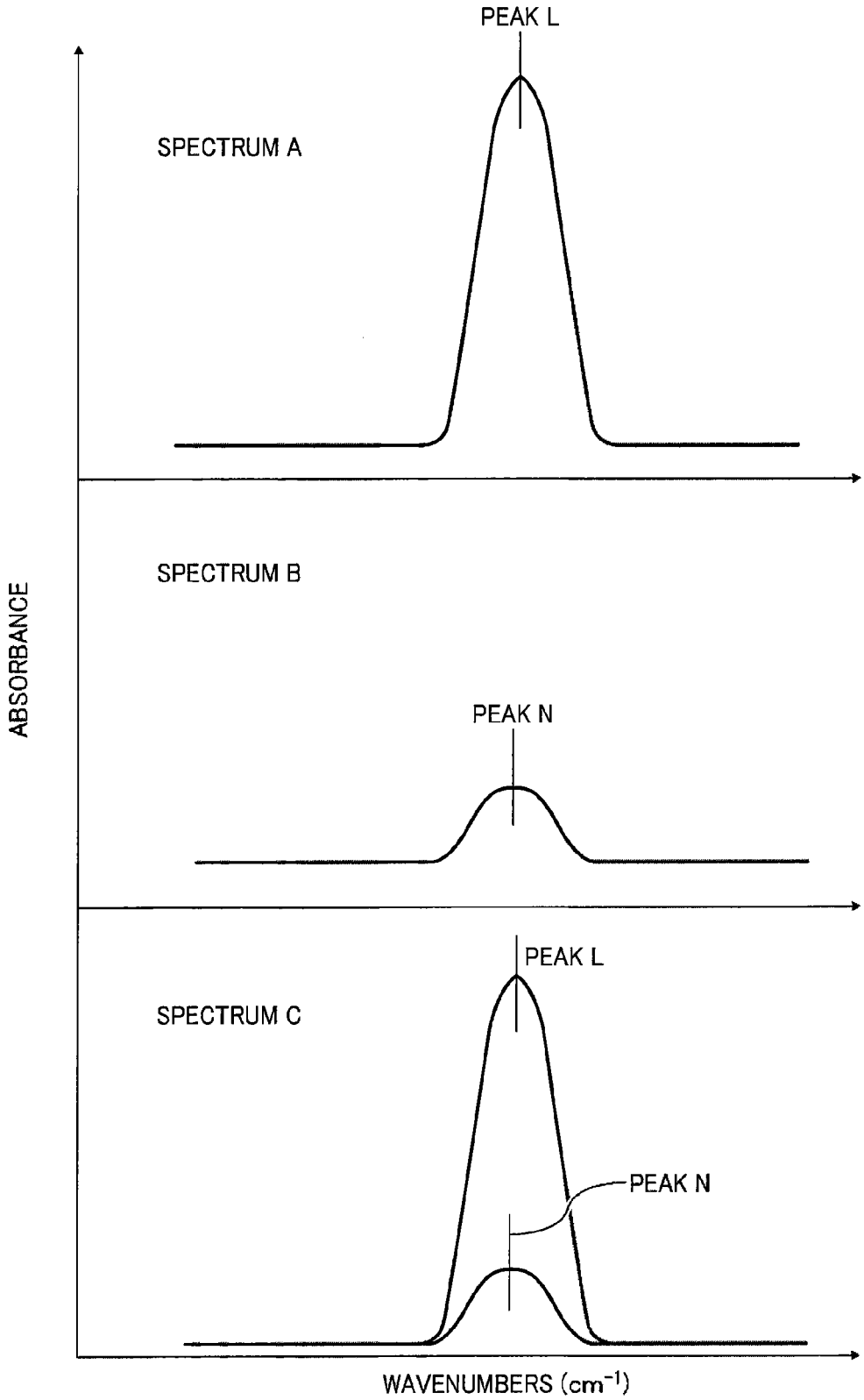
FIG. 6 shows one pattern of IR spectrum, which is not preferable for detection.
Figure 7:
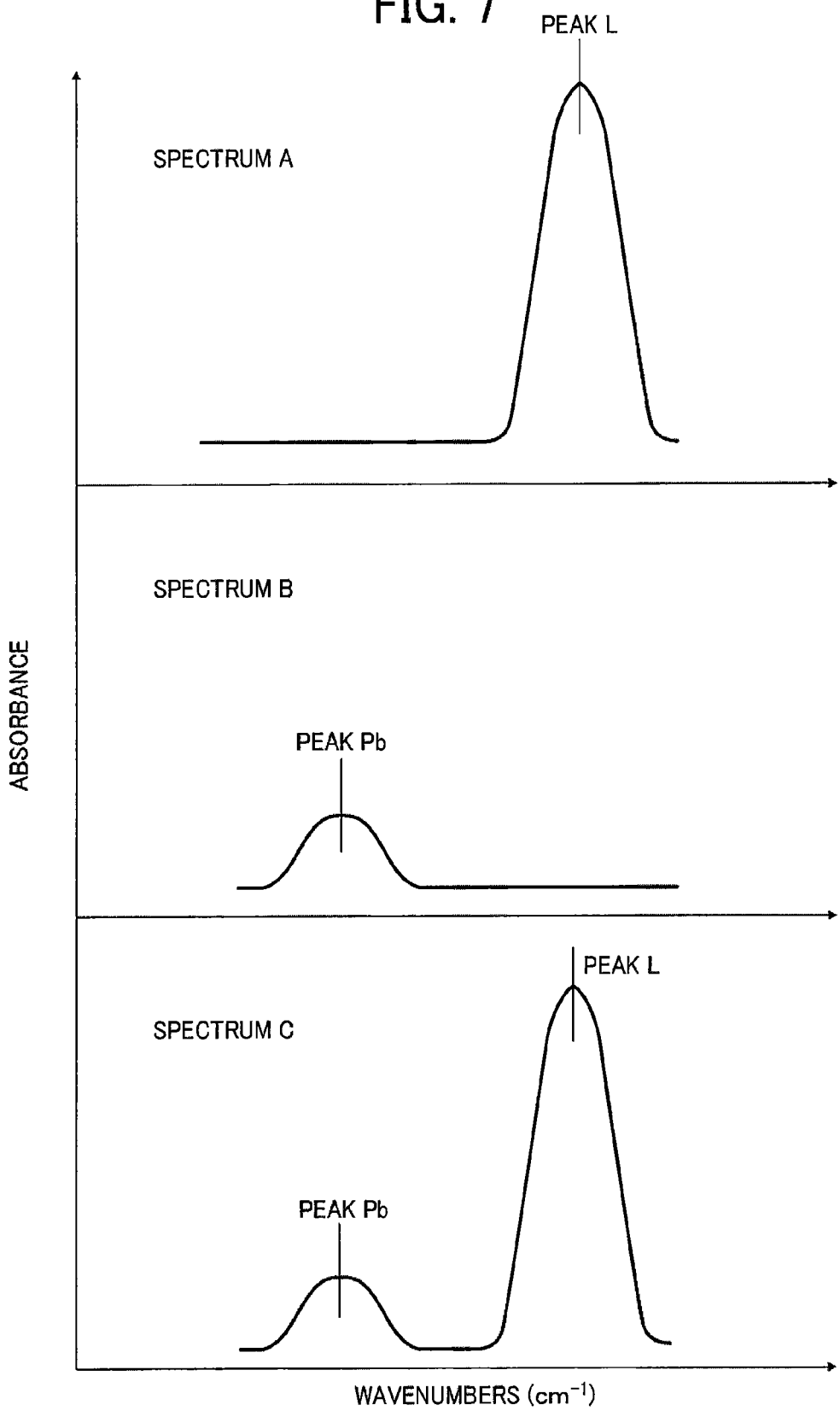
FIG. 7 shows another one pattern of IR spectrum A to C used for detection.

In FIG. 5, the peak Pb of the IR spectrum B has a wavenumber, which is not detected in the IR spectrum A. In other words, a peak is not detected in the IR spectrum A at the wavenumber that the peak Pb is detected in the IR spectrum B. If a peak is detected in both of the IR spectrum A and the IR spectrum B at a same wavenumber as shown in FIG. 6, such peak (peak N in FIG. 6) is not preferably used for computing the peak area ratio "Sb/Sa." Preferably, as shown in FIG. 7, the peak Pb in the IR spectrum B and a given specific peak (peak L) in the IR spectrum A have no overlapping area. In other words, it is preferable that the peak Pb and the peak L do not overlap each other at peak top or tail of each peak. If the peak Pb and the peak L overlap each other at peak top or tail of each peak as shown in FIG. 5, a differential spectrum of the IR spectrum C and the IR spectrum A needs to be computed, in which a peak area of the peak L is subtracted from the IR spectrum C to obtain a correct value of the peak Pb, by which the peak area ratio "Sb/Sa" can be computed effectively by eliminating an effect of the peak L of the IR spectrum A. However, such subtraction step can be omitted if the peak Pb has an area, which is too great compared to the peak L, even if the peak Pb and the peak L overlap each other at peak top or tail of each peak as shown in FIG. 5. If such subtraction step can be omitted, a computation of the peak area ratio "Sb/Sa" can be simplified and a computation can be conducted more precisely.

In an exemplary embodiment, the protective layer setting unit sets the agent coating ratio Y, defined by $((A_0-A)/A_0\times 100)(\%)$, for a process cartridge to 70% or more, preferably 75% or more, and more preferably 80% or more when the protective agent is applied to the photoconductor for 120 minutes, for example.

If the agent coating ratio Y is too small, the photoconductor may not be coated with the protective agent with a sufficient speed, by which a photoconductor may not be effectively protected from an effect of AC charging during a charging process and a frictional pressure between the photoconductor and a cleaning blade may partially become greater, resulting in damage to the photoconductor and occurrence of abnormal images, which is not preferable.

If an AC charging method is used, which uses a voltage having direct current superimposed with alternating current, electric discharges repeatedly occur between the photoconductor and a charge device, such as charge roller, for thousands of times per second, and thereby the photoconductor may receive damage during a charging process if the photoconductor is not supplied with a sufficient amount of the protective agent. If the photoconductor is damaged, the photoconductor and a cleaning blade may cause a greater frictional pressure therebetween, by which abnormal images may occur, which is not preferable.

Practically, a XPS measurement process for the above-described coating ratio needs breaking of a photoconductor, and thereby the photoconductor used for measuring the coating ratio cannot be assembled in a process cartridge. Accordingly, preferably, one or more sample photoconductors may be selected among photoconductors coated with a protective agent by a same application method to measure a agent coating ratio on photoconductors to confirm that an agent coating ratio of photoconductors can be set to a given level or range according to an exemplary embodiment. The XPS measurement for photoconductors may be preferably conducted for a same manufacturing lot number for protective layer setting units because manufacturing conditions of each manufacturing lot may vary. The XPS measurement may be required so that the protective layer setting units, shipped from a factory, can set the agent coating ratio according to an exemplary embodiment to photoconductors.

Figure 8:
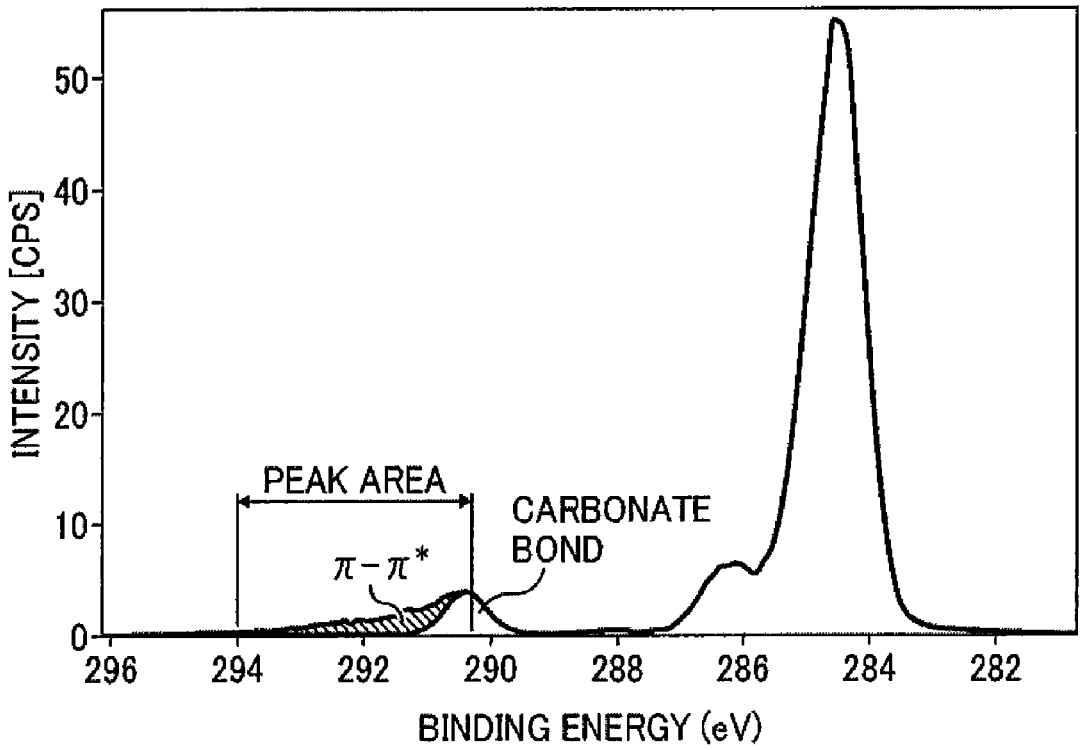
FIG. 8 shows an intensity profile of binding energy for a surface of a photoconductor before applying a protective agent, the binding energy is detected by XPS analysis.
Figure 9A:
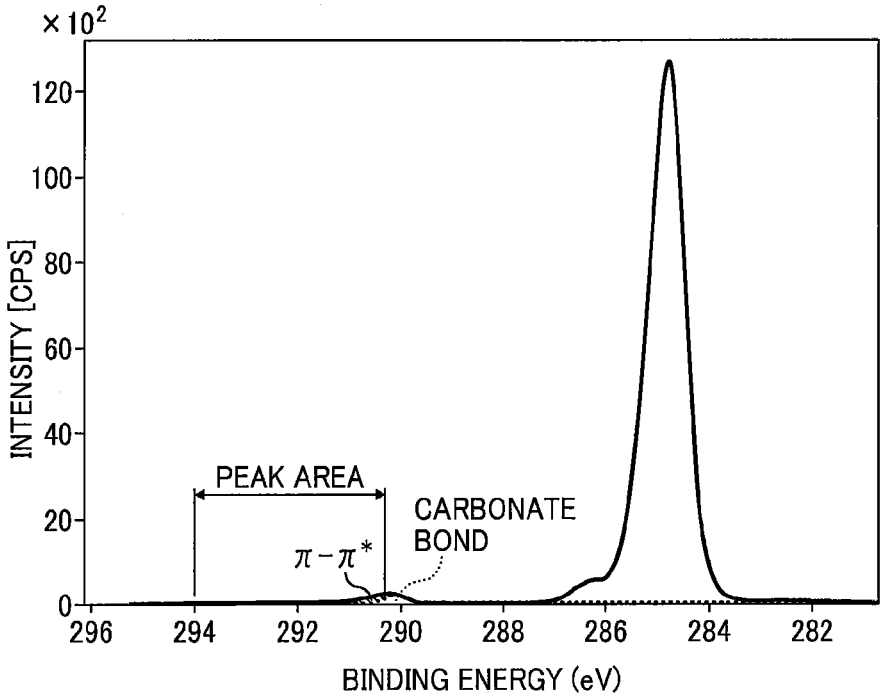
Figure 9B:
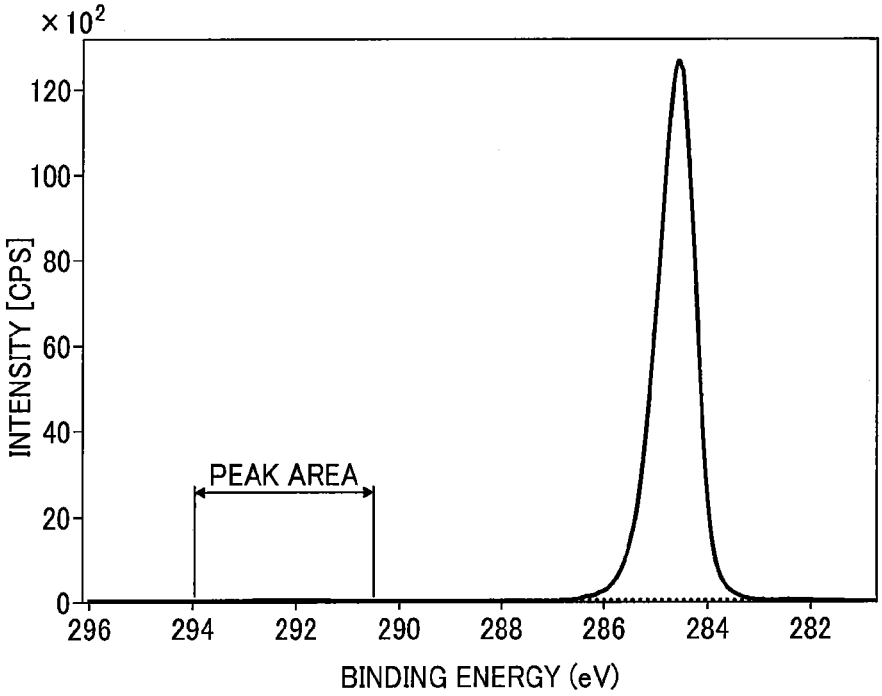

FIGS. 8 and 9 show example intensity profiles of binding energy for a surface of a photoconductor before or after applying a protective agent to a photoconductor, detected by XPS analysis. FIG. 8 shows an intensity profile of binding energy for a surface of a photoconductor before applying a protective agent, and FIG. 9 shows an intensity profile of binding energy for a surface of a photoconductor after applying a protective agent. FIG. 9A shows an intensity profile of binding energy for a surface of a photoconductor applied with a protective agent at an agent coating ratio of 74%, and FIG. 9B shows an intensity profile of binding energy for a surface of a photoconductor applied with a protective agent at an agent coating ratio of 98%. Hereinafter, a method of computing the aforementioned $A_0$ and A is explained with reference to FIGS. 8 and 9.

First, with reference to FIG. 8, a method of computing the first area value "$A_0$" from the C1s spectrum before applying a protective agent is explained. Then, with reference to FIG. 9, a method of computing the second area value "A" from the C1s spectrum after applying a protective agent is explained. In this disclosure, the C1s spectrum most preferably means a spectrum of binding energy ranging from 281 eV to 296 eV shown in FIG. 8, for an image carrying member containing polycarbonate. The C1s means "is orbit of carbon (C1s orbit)." Accordingly, the C1s spectrum is a photoelectron spectrum, which is obtained by irradiating an X ray to a sample and detecting photoelectron emission from the is orbit of carbon (C1s orbit). A total area of the C1s spectrum can be obtained by separating peaks included in the C1s spectrum, determining each area of each peak, and then adding values of each area of each peak, or can be obtained by computing the C1s spectrum as one area. From a viewpoint of saving a process of separating peaks in the C1s spectrum and obtaining a higher precision value, a total area of the C1s spectrum can be preferably obtained by computing the C1s spectrum as one area. Hereinafter, the total area of the C1s spectrum before applying protective agent, computed by the aforementioned methods, is referred as non-applied total area "$Y_0$."

As shown in FIG. 8, a peak detected in a range of 290.3 eV to 294 eV, which is used for computing the first area value $A_0$, can be separated in two peaks: one peak is attributed to carbonate bonding (area next to shaded area in FIG. 8), and the other peak is attributed to the aforementioned π-π* transition (shaded area in FIG. 8). The other peak attributed to π-π* transition includes a plurality of peaks, superimposed upon one another. Accordingly, a peak area detected in a range of 290.3 eV to 294 eV can be computed by separating a plurality of peaks into each peak, determining a peak area of each peak, and adding the peak area value of each peak. Such peak area before applying a protective agent is referred as non-applied target area "$W_0$."

If a peak in a range of 290.3 eV to 294 eV is not superimposed with a peak having a binding energy of 290.3 eV or less and a peak having a binding energy of 294 eV or more as shown in FIG. 8, the non-applied target area $W_0$ in a range of 290.3 eV to 294 eV can be computed as one area without separating a profile into a plurality of peak profiles. When the non-applied total area $Y_0$ and non-applied target area $W_0$ is computed, the first area value $A_0$ can be computed with a following equation.

$$A_0=(W_0/Y_0)\times 100$$

In case of an example profile shown in FIG. 8, the first area value $A_0$ has a value of 8.7% ($A_0$=8.7%), for example.

Similarly, a computation of the second area value "A" after applying a protective agent is described using the C1s spectrum shown in FIG. 9. As above described, the C1s spectrum preferably means a spectrum ranging from 281 eV to 296 eV, for an image carrying member containing polycarbonate. As similar to the computing method for the $Y_0$, a total area of the C1s spectrum after applying a protective agent is obtained by separating peaks included in the C1s spectrum, determining each area of each peak, and then adding values of each area of each peak, or obtained by computing the C1s spectrum as one area. From a viewpoint of saving a process of separating peaks in the C1s spectrum and obtaining a higher precision value, a total area of the C1s spectrum can be preferably obtained by computing the C1s spectrum as one area. Hereinafter, the total area of the C1s spectrum after applying protective agent, computed by the aforementioned method, is referred as applied total area "$Y_1$."

Further, as similar to the computing method for the first area value $A_0$, the second area value "A" is computed as below. A peak detected in a range of 290.3 eV to 294 eV, which is used for computing the second area value A, can be separated in two peaks: one peak is attributed to carbonate bonding (area next to shaded area in FIG. 9), and the other peak is attributed to π-π* transition (shaded area in FIG. 9). The other peak attributed to the aforementioned π-π* transition includes a plurality of peaks, superimposed upon one another. Accordingly, a peak area detected in a range of 290.3 eV to 294 eV can be computed by separating a plurality of peaks into each peak, determining a peak area of each peak, and adding the peak area value of each peak. Such peak area after applying protective agent is referred as applied target area "W."

If a peak in a range of 290.3 eV to 294 eV is not superimposed with a peak having a binding energy of 290.3 eV or less and a peak having a binding energy of 294 eV or more as shown in FIG. 9, the applied target area W in a range of 290.3 eV to 294 eV can be computed as one area without separating a profile into a plurality of peak profiles. When the applied total area Y and applied target area W are computed, the second area value A can be computed with a following equation.

$$A=(W/Y_1)\times 100$$

Based on the computed first area value $A_0$ and the second area value A, a coating ratio of a photoconductor can be obtained by a following equation.

$$(A_0-A)/A_0)\times 100(\%)$$

In case of an example profile shown in FIG. 9A, the second area value "A" has a value of 2.3% (A=2.3%), and in case of an example profile shown in FIG. 9B, the second area value "A" has a value of 0.2% (A=0.2%). Accordingly, the coating ratio of the photoconductor in FIGS. 9A and 9B respectively becomes 74% and 98% using the above equation because the first area value $A_0$ for FIGS. 9A and 9B is 8.7% as above described.

In an exemplary embodiment, the protective layer setting unit comprises a protective agent having paraffin as a main component and shaped as a protective agent bar, and an application unit. The application unit comprises a brush roller and a blade. The brush roller has a metal core and a number of fibers preferably formed on the metal core by an electrostatic implantation method with a fiber density of 50,000 to 600,000 fibers per square inch, for example. Each of the fibers preferably has a diameter of from 28 μm to 42 μm, for example. The protective agent bar is pressed against the fibers to scrape the protective agent, and the fibers are pressed against the photoconductor to apply the protective agent to the image carrying member. The blade is pressed against the photoconductor to form the protective agent layer on the photoconductor.

In an exemplary embodiment, a process cartridge comprises the photoconductor and the protective layer setting unit as one unit. In an exemplary embodiment, an image forming apparatus cartridge comprises the protective layer setting unit.

Figure 10:
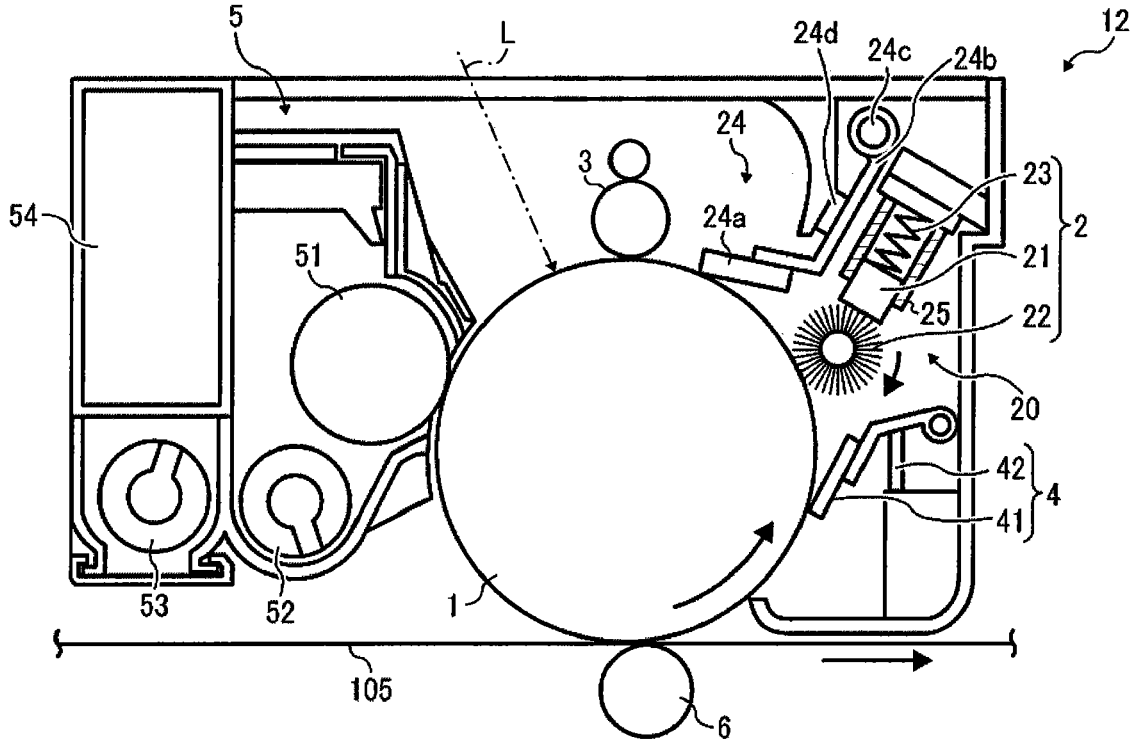
FIG. 10 illustrates a schematic cross-sectional view of a process cartridge having a protective layer setting unit according to an exemplary embodiment.
Figure 11:
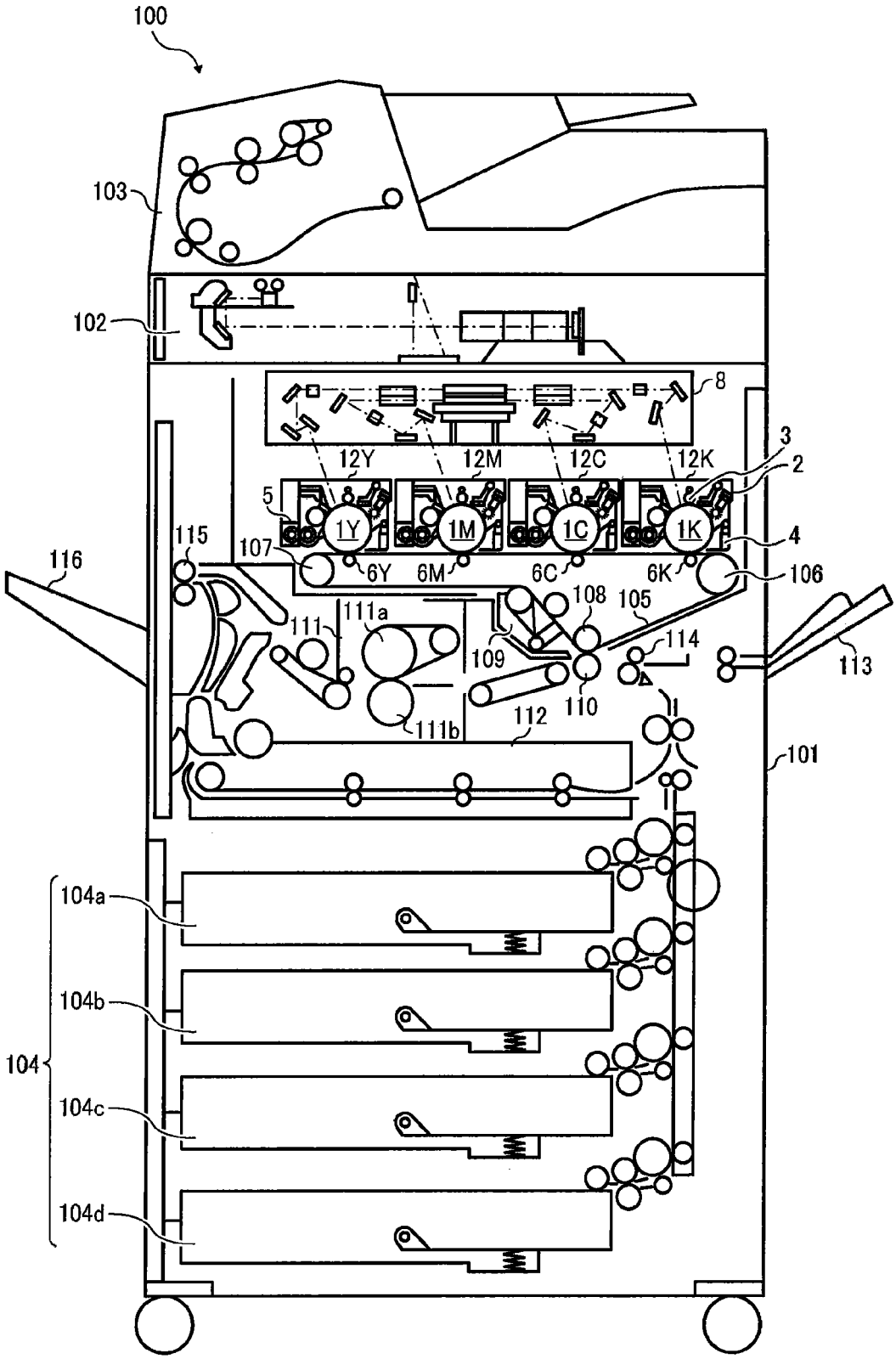
FIG. 11 illustrates a schematic cross-sectional view of an image forming apparatus having a protective layer setting unit according to an exemplary embodiment.

A description is now given to a process cartridge according to an exemplary embodiment with reference to FIG. 10. FIG. 10 illustrates a schematic configuration of a process cartridge 12 according to an exemplary embodiment. The process cartridge 12 includes a photoconductor drum 1 (which may be simply referred as "photoconductor"), a protective layer setting unit 20, a charge roller 3, a cleaning unit 4, and a development unit 5, for example. Such process cartridge 12 may be disposed in proximity to a transfer roller 6 and an intermediate transfer member 105, such as a transfer belt. Although a plurality of photoconductor drums 1Y, 1M, 1C, and 1K, and a plurality of transfer rollers 6Y, 6M, 6C, and 6K may be used as shown in FIG. 11, they are simply referred as photoconductor drum 1 and transfer roller 6 respectively because each of the photoconductor drums or each of the transfer roller has a similar configuration one another. The photoconductor drum 1 can be supplied with a protective agent using the protective layer setting unit 20, which is disposed between the cleaning unit 4 and the charge roller 3. The protective layer setting unit 20 includes an agent applicator 2, and a layer adjusting unit 24, wherein the agent applicator 2 is disposed at a upstream side of the rotation direction of the photoconductor drum 1 with respect to the layer adjusting unit 24. Such protective layer setting unit 20 can be used as an "application unit" for applying a protective agent onto the photoconductor drum 1.

The cleaning unit 4 removes toner remaining on the photoconductor drum 1 after an image transfer process. In an exemplary embodiment, the cleaning unit 4 cleans the photoconductor surface before applying the protective agent to the photoconductor drum 1 to apply the protective agent at a good surface condition. Accordingly, the cleaning unit 4 may be one part of the protective layer setting unit 20. The development unit 5 includes a developing roller 51, agitation screws 52 and 53 for agitating and transporting a developing agent, and a toner compartment 54.

The agent applicator 2 includes a biasing force applicator 23, a layer adjusting unit 24, and a support guide 25, for example. The support guide 25 supports an agent bar 21 so as to prevent shaking of the agent bar 21. In an exemplary embodiment, the agent bar 21 can be prepared by a melt-casting method or a compression casting method. In the melt-casting method, a protective agent is melted and poured in a cast, and then cooled. In the compression casting method, a powder of the protective agent is compressed.

The cleaning unit 4 includes a cleaning member 41, and a biasing device 42, for example. After conducting a transfer process, partially degraded protective agent or toner remaining on the surface of the photoconductor drum 1 can be cleaned by the cleaning member 41, supported by the biasing device 42 of the cleaning unit 4. The cleaning member 41 may have a blade shape, for example. In FIG. 10, the cleaning member 41 is angled and contacted to the photoconductor drum 1 in a counter direction.

The layer adjusting unit 24 includes a blade 24*a*, a blade supporter 24*b*, a shaft 24*c*, and a spring 24*d*. The blade 24*a* is angled and contacted to the photoconductor drum 1 in a trailing direction, for example. The blade supporter 24*b*, supporting one end of the blade 24*a*, is rotatable about the shaft 24*c*. The spring 24*d* biases the blade supporter 24*b* so as to press the blade 24*a* against the photoconductor drum 1.

The agent bar 21 is pressed against brushes of an agent applicator 22 using a biasing force of the biasing force applicator 23 to transfer the protective agent from the agent bar 21 to the brushes, wherein the agent applicator 22 may be formed as brush roller, and the biasing force applicator 23 may include a spring, for example. The agent applicator 22, rotating at a given speed having a different linear velocity with respect to the photoconductor drum 1, slidably contacts the photoconductor drum 1 to apply the protective agent to the surface of the photoconductor drum 1 from the brushes, which has the protective agent transferred from the agent bar 21.

Depending on material types of protective agent, a protective layer may not be effectively and uniformly formed on the photoconductor drum 1 just by applying the protective agent. In light of such situation, the layer adjusting unit 24 has a blade 24*a* as a layer forming device and a blade supporter 24*b* to form a protective layer uniformly on the photoconductor drum 1. The blade supporter 24*b* supports the blade 24*a* pressed against the photoconductor drum 1. With such configuration, the photoconductor drum 1 can be supplied with a protective agent sufficiently, and a uniform thin protective layer can be effectively formed on the photoconductor drum 1 by the layer adjusting unit 24.

The cleaning unit 4 removes protective agent degraded by electrical stress and toner remaining on the photoconductor drum 1. Although the layer adjusting unit 24 can be used as a cleaning member, both of the layer adjusting unit 24 and the cleaning member 41 are preferably disposed in the process cartridge 12 as shown in FIG. 10 because material removing function and layer forming function may require different types of devices due to different contact conditions for the removing function and layer forming function. As shown in FIG. 10, the cleaning unit 4 is preferably disposed at an upstream side of rotation direction of the photoconductor drum 1 with respect to the agent applicator 22.

After a transfer process, the surface of the photoconductor drum 1 has degraded protective agent and remaining toner. The cleaning member 41 cleans such residuals from the photoconductor drum 1. The cleaning member 41 is angled and contacted to the photoconductor drum 1 in a counter direction, for example.

After the cleaning unit 4 cleans the photoconductor surface, new protective agent is supplied to the photoconductor surface by the agent applicator 22, and the protective agent is extended on the photoconductor surface as a thin protective layer by the blade 24*a* of the layer adjusting unit 24. The protective agent used in an exemplary embodiment can be absorbed well to a higher hydrophilic portion of the photoconductor surface, wherein the hydrophilic portion is caused by electrical stress. Accordingly, even if the photoconductor surface is partially degraded by greater electrical stress, which may occur temporarily, degradation of the photoconductor can be reduced or lessened by absorption of the protective agent on the photoconductor.

After the charge roller 3 charges the photoconductor drum 1 supplied with a protective layer, an optical writing unit (not shown) irradiates a laser beam L to the photoconductor drum 1 to form a latent image on the photoconductor drum 1, and then the latent image is developed by toner supplied by the development unit 5 as a toner image, which is transferred to the intermediate transfer member 105, such as a transfer belt, by using the transfer roller 6. If the toner image is directly transferred to a transfer member from the photoconductor drum 1, the transfer member may be a recording sheet.

The blade 24*a* of the layer adjusting unit 24 may be made from a known elastic body, such as urethane rubber, hydrin rubber, silicone rubber, fluorocarbon rubber, or the like, which can be used alone or mixed. Such blade 24*a* may be coated with a material having a lower frictional coefficient to reduce friction at a contact portion with the photoconductor drum 1, wherein the blade 24*a* may be coated with such material by a dipping method or the like. Further, to adjust hardness of the elastic body, fillers such as organic filler or inorganic filler can be dispersed in the elastic body.

Such blade 24*a* is fixed to the blade supporter 24*b* using adhesive or fused directly to the blade supporter 24*b* so that a leading edge of the blade 24*a* can be effectively contacted to the photoconductor drum 1 with a given pressure. The blade 24*a* has a thickness of from 0.5 mm to 5 mm, and preferably from 1 mm to 3 mm, for example, wherein the thickness of the blade 24*a* is determined in view of pressure biased to the blade 24*a*. The blade 24*a* has a free length portion of from 1 mm to 15 mm, and preferably from 2 mm to 10 mm, for example, wherein the free length of the blade 24*a* is also determined in view of pressure biased to the blade 24*a*.

Alternatively, the blade 24*a* can be made from a resilient metal and an elastic material formed on the resilient metal by a coating method or a dipping method using a coupling agent or a primer component. Further, a thermosetting process may be conducted for such blade 24*a* made from a resilient metal and an elastic material. Further, such blade 24*a* may be subjected to a surface polishing process. The resilient metal may be a sheet spring, and the elastic material may be resin, rubber, elastomer, or the like. The resilient metal has a thickness of from 0.05 mm to 3 mm, and preferably from 0.1 mm to 1 mm, for example. Further, the blade 24*a* made from the resilient metal may be bent in a direction parallel to a support direction after fixing the blade 24*a* to the blade supporter 24*b* to prevent twisting of the blade 24*a*. The surface layer of the blade 24*a* may be fluorocarbon polymer, such as PFA (perfluoroalkoxy), PTFE (polytetrafluoroethylene), FEP (fluorinated ethylene-propylene), PVDF (polyvinylidene fluoride), fluorocarbon rubber; and silicone elastomer, such as methylphenyl silicone elastomer, but not limited to these. These can be used alone or used with filler material, as required.

Further, the blade 24*a* may be pressed against the photoconductor drum 1 with a linear load of preferably from 5 gf/cm to 80 gf/cm, more preferably from 10 gf/cm to 60 gf/cm, which is effective for extending and forming a protective layer on the photoconductor drum 1.

A description is now given to the agent applicator 22. The agent applicator 22 may preferably be a brush roller having a number of brush fibers, which is used for supplying a protective agent to the photoconductor drum 1. Such brush fibers have a given level of flexibility to reduce mechanical stress to be applied to a surface of the photoconductor drum 1. Such brush fibers having some flexibility may be made from known materials having flexibility, such as polyolefin resin (e.g., polyethylene, polypropylene); polyvinyl resin and polyvinylidene resin (e.g., polystyrene, acrylic resin, polyacrylonitrile, polyvinyl acetate, polyvinyl alcohol, polyvinyl butyral, polyvinyl chloride, polyvinyl carbazole, polyvinyl ether, polyvinyl ketone); copolymer of polyvinyl chloride/vinyl acetate; copolymer of styrene/acrylic acid; styrene/butadiene resin; fluorocarbon polymer (e.g., polytetrafluoroethylene, polyvinyl fluoride, polyvinylidene fluoride, polychlorotrifluoroethylene); polyester; nylon; acrylic; rayon; polyurethane; polycarbonate; phenol resin; and amino resin (e.g., urea/formaldehyde resin, melamine resin, benzoganamine resin, urea resin, polyamide resin), for example. Such materials can be used alone or in combination. Further, to adjust flexibility of brush fibers, diene rubber, styrene-butadiene rubber (SBR), ethylene-propylene rubber, isoprene rubber, nitrile rubber, urethane rubber, silicone rubber, hydrin rubber, and norbornene rubber, or the like can be added.

The brush roller used as the agent applicator 22 has a metal core and brush fibers formed on the core by winding brush fibers in a spiral manner, for example. Such brush fibers may have a fiber diameter of from 10 μm to 500 μm, a fiber length of from 1 mm to 15 mm, and a fiber density of 10,000 to 300,000 fibers per square inch (or $1.5\times10^7$ to $4.5\times10^8$ fibers per square meter). The brush roller preferably has a higher fiber density to uniformly and stably supply a protective agent to the photoconductor drum 1, in which one brush fiber may be preferably made of a bundle of tiny fibers such as several to hundreds of tiny fibers. For example, one brush fiber may be composed of a bundle of 50 tiny fibers, in which one tiny fiber has 6.7 decitex (6 denier) and a bundle of 50 filaments (or fibers) has a value of 333 decitex computed by a equation of 6.7 decitex×50 filament (or 300 denier=6 denier×50 filament) .

The brush fiber is preferably made of a single fiber having a diameter of 28 μm to 43 μm, more preferably 30 μm to 40 μm, to effectively and efficiently supply a protective agent. Because brush fibers are generally made by twisting fibers, brush fibers may not have a uniform fiber diameter, and thereby a unit of "denier" and/or "decitex" is used in general. However, if a single fiber is used as one brush fiber, brush fibers have a uniform fiber diameter, and thereby brush fibers may be preferably defined by a fiber diameter. If the single fiber has too small a diameter, a protective agent may not be efficiently supplied, which is not preferable. If the single fiber has too great a diameter, the single fiber has too great stiffness, by which the photoconductor drum 1 may be damaged, which is not preferable. Further, a single fiber having a diameter of 28 μm to 43 μm is preferably implanted to a surface of the core in a perpendicular direction, and an electrostatic implantation method using electrostatic force may be preferably used to implant brush fibers on the core. In an electrostatic implantation method, an adhesive agent is applied to the metal core, and then the core is charged. Under the charged condition, a number of single fibers having a diameter of 28 μm to 43 μm are dispersed in a space using electrostatic force, and then implanted on the core applied with the adhesive agent. The adhesive agent is hardened after implantation to form a brush roller. As such, a brush roller having a fiber density of 50,000 to 600,000 fibers per square inch can be made by an electrostatic implantation method.

Further, the brush fiber may have a coat layer on a surface of the fiber, as required, to stabilize a surface shape and fiber property against environmental effect, for example.

The coat layer may be made from a material which can change its shape when brush fibers flex. Such a material having flexibility may be polyolefin resin (e.g., polyethylene, polypropylene, chlorinated polyethylene, chlorosulfonated polyethylene); polyvinyl and polyvinylidene resin such as polystyrene, acrylic resin (e.g., polymethyl methacrylate), polyacrylonitrile, polyvinyl acetate, polyvinyl alcohol, polyvinyl butyral, polyvinyl chloride, polyvinyl carbazole, polyvinyl ether, polyvinyl ketone; copolymer of polyvinyl chloride/vinyl acetate; silicone resin or its modified compound having organosiloxane bonding (e.g., modified compound of alkyd resin, polyester resin, epoxy resin, polyurethane); fluorocarbon resin, such as perfluoro alkylether, polyfluorovinyl, polyfluorovinylvinyliden, polychlorotrifluoroethylene; polyamide; polyester; polyurethane; polycarbonate; amino resin, such as urea/formaldehyde resin; and epoxy resin, for example. These materials can be used alone or in combination.

In an exemplary embodiment, the process cartridge 12 includes a charging unit using corona discharge, scorotron charging, or a charge roller shown in FIG. 10. From a viewpoint of reducing the apparatus size and reducing generation of oxidizing gas, such as ozone, a charge roller is preferably used. The charge roller 3 may contact the photoconductor drum 1 or may be disposed opposite to the photoconductor drum 1 across a gap, such as 20 μm to 100 μm. The charge roller 3, supplied with a given voltage, charges the photoconductor drum 1. The charge roller 3 charges the photoconductor drum 1 with a direct-current voltage (referred as DC charging), or a superimposed voltage superimposing a given alternating voltage to a direct-current voltage (referred as AC charging), for example.

The charge roller 3 may be preferably configured with a conductive supporter, a polymer layer, and a surface layer. The conductive supporter, used as a supporter and an electrode of the charge roller 3, is made from a conductive material, such as metal or metal alloy (e.g., aluminum, cupper alloy, stainless steel), metal (e.g., iron) coated with chrome or nickel, or resin added with a conductive material, for example.

The polymer layer may be a conductive layer having a given resistance, such as from $10^6$ Ωcm to $10^9$ Ωcm, in which a conductive agent is added in a polymeric material to adjust a resistance. The polymeric material may be thermoplastic elastomer, such as polyester, polyolefin; thermoplastic resin having styrene, such as polystyrene, copolymer of styrene/ butadiene, copolymer of styrene/acrylonitrile, copolymer of styrene/butadiene/acrylonitrile; rubber material, such as isoprene rubber, chloroprene rubber, epichloro hydrin rubber, butyl rubber, urethane rubber, silicone rubber, fluorocarbon rubber, styrene/butadiene rubber, butadiene rubber, nitrile rubber, ethylene-propylene rubber, epichlorohydrin/ethyleneoxide copolymer rubber, epichlorohydrin/ethyleneoxide/allylglycidyl ether copolymer rubber, ethylene/propylene/dien copolymer rubber (EPDM), acrylonitrile/butadiene copolymer rubber, natural rubber, and rubber mixing these rubber materials. Among the rubber materials, silicone rubber, ethylene/propylene rubber, epichlorohydrin/ethyleneoxide copolymer rubber, epichlorohydrin/ethyleneoxide/allylglycidyl ether copolymer rubber, acrylonitrile/butadiene copolymer rubber, and rubber mixing these rubber materials are preferably used. Such rubber materials may be foamed rubber or unfoamed rubber.

The conductive agent may be an electronic conductive agent, or an ion conductive agent, for example. The electronic conductive agent may be fine powders of carbon black, such as ketjen black, acetylene black; thermal decomposed carbon, graphite; conductive metal or alloy, such as aluminum, cupper, nickel, stainless steel; conductive metal oxide, such as tin oxide, indium oxide, titanium oxide, tin oxide/antimony oxide solid solution, tin oxide/indium oxide solid solution; and surface-treated insulation material having conductivity, for example. The ion conductive agent may be perchlorate or chlorate of tetraethyl ammonium or lauryl trimethyl ammonium; and perchlorate or chlorate of alkali metal or alkaline-earth metal, such as lithium, magnesium, for example. Such conductive agents may be used alone or in combination. Although such conductive agents may be added to a polymeric material with a given amount, the electronic conductive agent is added to a 100 weight part of polymeric material for a range of 1 to 30 weight part, and more preferably a range of 15 to 25 weight part, and the ion conductive agent is added to a 100 weight part of polymeric material for a range of 0.1 to 5.0 weight part, and more preferably a range of 0.5 to 3.0 weight part.

The surface layer of the charge roller 3, composed of polymeric material, may have a dynamic ultra-micro hardness of from 0.04 to 0.5, for example. Such polymeric material may be polyamide, polyurethane, polyvinylidene fluoride, copolymer of ethylene tetrafluoride, polyester, polyimide, silicone resin, acrylic resin, polyvinyl butyral, copolymer of ethylene tetrafluoroethylene, melamine resin, fluorocarbon rubber, epoxy resin, polycarbonate, polyvinyl alcohol, cellulose, polyvinylidene chloride, polyvinyl chloride, polyethylene, copolymer of ethylene vinyl acetate, or the like, for example. From a viewpoint of separation performance with toner, polyamide, polyvinylidene fluoride, copolymer of ethylene tetrafluoride, polyester, and polyimide are preferably used. Such polymeric materials can be used alone or in combination. Such polymeric material has a number average molecular weight, preferably in a range of 1,000 to 100,000, and more preferably in a range of 10,000 to 50,000, for example.

The surface layer is formed by mixing the polymeric material, the conductive agent, and fine powders. The fine powders may be metal oxide or complex metal oxide, such as silicon oxide, aluminum oxide, barium titanate, or polymer powder of tetrafluoroethylene, vinylidene fluoride, for example, but not limited thereto. Such fine powders can be used alone or in combination.

A description is given to a development unit used in the process cartridge according to an exemplary embodiment with reference to FIG. 10. The process cartridge 12 includes the development unit 51 using a developing agent to develop a latent image formed on the photoconductor drum 1 as a toner image. The developing agent may be a one-component developing agent not having a carrier, or a two-component developing agent having toner and a carrier. As shown in FIG. 10, the development unit 5 includes the developing roller 51 used as a developing agent carrier, partially exposed to the photoconductor drum 1 through an opening of a casing of the development unit 5.

Toner particles supplied to the development unit 5 from a toner bottle (not shown) are agitated with carrier particles and transported by the agitation transport screws 52 and 53, and then carried on the developing roller 51. The developing roller 51 includes a magnet roller and a developing sleeve. The magnet roller generates a magnetic field, and the developing sleeve coaxially rotates around the magnet roller. Chains of carrier particles of the developing agent accumulate on the developing roller 51 with an effect of magnetic force of the magnet roller, and then transported to a developing section facing the photoconductor drum 1.

The developing roller 51 may rotate at a linear velocity greater than a linear velocity of the photoconductor drum 1 at the developing section, for example. Chains of carrier particles accumulated on the developing roller 51 contact a surface of the photoconductor drum 1, and supply toner particles adhered on the carrier surface to the surface of the photoconductor drum 1. At this time, the developing roller 51 is supplied with a developing bias from a power source (not shown) to form a developing electric field at the developing section. In the developing electric field, toner particles move from the developing roller 51 to a latent image on the photoconductor drum 1, and adhere to the latent image. Such toner adhesion to the latent image of the photoconductor drum 1 generates a toner image of each color.

A description is now given to an image forming apparatus according to an exemplary embodiment with reference to FIG. 11. FIG. 11 illustrates a schematic cross-sectional view of an image forming apparatus 100 employing the protective layer setting unit 20 and the process cartridge 12 according to an exemplary embodiment. The image forming apparatus 100 includes an image forming unit 101, a scanner 102, an automatic document feeder (ADF) 103, and a sheet feed unit 104, for example. The image forming unit 101 conducts an image forming. The scanner 102 is disposed over the image forming unit 101, and the ADF 103 is disposed over the scanner 102. The sheet feed unit 104, disposed under the image forming unit 101, includes sheet cassettes 104*a*, 104*b*, 104*c*, and 104*d*. An intermediate transfer member 105, disposed under the image forming unit 101, is extended by support rollers 106, 107, 108 and can be driven in a clockwise direction by a drive unit (not shown), for example. A belt cleaning unit 109 is disposed near the support roller 108 to remove toner remaining on the intermediate transfer member 105 after a secondary transfer. The process cartridges 12Y, 12M, 12C, and 12K for forming images of yellow (Y), magenta (M), cyan (C), and black (K) are arranged in tandem over the intermediate transfer member 105 extended between the support rollers 106 and 107.

An optical writing unit 8 is disposed over the process cartridges 12Y, 12M, 12C, and 12K. A secondary transfer roller 110, used as a transfer device, is disposed opposite the support roller 108 via the intermediate transfer member 105. The secondary transfer roller 110 is used to transfer toner images from the intermediate transfer member 105 to a sheet fed from the sheet feed unit 104. A fixing unit 111 is disposed next to the secondary transfer roller 110 for fixing toner images on the sheet. The fixing unit 111 includes a fixing belt 111*a* and a pressure roller 111*b*. A sheet inverting unit 112 is disposed under the fixing unit 111 to invert faces of the sheet for double face printing.

A description is now given to an image forming process with reference to FIG. 11. Hereinafter, an image forming process using negative/positive process is described. The photoconductor drum 1 may be an OPC (organic photoconductor) having an organic photoconductive layer, which is de-charged by a decharging lamp (not shown) to prepare for an image forming operation. The photoconductor drum 1 is uniformly charged to a negative charge by the charge roller 3. The charge unit 3 is applied with a given voltage, such as direct current voltage superimposed with alternating-voltage, from a voltage power source (not shown), in which the given voltage is used to charge the photoconductor drum 1 to a given potential.

The charged photoconductor drum 1 is then irradiated with a laser beam emitted from the optical writing unit 8 to form a latent image on the charged photoconductor drum 1, in which an absolute potential value of light-exposed portion becomes smaller than an absolute potential value of non-exposed portion. The laser beam, emitted by a laser diode, is reflected by a polygon mirror rotating at a high speed, and then scanned on the surface of the photoconductor drum 1 in an axial direction of the photoconductor drum 1.

The formed latent image is then developed by a developing agent, supplied from a developing sleeve of the development unit 5, as a visible toner image. The developing agent may be toner-only component or a mixture of toner particles and carrier particles. When developing the latent image, a voltage power source (not shown) may supply a given developing bias voltage to the developing sleeve, wherein the developing bias voltage may be direct-current voltage or a voltage having direct-current voltage superimposed with alternating-current voltage having a voltage value, set between a potential of the light-exposed portion and a potential of the non-exposed portion of the photoconductor drum 1, for example.

The toner images formed on the photoconductor drum 1 are transferred to the intermediate transfer member 105 by the transfer roller 6, and the toner image is then transferred from the intermediate transfer member 105 to a transfer medium such as a paper fed from the sheet feed unit 104 or a manual tray 113 and a feed roller 114 by the secondary transfer roller 110, by which an image is formed on the sheet. In the transfer process, the transfer roller 6 is preferably supplied with a transfer bias voltage having a polarity opposite to a polarity of toner particles.

Then, toner particles remaining on the photoconductor drum 1 are removed by the cleaning member 41, and then recovered in a toner recovery section in the cleaning unit 4. Then, the sheet is transported to the fixing unit 11 to fix toner images on the sheet by applying heat and pressure. After the fixing process, the sheet is ejected to a tray 116 by an ejection roller 115. Further, the image forming apparatus 100 can print images on both faces of a transfer medium. When printing images on both faces, a transport route after the fixing unit 111 is switched to transport the sheet to the sheet inverting unit 112 to invert the faces of the sheet, and then the sheet is fed to a secondary transfer nip again to form an image on back face the sheet. Then, the sheet is transported to the fixing unit 111 to fix toner images on the sheet, and the sheet is ejected to the tray 1116 by the ejection roller 115. After an image transfer process, the belt cleaning unit 109 removes toner remaining on the intermediate transfer member 105 to prepare for another image forming operation.

In the image forming apparatus 100, an intermediate transfer method is used to transfer a plurality of toner images to an intermediate transfer member and then further transfer the toner images to a transfer medium, and then the toner images are fixed. Alternatively, in the image forming apparatus 100, a plurality of toner images can be directly transferred from photoconductor drums to a transfer medium, and then the toner images are fixed.

In the image forming apparatus 100, the charge roller 3 preferably contacts the photoconductor drum 1 or is preferably disposed opposite to the photoconductor drum 1 across a tiny gap. The charge roller 3 can preferably reduce oxidizing gas generation, such as ozone, compared to a corona discharge unit, such as corotron, scorotron charging using wire for discharge during a charging process. However, because electrical discharge occurs in proximity to the photoconductor surface when the charge roller 3 is used, the photoconductor drum 1 receives a greater electrical stress. In an exemplary embodiment, the protective layer setting unit 20 is used to apply a protective agent to the photoconductor drum 1, by which the photoconductor drum 1 can be protected from electrical stress effectively and a degradation of the photoconductor drum 1 can be reduced or lessened over time. Accordingly, the image forming apparatus 100 can produce higher quality images over time while reducing variation of image quality caused by environmental condition or the like. Although the protective layer setting unit 20 is installed in the image forming apparatus 100 using the process cartridge 12, the protective layer setting unit 20 can be directly mounted in the image forming apparatus 100.

In an exemplary embodiment, the protective layer setting unit uses a protective agent comprising paraffin in an amount of from 50 to 95 weight percent (wt %). The ratio of paraffin in the protective agent is a ratio of paraffin to all organic constituents in the protective agent. If the protective agent includes inorganic constituent, the ratio of paraffin is a ratio of paraffin to all organic constituents in the protective agent computed by excluding the inorganic constituent.

The evaluation index "Sb/Sa" may vary slightly depending on a ratio of paraffin in a protective agent. However, without relevancy to paraffin ratio in a protective agent, such evaluation index "Sb/Sa" may be preferably set to 0.02 or more after applying a protective agent to a photoconductor for 5 minutes, and may be preferably set to 0.85 or less after applying a protective agent to a photoconductor for 150 minutes, by which a protective agent can be applied on a photoconductor with a preferable application amount.

In an exemplary embodiment, the protective layer setting unit uses a protective agent having paraffin as a main component, for example. The paraffin includes normal paraffin, and isoparaffin, for example, which can be used alone or in combination. In an exemplary embodiment, a protective agent, used as a protective agent bar, comprises paraffin in an amount of 50 wt % (weight percent) or more, more preferably 60 wt % or more, and further preferably 70 wt % or more, for example. If the paraffin amount included in the protective agent is too small, a photoconductor may not be effectively protected by the protective agent, by which the photoconductor may be abraded during image forming, which is not preferable. If the paraffin amount included in the protective agent is too great, the photoconductor surface may not be effectively coated by paraffin, which is not preferable. In general, it is difficult to form a uniform thin layer of paraffin on a photoconductor by using brush or blade pressure if only paraffin is used as a protective agent. Therefore, a protective agent may need to include paraffin and other material.

The other material may be an amphipathic organic compound; hydrocarbons, such as aliphatic unsaturated hydrocarbon, alicyclic saturated hydrocarbon (e.g., cyclo paraffin, cyclic polyolefin), alicyclic unsaturated hydrocarbon, aromatic hydrocarbon; fluorocarbon polymer or wax, such as PTFE (polytetrafluoroethylene), PFA (perfluoroalkoxy), FEP (fluorinated ethylene-propylene), PVDF (polyvinylidene fluoride), ETFE (Ethylene tetrafluoroethylene); silicone polymer or wax, such as polymethyl silicone, polymethylphenyl silicone; inorganic compound having lubricating property, such as mica isinglass, but not limited to these. Among these, amphipathic organic compounds and alicyclic saturated hydrocarbons are preferably included in a protective agent to enhance the application performance of the protective agent, and alicyclic saturated hydrocarbons, such as cyclic polyolefin, are preferably used to form a uniform layer of protective agent on a photoconductor. These materials can be used alone or in combination.

Suitable amphiphilic organic compounds may be anionic surfactant, cationic surfactant, zwitterionic surfactant, nonionic surfactant, or a complex compound of these, for example. Because a protective agent is applied to a photoconductor used for image forming, such protective agent may need to have a property that does not cause a problem on electric property of the photoconductor. The nonionic surfactant, which is an amphiphilic organic compound, may not be ionic dissociated, and thereby electric charge leak by aerial discharge can be reduced and image quality can be maintained at a higher level even if environmental conditions, such as humidity, changes greatly.

The nonionic surfactant may preferably be an ester compound of alkylcarboxylic acid (see chemical formula (I)) and polyalcohol, in which "n" is an integral number from 15 to 35.

$$C_nH_{2n+1}COOH \qquad \text{(chemical formula (1))}$$

If a straight chain alkylcarboxylic acid is used as alkylcarboxylic acid (chemical formula (1)), the amphiphilic organic compound can be preferably adhered on a surface of an image carrying member such as a photoconductor. Specifically, the hydrophobic portion of the amphiphilic organic compound can be oriented to a surface of an image carrying member in an orderly manner, and thereby the amphiphilic organic compound can be preferably adsorbed on the image carrying with a higher adsorption density.

Alkylcarboxylic acid esters have hydrophobicity. The greater the number of alkylcarboxylic acid esters in one molecule, the more effective to reduce an adsorption of dissociated material generated by aerial discharge to a surface of an image carrying member such as a photoconductor, and are more effective to reduce electrical stress to a surface of the image carrying member during a charging process. However, if a ratio of alkylcarboxylic acid ester becomes too great, polyalcohol having hydrophilicity may be blocked by the alkylcarboxylic acid ester, by which adsorption performance may not be effectively obtained depending on a surface condition of the image carrying member. Accordingly, the average number of ester bonds in one molecule of amphiphilic organic compound may be preferably from 1 to 3.

The average number of ester bonds in one molecule of amphiphilic organic compound can be set or adjusted by selecting one amphiphilic organic compound or by mixing a plurality of amphiphilic organic compounds, each compound having different numbers of ester bonds. Suitable amphiphilic organic compounds include anionic surfactant, cationic surfactant, zwitterionic surfactant, and nonionic surfactant, as above described.

Examples of the anionic surfactant include, but are not limited to, compounds of an alkali metal ion (e.g., sodium, potassium), alkaline-earth metal ion (e.g., magnesium, calcium), metal ion (e.g., aluminum, zinc), or ammonium ion bonded with a compound having an anion at a hydrophobic portion, such as alkyl benzene sulfonate, α-olefin sulfonate, alkane sulfonate, sulfuric alkyl salt, sulfuric alkylpolyoxyethylene salt, alkyl phosphate salt, long-chain aliphatic acid salt, α-sulfoaliphatic acid ester salt, and alkyl ether sulfate.

Examples of the cationic surfactant include, but are not limited to, compounds having chlorine, fluorine, bromine, phosphoric ion, nitrate ion, sulphuric ion, thiosulphuric ion, carbonate ion, and hydroxide ion, which are bonded to a compound having a cation at a hydrophobic portion, such as alkyltrimethyl ammonium salt, dialkylmethyl ammonium salt, and alkyldimethylbenzyl ammonium salt.

Examples of the zwitterionic surfactant include, but are not limited to, dimethylalkylamine oxide, N-alkylbetaine, imidazoline derivatives, and alkylamino acid.

Examples of the nonionic surfactant include, but are not limited to, alcohol compounds, ether compounds, or amide compounds, such as long-chain alkylalcohol, alkylpolyoxyethylene ether, polyoxyethylene alkyl phenyl ether, aliphatic acid diethanolamide, alkyl polyglucoxide, and polyoxyethylene sorbitan alkylester. Further, examples of the nonionic surfactant preferably include long-chain alkylcarboxylic acids, such as lauric acid, paltimic acid, stearic acid, behenic acid, lignoceric acid, cerinic acid, montanic acid, melissic acid; polyalcohol, such as ethylene glycol, propylene glycol, glycerin, erythritol, hexitol; and ester compounds having partially anhydride compounds of these.

Examples of ester compounds include, but are not limited to, alkylcarboxylic acid glyceryl or its substitution, such as monoglyceryl stearate, diglyceryl stearate, monoglyceryl palmitate, diglyceryl laurate, triglyceryl laurate, diglyceryl palmitate, triglyceryl palmitate, diglyceryl myristate, triglyceryl myristate, glyceryl palmitate/stearate, monoglyceryl arachidate, diglyceryl arachidate, monoglyceryl behenate, glyceryl stearate/behenate, glyceryl cerinate/stearate, monoglyceryl montanate, monoglyceryl melissate; and alkylcarboxylic acid sorbitan or its substitution, such as monosorbitan stearate, trisorbitan stearate, monosorbitan palmitate, disorbitan palmitate, trisorbitan palmitate, disorbitan myristate, trisorbitan myristate, sorbitan paltimate/stearate, monosorbitan arachidate, disorbitan arachidate, monosorbitan behenate, sorbitan stearate/behenate, sorbitan cerinate/stearate, monosorbitan montanate, monosorbitan melissate, but not limited those. These amphiphilic organic compounds can be used alone or in combination.

Further, the protective agent may include fillers, including but not limited to, metal oxides, silicate compound, mica isinglass, boron nitride, as required.

A description is now given to experiment and its results using a process cartridge prepared according to an exemplary embodiment. It should be noted that Examples used in the experiment are just exemplary, and other configurations can be envisioned based upon the descriptions herein.

Photoconductor Nos. 1 and 2

An aluminum drum (as a conductive supporter) having a diameter of 30 mm was coated with an under layer, a charge generation layer, a charge transport layer, and a surface layer in this order, and dried to form the photoconductor drum having an under layer of 3.6 μm thickness, a charge generation layer of about 0.14 μm thickness, a charge transport layer of 23 μm thickness, and a surface layer of about 3.5 μm thickness. The surface layer was coated using a spray method, and other layers were coated using a dipping method. The surface layer included the following:

(Surface Layer)

Z-type polycarbonate: 10 parts triphenylamine compound (structural formula 1): 7 parts fine alumina particles (particle diameter of 0.3 μm): 5 parts tetrahydrofuran: 400 parts cyclohexanone: 150 parts (structural formula 1)

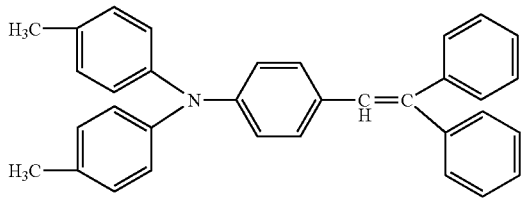

A protective agent bar was prepared as below.

Agent bar No. 1

FT115 (synthesize wax manufactured by Nippon Seiro Co., Ltd.) of 88 weight parts and TOPAS-TM (manufactured by manufactured by Ticona) of 12 weight parts were placed in a glass vessel having a cap, and were agitated and melted at a temperature of 160 to 250 degrees Celsius using a hot stirrer. Then, the melted protective agent was poured in an internal space of an aluminum metal mold, having a size of 12 mm×8 mm×350 mm, heated to 115 degrees Celsius in advance. After cooling to 88 degrees Celsius on a wooden table, the aluminum metal mold is cooled to 40 degrees Celsius on an aluminum table. Then, the solidified product is removed from the mold, and cooled to an ambient temperature while placing a weight on the product to prevent warping. After that, an agent bar No. 1 having a size of 7 mm×8 mm×310 mm was prepared by trimming a portion of the product. The agent bar No. 1 was attached to a metal supporter using a double face tape.

Agent bar No. 2

Normal paraffin (average molecular weight: 640) of 60 weight parts and monosorbitan stearate (HLB: 5.9) of 40 weight parts were placed in a glass vessel having a cap, and were agitated and melted at a temperature of 180 degrees Celsius using a hot stirrer. Then, the melted protective agent was poured in an internal space of an aluminum metal mold, having a size of 12 mm×8 mm×350 mm, heated to 115 degrees Celsius in advance. After cooling to 90 degrees Celsius on a wooden table, the aluminum metal mold was cooled to 40 degrees Celsius on an aluminum table. Then, the solidified product is removed from the mold, and cooled to an ambient temperature while placing a weight on the product to prevent warping. After that, an agent bar No. 2 having a size of 7 mm×8 mm×310 mm was prepared by trimming a portion of the product. The agent bar No. 2 was attached to a metal supporter using a double face tape.

Photoconductor Analysis Before Applying Protective Agent

Samples of the agent bar No. 1 and photoconductor No. 1 were analyzed by FT-IR Avatar370 (manufactured by Thermo Electron Corporation, Thunder Dome) under a condition of one time reflection, ATR prism of Ge, incident angle of 45° for IR spectrum analysis to obtain IR spectrum A and B, which is shown in FIG. 1, wherein the IR spectrum A is for the photoconductor No. 1, and the IR spectrum B is for the agent bar No. 1. In the IR spectrum A of the photoconductor No. 1, the peak Pa1 attributed to a polycarbonate bond is observed at 1770 $cm^{-1}$. In the IR spectrum B of the agent bar No. 1, the peak Pb1 (2850 $cm^{-1}$) and the peak Pb2 (2920 $cm^{-1}$) attributed to methylene group are observed. When the photoconductor was measured by the ATR, a measurement sample having 1 cm×1 cm size was cut from an aluminum base of the photoconductor.

FIG. 8 shows an intensity profile (or C Is spectrum) of binding energy for a surface of the photoconductor, used in the experiment, which was analyzed by XPS before applying a protective agent. The photoconductor drum was analyzed by using an XPS analyzer "AXIS/ULTRA" manufactured by SHIMADZU/KRATOS (having X ray source: Mo no Al, analysis range: 700×300 μm), and C1s spectrum profile was obtained for a photoconductor. FIG. 8 shows an example spectrum profile of such C1s spectrum.

A peak detected in a range of 290.3 eV to 294 eV, which is used for computing the first area value $A_0$, can be separated in two peaks: one peak is attributed to carbonate bonding (area next to shaded area in FIG. 8), and the other peak is attributed to the aforementioned π-π* transition (shaded area in FIG. 8). The other peak attributed to π-π* transition includes a plurality of peaks, superimposed upon one another. Accordingly, for the photoconductor No. 1, the peak area in a range of 290.3 eV to 294 eV was computed as one peak area and the first area value $A_0$ was detected as 8.6%. In other words, a ratio of the first area value $A_0$ with respect to a total area of C1s spectrum was 8.6% for the photoconductor No. 1.

As similar to the photoconductor No. 1, a photoconductor No. 2 was analyzed by XPS before applying a protective agent. As for the photoconductor No. 2, the peak area in a range of 290.3 eV to 294 eV was not superimposed with the binding energy of 290.3 eV or less or the binding energy of 294 eV or more. Accordingly, as for the photoconductor No. 2, the peak area in a range of 290.3 eV to 294 eV was computed as one peak area and the first area value $A_0$ was detected as 8.8%. In other words, a ratio of the first area value $A_0$ with respect to a total area of C1s spectrum was 8.8% for the photoconductor No. 2. When conducting XPS measurement, a measurement sample having 0.5 cm×1 cm size was cut from an aluminum base of the photoconductor.

Analysis after Applying Protective Agent and Computation of X and Y

After applying the protective agent, the photoconductor was analyzed as below. Specifically, after applying the protective agent for 120 minutes to photoconductors Nos. 3 to 8 (to be described later), samples of the photoconductors Nos. 3 to 8 were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 1). The IR spectrum C was obtained after applying the protective agent for 120 minutes. Based on the IR spectrum C, a peak area ratio between the peak Pb1 (2850 $cm^{-1}$) having the peak area "Sb" and the peak Pa1 (1770 $cm^{-1}$) having the peak area "Sa" was evaluated as a peak area ratio or evaluation index "Sb/Sa."

The peak Pb1 (2850 $cm^{-1}$) is a peak attributed to the agent bar No. 1. Because a peak attributed to the photoconductor also exists around the peak Pb1 (2850 $cm^{-1}$) and overlaps with the peak Pb1, a differential spectrum between the IR spectrum C, obtained after applying the protective agent to the photoconductor, and the IR spectrum A for photoconductor to which the protective agent has not been applied is computed so that the peak area of the peak Pb1 (2850 $cm^{-1}$) attributed to the agent bar No. 1 is not affected by the peak area of the peak attributed to the photoconductor, and then the peak area ratio or evaluation index X=Sb/Sa is computed.

Figures 13, 14:
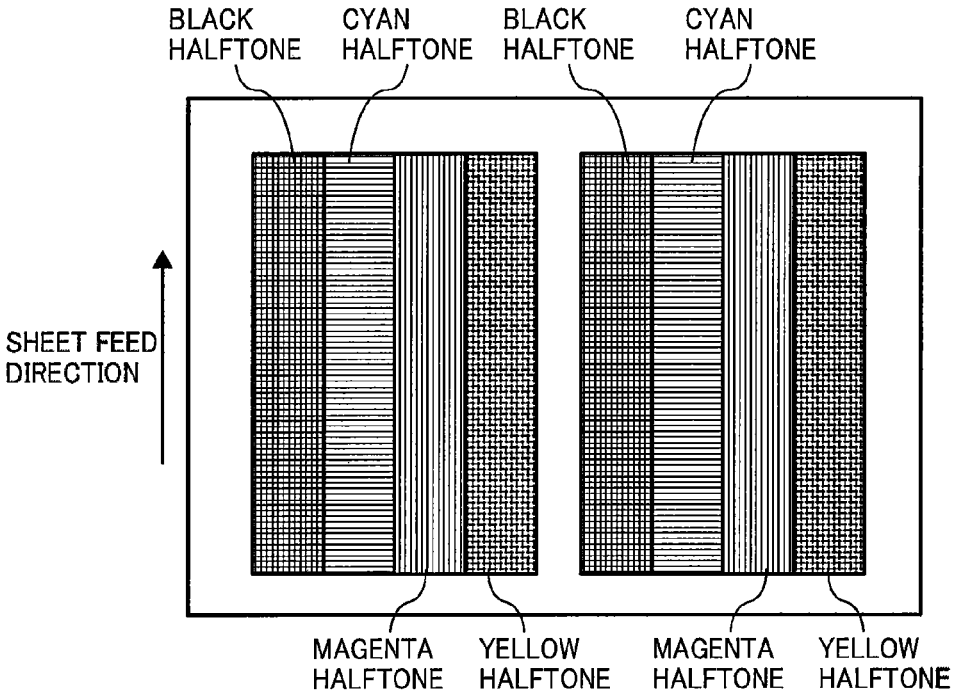
FIG. 13 illustrates a halftone image pattern used for evaluating a process cartridge according to exemplary embodiments.
FIG. 14 shows conditions of peak used for computing a peak area for each of peaks, in which start and end point of background for computing a peak area, and integration area of peak are included with wavenumber information.

When computing the differential spectrum, peak intensity was adjusted, such as increased or decreased, as required. For example, a given coefficient is multiplied to the absorbance of the spectrum so as to set a zero value for the peak area of the peak at 1770 $cm^{-1}$. FIG. 14 shows conditions of peak used for computing a peak area for each of the peaks, in which a start and end point of background for computing a peak area, and integration area of peak are included with wavenumber information.

Further, an XPS analysis is conducted on the photoconductor after applying the protective agent for 120 minutes as similar to before applying the protective agent. Based on the computed first area value $A_0$ and the second area value A, an agent coating ratio of the photoconductor after applying the protective agent can be obtained by a following equation, in which five areas were sampled from each photoconductor randomly to compute the first area value $A_0$ and the second area value A as average value of samples.

$$((A_0-A)/A_0)\times 100(\%)$$

As above described, the A and $A_0$ are a ratio of peak area of 290.3 eV to 294 eV with respect to a total area of C1s spectrum when a surface of the photoconductor drum is analyzed by XPS, in which the $A_0$ is a peak area ratio before applying protective agent, and the A is a peak area ratio after applying protective agent. Based on XPS results of the photoconductors Nos. 1 and 2, the $A_0$ was measured as 8.7% ($A_{0-ave}$=8.7%) for the photoconductor used in the experiment. In the example profile shown in FIG. 9A, the second area value "A" has a value of 2.3% (A=2.3%), and in the example profile shown in FIG. 9B, the second area value "A" has a value of 0.2% (A=0.2%). Accordingly, the coating ratio of the photoconductor in FIGS. 9A and 9B respectively becomes 74% and 98% using the above equation because the first area value $A_0$ for FIGS. 9A and 9B is 8.7% as above described.

EXAMPLES 1 TO 4 AND COMPARATIVE EXAMPLES 1 AND 2

The photoconductor Nos. 3 to 8, applied with the protective agent for 120 minutes by using the following protective layer setting units, were used.

Example 1

Protective Layer Setting Unit 1

Figure 12:
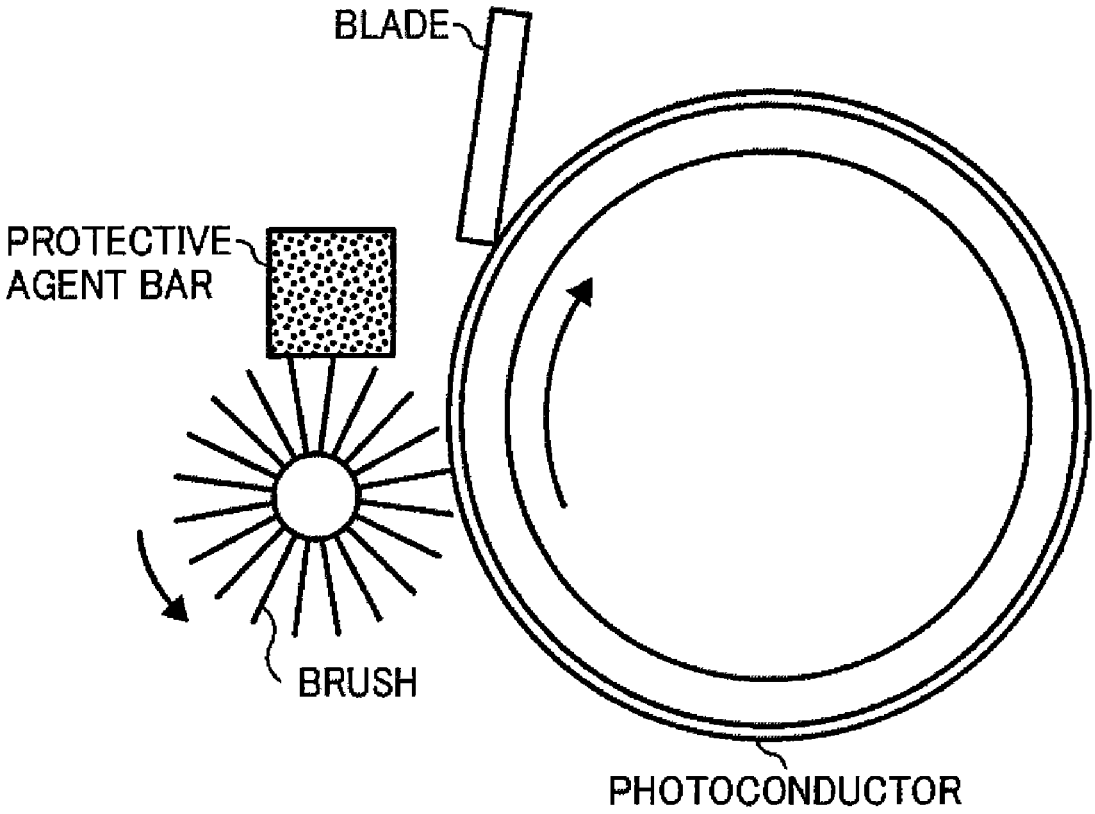
FIG. 12 illustrates a schematic view of a configuration of a protective layer setting unit according to an exemplary embodiment.

The photoconductor No. 3, a brush roller No. 3 (fiber having a thickness of 20 denier, fiber density of 50,000 fibers per square inch), and a urethane blade were assembled in a protective layer setting unit (see FIG. 12). The agent bar No. 1 was pressed against the brush with a spring force of 4.8 N to apply a protective agent to photoconductor No. 3. The photoconductor and the brush roller rotated at a linear velocity of 125 mm/sec and 146 mm/sec, respectively.

After applying the protective agent, the photoconductor No. 3 was analyzed by FT-IR Avatar370 (manufactured by Thermo Electron Corporation, Thunder Dome) under a condition of one time reflection, ATR prism of Ge, incident angle of 45° for IR spectrum analysis for computing "X". After applying the protective agent, the photoconductor No. 3 was also analyzed by using an XPS analyzer "AXIS/ULTRA" manufactured by SHIMADZU/KRATOS (having X ray source: Mo no Al, analysis range: 700×300 μm), and C1s spectrum profile was obtained for computing "Y". Based on the computed "X" and "Y," "X/Y" of 0.0033 was obtained.

Then, a new photoconductor and a charge roller were set in a black process cartridge of IPSIO CX400, a tandem type color image forming apparatus produced by Ricoh Company, Ltd. The charge roller was disposed above the photoconductor. The photoconductor rotated at a linear velocity of 125 mm/sec, a superimposed voltage having a direct-current voltage of −600 V and an alternating-current voltage having a frequency 1450 Hz and an amplitude of 1100 V was applied between the photoconductor and the charge roller. The black process cartridge was set using a condition of the protective layer setting unit 1.

Then, the image forming apparatus was operated to produce a black-character image for 150 sheets to evaluate image quality. In this case, the image forming apparatus produced a higher quality image. FIG. 13 illustrates evaluation image patterns used for the experiment. As shown in FIG. 13, striped halftone images of each of the colors of black, cyan, magenta, and yellow are formed side by side. When evaluating performance of an image forming apparatus used for the experiment, such an evaluation image pattern was used as a test image, and the image forming apparatus was operated to copy the test image on a greater number of sheets. The copied image quality was checked based on image evaluation criteria.

The image forming apparatus was further operated to produce one-by-one a halftone image of A4 size shown in FIG. 13 for 6,000 sheets to evaluate image quality, in which five sheets were printed as one set until 6,000 sheets were printed. In this case, the image forming apparatus produced a higher quality image for the 6,000th sheet, which was visually evaluated. The image on the 6,000th sheet was further observed using a microscope and it was found that dots were arranged in the image in an orderly manner without disturbance of dots.

Example 2

Protective Layer Setting Unit 2

The photoconductor No. 4, a brush roller No. 2 (fiber having a thickness of 10 denier, fiber density of 50,000 fibers per square inch), and a urethane blade were assembled in a protective layer setting unit (see FIG. 12). The agent bar No. 1 was pressed against the brush with a spring force of 4.8 N to apply a protective agent to photoconductor No. 4. The photoconductor and the brush roller rotated at a linear velocity of 125 mm/sec and 146 mm/sec, respectively.

After applying the protective agent, the photoconductor No. 4 was analyzed by FT-IR Avatar370 (manufactured by Thermo Electron Corporation, Thunder Dome) under a condition of one time reflection, ATR prism of Ge, incident angle of 45° for IR spectrum analysis for computing "X". After applying the protective agent, the photoconductor No. 4 was also analyzed by using an XPS analyzer "AXIS/ULTRA" manufactured by SHIMADZU/KRATOS (having X ray source: Mo no Al, analysis range: 700×300 μm), and C1s spectrum profile was obtained for computing "Y". Based on the computed "X" and "Y," "X/Y" of 0.0025 was obtained.

Then, a new photoconductor and a charge roller were set in a black process cartridge of IPSIO CX400, a tandem type color image forming apparatus produced by Ricoh Company, Ltd. The charge roller was disposed above the photoconductor. The photoconductor rotated at a linear velocity of 125 mm/sec, a superimposed voltage having a direct-current voltage of −600 V and an alternating-current voltage having a frequency 1450 Hz and an amplitude of 1100 V was applied between the photoconductor and the charge roller. The black process cartridge was set using a condition of the protective layer setting unit 2.

Then, the image forming apparatus was operated to produce a black-character image for 150 sheets to evaluate image quality. In this case, the image forming apparatus produced a higher quality image. The image forming apparatus was further operated to produce one-by-one a halftone image of A4 size shown in FIG. 13 for 6,000 sheets to evaluate image quality, in which five sheets were printed as one set until 6,000 sheets were printed. In this case, the image forming apparatus produced a higher quality image for the 6,000th sheet, which was visually evaluated. The image on the 6,000th sheet was further observed using a microscope and it was found that dots were arranged in the image in an orderly manner without disturbance of dots.

Comparative Example 1

Protective Layer Setting Unit 3

The photoconductor No. 5, a brush roller No. 1 (fiber having a thickness of 20 denier, fiber density of 100,000 fibers per square inch), and a urethane blade were assembled in a protective layer setting unit (see FIG. 12). The agent bar No. 2 was pressed against the brush with a spring force of 6 N to apply a protective agent to photoconductor No. 5. The photoconductor and the brush roller rotated at a linear velocity of 125 mm/sec and 146 mm/sec, respectively.

After applying the protective agent, the photoconductor No. 5 was analyzed by FT-IR Avatar370 (manufactured by Thermo Electron Corporation, Thunder Dome) under a condition of one time reflection, ATR prism of Ge, incident angle of 45° for IR spectrum analysis for computing "X". After applying the protective agent, the photoconductor No. 5 was also analyzed by using an XPS analyzer "AXIS/ULTRA" manufactured by SHIMADZU/KRATOS (having X ray source: Mo no Al, analysis range: 700×300 μm), and C1s spectrum profile was obtained for computing "Y". Based on the computed "X" and "Y," "X/Y" of 0.0242 was obtained.

Then, a new photoconductor and a charge roller were set in a black process cartridge of IPSIO CX400, a tandem type color image forming apparatus produced by Ricoh Company, Ltd. The charge roller was disposed above the photoconductor. The photoconductor rotated at a linear velocity of 125 mm/sec, a superimposed voltage having a direct-current voltage of −600 V and an alternating-current voltage having a frequency 1450 Hz and an amplitude of 1100 V was applied between the photoconductor and the charge roller. The black process cartridge was set using a condition of the protective layer setting unit 3.

Then, the image forming apparatus was operated to produce a black-character image for 150 sheets to evaluate image quality. In this case, the image forming apparatus produced images having characters having a relatively bold shape. The produced image of Example 1 and the produced image of Comparative Example 1 were observed using a microscope, in which the image of Example 1 consisted of sharp dots, but the image of Comparative Example 1 consisted of not-so-sharp dots. The image forming apparatus was further operated to produce one-by-one a halftone image of A4 size shown in FIG. 13 for 6,000 sheets to evaluate image quality, in which five sheets were printed as one set until 6,000 sheets were printed. In this case, the image forming apparatus produced an image having a white streak on the 6,000th sheet, which was visually evaluated.

Comparative Example 2

Protective Layer Setting Unit 4

The photoconductor No. 6, a brush roller No. 1 (fiber having a thickness of 20 denier, fiber density of 100,000 fibers per square inch), and a urethane blade were assembled in a protective layer setting unit (see FIG. 12). The agent bar No. 2 was pressed against the brush with a spring force of 5 N to apply a protective agent to photoconductor No. 6. The photoconductor and the brush roller rotated at a linear velocity of 125 mm/sec and 146 mm/sec, respectively.

After applying the protective agent, the photoconductor No. 6 was analyzed by FT-IR Avatar370 (manufactured by Thermo Electron Corporation, Thunder Dome) under a condition of one time reflection, ATR prism of Ge, incident angle of 45° for IR spectrum analysis for computing "X". After applying the protective agent, the photoconductor No. 6 was also analyzed by using an XPS analyzer "AXIS/ULTRA" manufactured by SHIMADZU/KRATOS (having X ray source: Mo no Al, analysis range: 700×300 μm), and C1s spectrum profile was obtained for computing "Y". Based on the computed "X" and "Y," "X/Y" of 0.0220 was obtained.

Then, a new photoconductor and a charge roller were set in a black process cartridge of IPSIO CX400, a tandem type color image forming apparatus produced by Ricoh Company, Ltd. The charge roller was disposed above the photoconductor. The photoconductor rotated at a linear velocity of 125 mm/sec, a superimposed voltage having a direct-current voltage of −600 V and an alternating-current voltage having a frequency 1450 Hz and an amplitude of 1100 V was applied between the photoconductor and the charge roller. The black process cartridge was set using a condition of the protective layer setting unit 4.

Then, the image forming apparatus was operated to produce a black-character image for 150 sheets to evaluate image quality. In this case, the image forming apparatus produced images having characters having a relatively bold shape. The produced image of Example 1 and the produced image of Comparative Example 2 were observed using a SEM (scanning electron microscope), in which the image of Example 1 consisted of sharp dots, but the image of Comparative Example 2 consisted of not-so-sharp dots. The image forming apparatus was further operated to produce one-by-one a halftone image of A4 size shown in FIG. 13 for 6,000 sheets to evaluate image quality, in which five sheets were printed as one set until 6,000 sheets were printed. In this case, the image forming apparatus produced an image having a white streak on the 6,000th sheet, which was visually evaluated.

Example 3

Protective Layer Setting Unit 5

The photoconductor No. 7, a brush roller No. 2 (fiber having a thickness of 10 denier, fiber density of 50,000 fibers per square inch), and a urethane blade were assembled in a protective layer setting unit (see FIG. 12). The agent bar No. 2 was pressed against the brush with a spring force of 3.5 N to apply a protective agent to photoconductor No. 7. The photoconductor and the brush roller rotated at a linear velocity of 125 mm/sec and 146 mm/sec, respectively.

After applying the protective agent, the photoconductor No. 7 was analyzed by using an XPS analyzer "AXIS/ULTRA" manufactured by SHIMADZU/KRATOS (having X ray source: Mo no Al, analysis range: 700×300 μm), and C1s spectrum profile shown in FIG. 8 was obtained for a photoconductor No. 7. After applying the protective agent, the photoconductor No. 7 was also analyzed by FT-IR Avatar370 (manufactured by Thermo Electron Corporation, Thunder Dome) under a condition of one time reflection, ATR prism of Ge, incident angle of 45° for IR spectrum analysis for computing "X". After applying the protective agent, the photoconductor No. 7 was analyzed by using an XPS analyzer "AXIS/ULTRA" manufactured by SHIMADZU/KRATOS (having X ray source: Mo no Al, analysis range: 700×300 μm), and C1s spectrum profile was obtained for computing "Y". Based on the computed "X" and "Y," "X/Y" of 0.014 was obtained.

Then, a new photoconductor and a charge roller were set in a black process cartridge of IPSIO CX400, a tandem type color image forming apparatus produced by Ricoh Company, Ltd. The charge roller was disposed above the photoconductor. The photoconductor rotated at a linear velocity of 125 mm/sec, a superimposed voltage having a direct-current voltage of −600 V and an alternating-current voltage having a frequency 1450 Hz and an amplitude of 1100 V was applied between the photoconductor and the charge roller. The black process cartridge was set using a condition of the protective layer setting unit 5.

Then, the image forming apparatus was operated to produce a black-character image for 150 sheets to evaluate image quality. In this case, the image forming apparatus produced a higher quality image. The image forming apparatus was further operated to produce one-by-one a halftone image of A4 size shown in FIG. 13 for 6,000 sheets to evaluate image quality, in which five sheets were printed as one set until 6,000 sheets were printed. In this case, the image forming apparatus produced a higher quality image for the 6,000th sheet, which was visually evaluated. The image on the 6,000th sheet was further observed using a microscope and it was found that some dots in the image had a not-so-sharp shape.

Example 4

Protective Layer Setting Unit 6

The photoconductor No. 8, a brush roller No. 1 (fiber having a thickness of 20 denier, fiber density of 100,000 fibers per square inch), and a urethane blade were assembled in a protective layer setting unit (see FIG. 12). The agent bar No. 1 was pressed against the brush with a spring force of 6 N to apply a protective agent to photoconductor No. 8. The photoconductor and the brush roller rotated at a linear velocity of 125 mm/sec and 146 mm/sec, respectively.

After applying the protective agent, the photoconductor No. 8 was analyzed by FT-IR Avatar370 (manufactured by Thermo Electron Corporation, Thunder Dome) under a condition of one time reflection, ATR prism of Ge, incident angle of 45° for IR spectrum analysis for computing "X". After applying the protective agent, the photoconductor No. 8 was also analyzed by using an XPS analyzer "AXIS/ULTRA" manufactured by SHIMADZU/KRATOS (having X ray source: Mo no Al, analysis range: 700×300 μm), and C1s spectrum profile was obtained for computing "Y". Based on the computed "X" and "Y," "X/Y" of 0.0059 was obtained.

Then, a new photoconductor and a charge roller were set in a black process cartridge of IPSIO CX400, a tandem type color image forming apparatus produced by Ricoh Company, Ltd. The charge roller was disposed above the photoconductor. The photoconductor rotated at a linear velocity of 125 mm/sec, a superimposed voltage having a direct-current voltage of −600 V and an alternating-current voltage having a frequency 1450 Hz and an amplitude of 1100 V was applied between the photoconductor and the charge roller. The black process cartridge was set using a condition of the protective layer setting unit 6.

Then, the image forming apparatus was operated to produce a black-character image for 150 sheets to evaluate image quality. In this case, the image forming apparatus produced a higher quality image. The image forming apparatus was further operated to produce one-by-one a halftone image of A4 size shown in FIG. 13 for 6,000 sheets to evaluate image quality, in which five sheets were printed as one set until 6,000 sheets were printed. In this case, the image forming apparatus produced a higher quality image for the 6,000th sheet, which was visually evaluated. The image on the 6,000th sheet was further observed using a microscope and it was found that dots were arranged in the image in an orderly manner without disturbance of dots.

FIG. 15 shows experiment results for image quality, and FIG. 16 shows conditions of protective agent bars used in the experiment. The application units 1 to 6 in FIG. 15 correspond to the protective layer setting units 1 to 6. In the evaluation results in FIG. 15, "○" indicates that higher quality image was produced, "A" indicates that image degradation was not observed by eye, but was observed by microscopic observation (acceptable level for practical usage), and "x" indicates that abnormal image was observed.

Based on the above results, the ratio of (X/Y) is set to 0.020, preferably 0.016, and more preferably from 0.014 when the protective layer setting unit applies the protective agent for 120 minutes to a photoconductor to coat the photoconductor with a preferable amount of protective agent.

In an exemplary embodiment, "X" indicates an amount of protective agent applied on a photoconductor, and "Y" indicates a coating ratio of photoconductor coated by a protective agent. By using such two factors "X" and "Y," a coating state of photoconductor can be evaluated more precisely. Although using "X" or "Y" alone is useful for evaluating coating state of photoconductor, using "X" or "Y" alone may not be sufficiently useful in some cases. For example, even if a coating ratio Y is computed as a greater value, such as 100%, if the applied amount "X" is too small, a photoconductor is not coated properly. On one hand, even if the applied amount "X" is computed as a greater value, if the coating ratio Y is too small, a photoconductor is not coated properly. Accordingly, by using such two factors "X" and "Y," a coating state of photoconductor can be evaluated more precisely.

A description is now given to a photoconductor preferably used in an exemplary embodiment. The photoconductor used in an image forming apparatus comprises a conductive support and a photosensitive layer provided thereon.

The photosensitive layer may be of a monolayer type in which a charge generation material and a charge transport material are mixed, or a forward lamination type in which a charge transport layer is provided on a charge generation layer, or a reverse lamination type in which a charge generation layer is provided on a charge transport layer. Further, a surface protective layer may be provided on the photosensitive layer to enhance physical strength, anti-abrasiveness, anti-gas property, cleaning performance and the like of the photoconductor. Further, a backing layer may be provided between the photosensitive layer and the conductive support. Further, each layer may additionally contain an appropriate amount of plasticizer, antioxidant, leveling agent and the like as required.

The conductive support of the photoconductor may have a drum shape prepared as below, for example. A cylindrically shaped plastic/paper is covered with a metal compound by vapor deposition or sputtering to form the conductive support. The metal compound may be aluminum, nickel, chromium, nichrome, copper, gold, silver, or platinum, or metal oxide, such as tin oxide or indium oxide, having conductivity of volume resistance of equal to or less than $10^{10}$ Ωcm. Alternatively, a metal plate, such as aluminum, aluminum alloy, nickel, stainless, or a tube obtained by extruding or drawing the metal plate, is subjected to surface treatment such as grinding, super-finishing, polishing and the like to form the conductive support. As the drum-like support, those having a diameter ranging from 20 mm to 150 mm, preferably from 24 mm to 100 mm, more preferably from 28 mm to 70 mm can be used. Diameter of the drum-like support of equal to or less than 20 mm is not preferable because arrangement of a charging device, a light exposure device, a development device, a transfer device, and a cleaning device around the drum is physically difficult, and a diameter of the drum-like support of equal to or more than 150 mm is not preferable because the size of image forming apparatus increases. When the image forming apparatus is of tandem type, in particular, the diameter is equal to or less than 70 mm, and preferably equal to or less than 60 mm because a plurality of photoconductors should be disposed. Also known conductive endless belts, such as nickel belt or stainless belt, may be used as a conductive support.

The backing layer of the photoconductor for use in an exemplary embodiment may be a resin layer, a resin layer having white pigment, or a metal oxide layer obtainable by chemically or electrochemically oxidizing a surface of a conductive base, for example, and the resin layer having white pigment is preferred. Examples of the white pigment include, but are not limited to, metal oxides, such as titanium oxide, aluminum oxide, zirconium oxide, and zinc oxide, and among these, it is preferred to contain titanium oxide having excellent ability to prevent charges from being injected from the conductive base. Examples of the resin used in the backing layer include, but are not limited to, thermoplastic resins, such as polyamide, polyvinyl alcohol, casein, methyl cellulose; thermosetting resins, such as acryl, phenol, melamine, alkyd, unsaturated polyester, epoxy; and these may be used singly or in combination.

Examples of the charge generation material of photoconductor for use in an exemplary embodiment include, but are not limited to, organic pigments and dyes, such as azo pigments (e.g., monoazo pigments, bisazo pigments, trisazo pigments, tetrakisazo pigments), triarylmethane dyes, thiazine dyes, oxazine dyes, xanthene dyes, cyanine dyestuffs, styryl dyestuffs, pyrylium dyes, quinacridone dyes, indigo dyes, perylene pigments, polycyclic quinone pigments, bisbenzimidazole pigments, indathrone pigments, squarylium pigments, phthalocyanine pigments; and inorganic materials, such as serene, serene-arsenic, serene-tellurium, cadmium sulfide, zinc oxide, titanium oxide and amorphous silicon, and the charge generation material may be used singly or in combination of plural kinds. The backing layer of the photoconductor may be composed of one layer or a plurality of layers.

Examples of the charge transport material of photoconductor for use in an exemplary embodiment include, but are not limited to, anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives, and these may be used singly or in combination.

The binding resin used for forming the photosensitive layer of charge generation layer and charge transport layer include, but is not limited to, known thermoplastic resins, thermosetting resins, photosetting resins, and photoconductive resins having electric insulation. Examples of binding resin include, but are not limited to, thermoplastic resins, such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, (meth) acryl resin, polystyrene, polycarbonate, polyacrylate, polysulfone, polyethersulfone and ABS resin; thermosetting resins, such as phenol resin, epoxy resin, urethane resin, melamine resin, isocyanate resin, alkyd resin, silicone resin; photosetting resins, such as photosetting acryl resin; and photoconductive resins, such as polyvinyl carbazole, polyvinyl anthracene, polyvinylpyrene. These can be used alone or a mixture of plural kinds of binding resins can be used, but are not limited thereto.

As the antioxidant, those listed below may be used, for example.

Monophenol compounds: 2,6-di-t-butyl-p-cresol, butylated hydroxy anisole, 2,6-di-t-butyl-4-ethylphenol, stearyl-β-(3,5-di-t-butyl-4-hydroxyphenyl)propionate, 3-t-butyl-4-hydroxyanisole or the like.

Bisphenol compounds: 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) or the like.

Polymeric phenol compounds: 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocopherols, or the like.

p-phenylenediamines: N-phenyl-N'-isopropyl-p-phenylene diamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, or the like.

Hydroquinones: 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone or the like.

Organic sulfur compounds: Dilauryl-3,3'-thiodipropionate, distearyl-3,3'-thiodipropionate, ditetradecyl-3,3'-thiodipropionate, or the like.

Organic phosphor compounds: Triphenyl phosphine, tri(nonylphenyl)phosphine, tri(dinonylphenyl)phosphine, tricresyl phosphine, tri(2,4-dibutylphenoxy)phosphine, or the like.

As the plasticizer, compounds, such as dibutylphthalate and dioctylphthalate that are commonly used as a plasticizer, may be used, and an appropriate use amount is about 0 to 30 parts by weight, relative to 100 parts by weight of the binding resin.

Further, a leveling agent may be added to the charge transport layer. As the leveling agent, silicone oils, such as dimethyl silicone oil, methylphenyl silicone oil, and polymer or oligomer having perfluoroalkyl group as a side chain can be used, for example, and an appropriate use amount is about 0 to 1 part by weight, relative to 100 parts by weight of binding resin.

The surface layer of the photoconductor is provided for improving or enhancing physical strength, abrasion resistance (or anti-abrasiveness), gas resistance (or anti-gas property), or cleanability (or cleaning performance) of a photoconductor. As the surface layer, those of polymers having higher physical strength than the photosensitive layer, and those of polymers in which inorganic fillers are dispersed can be exemplified.

The polymer used for the surface layer may be any polymers including, but not limited to, thermoplastic polymers and thermosetting polymers, and thermosetting polymers are particularly preferred because they have high physical strength and a good ability of reducing abrasion, which may occur when exposed to friction with a cleaning blade. The surface layer may not need to have charge transport ability insofar as it has a smaller film thickness. However, when a thicker surface layer not having charge transport ability is formed, a photoconductor may decrease its photosensitivity, increase its post-exposure potential, and increase its residual potential. Therefore, it is preferred to contain the charge transport material in the surface layer or to use a polymer having charge transport ability for the surface layer.

In general, the photosensitive layer and the surface layer have physical strength, which are greatly different from each other. When the surface layer is abraded and disappears due to friction with a cleaning blade, the photosensitive layer will be also soon thereafter abraded. Therefore, when providing a surface layer, the surface layer has a sufficient film thickness, ranging from 0.01 μm (micrometer) to 12 μm, preferably ranging from 1 μm to 10 μm, and more preferably from 2 μm to 8 μm. Film thickness of surface layer of equal to or less than 0.1 μm is not preferred because it is so thin that partial disappearance is likely to occur due to friction with a cleaning blade, and abrasion of the photosensitive layer proceeds from the disappeared part. A film thickness of surface layer of equal to or more than 12 μm is not preferred because such thicker surface layer may decrease photosensitivity, increase post-exposure potential, and increase residual potential for a photoconductor, and if a polymer having charge transport ability and relatively high price is used for surface layer, a cost of photoconductor becomes higher, which is not preferable.

As the polymer used in the surface layer, polycarbonate resin having transparency to a light beam at the time of an image writing, excellent insulation, physical strength, and adhesiveness is preferred. The polymer may also include other resins, such as ABS (Acrylonitrile Butadiene Styrene) resin, ACS (Acrylonitrile Chlorinated polyethylene Styrene) resin, olefin-vinyl monomer copolymer, chlorinated polyether, allyl resin, phenol resin, polyacetal, polyamide, polyamidoimide, polyacrylate, polyallylsulfone, polybutylene, polybutyleneterephthalate, polycarbonate, polyethersulfone, polyethylene, polyethyleneterephthalate, polyimide, acryl resin, polymethylpentene, polypropylene, polyphenyleneoxide, polysulfone, polystyrene, AS resin, butadiene-styrene copolymer, polyurethane, polyvinyl chloride, polyvinylidene chloride, and epoxy, for example.

To enhance physical strength of the surface layer, the surface layer may contain dispersed therein fine powders of a metal component, a metal oxide, or the like. Examples of the metal oxide include, but are not limited to, tin oxide, potassium titanate, titanium oxide, zinc oxide, indium oxide, and antimony oxide, or titanium nitride. Further, to enhance anti-abrasiveness of a surface layer, the surface layer may further contain a fluorocarbon resin, such as polytetrafluoroethylene, silicone resin, or compounds of these resins having dispersed inorganic materials therein, for example.

In an exemplary embodiment, photoconductor drums and an intermediate transfer member are used as image carrying member, in which toner images formed on photoconductors are transferred to the intermediate transfer member, and then the toner images are transferred to a transfer medium.

The intermediate transfer member may be preferably made from a conductive material having a volume resistance from $10^5$ Ω·cm to $11^{11}$ Ω·cm. If the surface resistance is less than $10^5$Ω/□, toner scattering may occur when a discharge is conducted for transferring a toner image from the photoconductor to the intermediate transfer member, by which toner image may be disturbed. If the surface resistance is greater than $10^{11}$Ω/□, electric charge corresponding to toner image may remain on the intermediate transfer member after transferring a toner image from the intermediate transfer member to a transfer medium, such as paper, by which such remained electric charge may appear as an image on a subsequent image forming operation.

The intermediate transfer member may be made from a conductive material and thermoplastic resin, in which such materials are kneaded, extruded, and formed into a belt shape or a cylindrical shape. The conductive material may be metal oxide, such as tin oxide, indium oxide, conductive particle, such as carbon black, or conductive polymer. These may be used alone or in combination. Alternatively, the conductive material can be added in resin solution having monomer or oligomer used for cross-linking reaction, and then a centrifugal molding conducted while applying heat to form an endless belt.

If the intermediate transfer member is provided with a surface layer, the surface layer of the intermediate transfer member may include materials used for the surface layer of photoconductor surface except the charge transport material, and a conductive material to adjust resistance.

A description is now given to toner for use in an exemplary embodiment. The toner preferably has an average circularity of from 0.93 to 1.00. In an exemplary embodiment, an average value obtained by the following (Equation 3) is defined as circularity of toner particles. The average circularity is an index of the degree of irregularities of toner particles. If the toner has perfect sphericity, the average circularity takes a value of 1.00. The more irregularities of the surface profile, the smaller the average circularity.

Circularity SR=(circumferential length of a circle having an area equivalent to a projected area of a particle)/(circumferential length of a projected image of the particle) (Equation 3)

If the average circularity is in a range of 0.93 to 1.00, toner particles may have a smooth surface, and thereby toner particles contact with each other at a small contact area, and toner particles and the photoconductor drum 1 also contact with each other at a small contact area, by which such toner particles can have an excellent transfer performance. Further, because such toner particles have no corners, an agitation torque for the developing agent in the developing unit 3 can be set smaller, and thereby the agitation can be conducted in a stable manner, by which defective images may not occur.

Further, because such toner particles have no corners, pressure applied to toner particles, when transferring a toner image to a transfer member or a recording member, can be uniformly applied to the toner particles used for forming dot images. Accordingly, a void may not occur on a transferred image. Further, because such toner particles have no corners, the toner particles may not have as high a grinding force, by which the toner particles may not damage or wear the surface of the photoconductor drum 1.

A description is given to a method of measuring circularity of toner particles. The degree of circularity SR of particles can be measured by using a flow-type particle image analyzing apparatus FPIA-1000 produced by To a Medical Electronics Co., Ltd. Such measuring may be conducted as below.

First, 0.1-0.5 ml of surfactant, preferably alkyl benzene sulfonate, as a dispersing agent is added to 100-150 ml of water in a container from which impurities have been removed in advance, and about 0.1-0.5 g of measurement sample is further added thereto. Then, an ultrasonic wave is applied to a suspension having a sample dispersed therein for 1 to 3 minute to set a suspension dispersion density as 3,000-10,000 particles/μl, and the shape of toner particles and distribution of the degree of circularity of toner particles are measured by using the above-mentioned flow-type particle image measuring apparatus.

A weight-average particle diameter D4 of toner particles is preferably from 3 μm to 10 μm, and more preferably from 4 μm to 8 μm, for example. In this range, the toner particles may have a diameter which is of sufficiently small size for developing fine dots of latent image. Accordingly, such toner particles have good reproducibility of image dots. If the weight-average particle diameter D4 is too small, a phenomenon such as lower transfer efficiency and lower blade cleaning performance may be more likely to occur. If the weight-average particle diameter D4 is too great, toner for forming characters and lines may unfavorably spatter.

Further, the toner particles preferably have a ratio (D4/D1) of from 1.00 to 1.40, wherein the D4/D1 is a ratio of the weight-average particle diameter D4 and the number-average particle diameter D1. The closer the ratio (D4/D1) is 1, the sharper the size distribution of the toner particles. If the (D4/D1) is in a range of 1.00 to 1.40, a latent image can be developed by any toner particles having different particle diameters but set in such D4/D1 ratio, by which an image having higher quality can be produced.

Further, because the toner particles have a sharper size distribution, a triboelectrical-charging profile of toner particles also becomes sharp, by which fogging can be reduced. Further, if toner particles have uniform diameter, the toner particles can be developed on a latent image dot in a precise array, and thereby dot reproducibility by toner particles becomes excellent.

The weight average particle diameter (D4), number average particle diameter (D1), and particle diameter distribution of a toner can be measured using an instrument COULTER COUNTER TA-II or COULETR MULTISIZER II from Coulter Electrons Inc. The typical measuring method is as follows:

(1) 0.1 to 5 ml of a surfactant (preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the weight average particle diameter (D4) and the number average particle diameter (D1) are determined.

The channels preferably include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

Such substantially spherically shaped toner particles can be prepared by a cross-linking reaction and/or an elongation reaction of a toner composition in an aqueous medium in the presence of fine resin particles. Preferably, the toner composition includes a polyester prepolymer having a functional group containing nitrogen atom, a polyester, a colorant, and a release agent, for example. The surface of toner particles prepared by such a method can be hardened, by which hot offset can be reduced, and thereby contamination of a fixing unit by toner particles can be reduced. Accordingly, the occurrence of defective images can be reduced.

A prepolymer formed as a modified polyester resin comprising a polyester prepolymer (a) having an isocyanate group, and amine (b) may be elongated or cross-linked with the polyester prepolymer (a).

The polyester prepolymer (a) having an isocyanate group may be a reaction product of polyester with polyisocyanate (3), in which the polyester is a polycondensation product of polyol (1) and polycarboxylic acid (2) and having an active hydrogen group. The active hydrogen group of the polyester may be hydroxyl group (e.g., alcoholic hydroxyl group, phenolic hydroxyl group), amino group, carboxyl group, and mercapto group, for example. Among these, alcoholic hydroxyl group is preferred.

Examples of the polyol (1) include diol (1-1) and trivalent or more polyol (1-2), and (1-1) alone or a mixture of (1-1) and a small amount of (1-2) is preferably used.

Examples of the diol (1-1) include, but are not limited to, alkylene glycols (e.g., ethylene glycol, 1,2-propylene glycol, 1,3-propylene glycol, 1,4-butane diol, 1,6-hexane diol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexane dimethanol, hydrogenated bisphenol A); bisphenols (e.g., bisphenol A, bisphenol F, bisphenol S); alkylene oxide adducts of the alicyclic diol (e.g., ethylene oxide, propylene oxide, butylene oxide); and alkylene oxide adducts of the bisphenol (e.g., ethylene oxide, propylene oxide, butylene oxide). Among these, alkylene glycols having a carbon number of 2 to 12 and alkylene oxide adducts of the bisphenol are preferable. Particularly preferable are the alkylene oxide adducts of the bisphenol, and a combination of an alkylene oxide adduct of the bisphenol and alkylene glycol having a carbon number of 2 to 12.

Examples of the trivalent or more polyol (1-2) include, but are not limited to, trihydric to octahydric alcohols and polyvalent aliphatic alcohols (e.g., glycerin, trimethylolethane, trimethylolpropane, pentaerythritol, sorbitol); trivalent or more phenols (e.g., trisphenol PA, phenol borax, cresol novolac); and alkylene oxide adducts of the trivalent or more polyphenol.

Examples of the polycarboxylic acid (2) include, but are not limited to, dicarboxylic acids (2-1) and trivalent or more polycarboxylic acids (2-2), and (2-1) alone or a mixture of (2-1) and a small amount of (2-2) are preferably used. Examples of the dicarboxylic acid (2-1) include, but are not limited to alkylene dicarboxylic acids (e.g., succinic acid, adipic acid, sebacic acid); alkenylene dicarboxylic acids (e.g., maleic acid, fumaric acid); and aromatic dicarboxylic acids (e.g., phthalic acid, isophthalic acid, terephthalic acid, naphthalen dicarboxylic acid). Among these, alkenylene dicarboxylic acids having a carbon number of 4 to 20 or aromatic dicarboxylic acids having a carbon number of 8 to 20 are preferable. Examples of the trivalent or more polycarboxylic acid (2-2) include, but are not limited to, aromatic polycarboxylic acids having a carbon number of 9 to 20 (e.g., trimellitic acid, pyromellitic acid). Acid anhydrides or lower alkyl esters (e.g., methyl ester, ethyl ester, isopropyl ester) of the polycarboxylic acid (2) may be reacted with polyol (1).

A ratio of the polyol (1) and the polycarboxylic acid (2) is preferably from 2/1 to 1/1, more preferably from 1.5/1 to 1/1, and further preferably from 1.3/1 to 1.02/1 as an equivalent ratio of [OH]/[COOH] between hydroxyl group [OH] and carboxyl group [COOH].

Examples of the polyisocyanate (3) include, but are not limited to, aliphatic polyisocyanates (e.g., tetramethylene diisocyanate, hexamethylene diisocyanate, 2,6-diisocyanate methyl caproate); alicyclic polyisocyanates (e.g., isophorone diisocyanate, cyclohexylmethane diisocyanate); aromatic diisocyanates (e.g., tolylene diisocyanate, diphenylmethane diisocyanate); aromatic aliphatic diisocyanates (e.g., α,α,α',α'-tetramethylxylylene diisocyanate); isocyanates; and compounds formed by blocking the polyisocyanate phenol derivative, oxime, or caprolactam. These can be used alone or in combination.

A ratio of the polyisocyanate (3) is preferably from 5/1 to 1/1, more preferably from 4/1 to 1.2/1, and further preferably from 2.5/1 to 1.5/1 as an as an equivalent ratio of [NCO]/[OH] between isocyanate group [NCO] and hydroxyl group [OH] of polyester having hydroxyl group. If the [NCO]/[OH] becomes too great, low-temperature fixability of the toner may deteriorate. For example, if the molar ratio of [NCO] becomes less than 1, the urea content in modified polyester becomes lower, by which hot offset resistance may be degraded.

The content of polyisocyanate (3) in the prepolymer (a) having isocyanate group is preferably from 0.5 wt % to 40 wt %, more preferably from 1 wt % to 30 wt %, and further preferably from 2 wt % to 20 wt %. If the content of polyisocyanate (3) is too small, hot offset resistance may be degraded, and a compatibility of thermostable preservability of the toner and low-temperature fixability of the toner may deteriorate. If the content of polyisocyanate (3) is too great, low-temperature fixability of the toner may deteriorate.

The number of isocyanate groups contained in one molecule of the prepolymer (a) having isocyanate group is preferably at least 1, more preferably an average of 1.5 to 3, and further preferably an average of 1.8 to 2.5. If the number of isocyanate groups per molecule is less than 1, the molecular weight of urea-modified polyester becomes lower, by which hot offset resistance may be degraded.

Examples of the amine (b) include, but are not limited to, diamines (B1), trivalent or more polyamines (B2), amino alcohols (B3), amino mercaptans (B4), amino acids (B5), and compounds (B6) of B1 to B5 in which the amino group is blocked.

Examples of the diamine (B1) include, but are not limited to, aromatic diamines (e.g., phenylene diamine, diethyl toluene diamine, 4,4'diaminodiphenylmethane); alicyclic diamines (e.g., 4,4'-diamino-3,3'dimethyldicyclohexylmethane, diaminecyclohexane, isophorone diamine); and aliphatic diamines (e.g., ethylene diamine, tetramethylene diamine, hexamethylene diamine). Examples of the trivalent or more polyamine (B2) include, but are not limited to, diethylene triamine, and triethylene tetramine. Examples of the amino alcohol (B3) include, but are not limited to, ethanolamine and hydroxyethylaniline. Examples of the amino mercaptan (B4) include, but are not limited to, aminoethyl mercaptan and aminopropyl mercaptan. Examples of the amino acid (B5) include, but are not limited to, aminopropionic acid and aminocaproic acid. Examples of the compound (B6), in which amino group of B1 to B5 is blocked, include, but are not limited to, ketimine compounds and oxazoline compounds obtained from amines of B1 to B5 or ketones (e.g., acetone, methyl ethyl ketone, methyl isobutyl ketone). The preferable amine (b) is B1 alone or a mixture of B1 and a small amount of B2.

Further, a reaction inhibitor can be used, as required, for an elongation reaction to adjust a molecular weight of urea-modified polyester. Examples of the reaction inhibitor include, but are not limited to, monoamines (e.g., diethylamine, dibuthylamine, buthylamine, laurylamine) and compounds (e.g., ketimine compound), in which monoamine is blocked.

A ratio of the amine (b) is preferably from 1/2 to 2/1, more preferably from 1.5/1 to 1/1.5, and further preferably from 1.2/1 to 1/1.2 as an equivalent ratio of [NCO]/[NHx] of isocyanate group [NCO] in the prepolymer (a) having isocyanate group and amino group [NHx] in the amine (b). If the [NCO]/[NHx] becomes too great or too small, a molecular weight of urea-modified polyester (i) becomes lower, and hot offset resistance may be degraded. In an exemplary embodiment, the urea-modified polyester (i) may have an urea bond and an urethane bond. A molar ratio of urea bond content and urethane bond content is preferably from 100/0 to 10/90, more preferably from 80/20 to 20/80, and further preferably from 60/40 to 30/70. If the molar ratio of urea bond becomes too small, hot offset resistance may be degraded.

The modified polyester such as urea-modified polyester (i), to be used for toner particles, can be manufactured by these reactions. The urea-modified polyester (i) can be prepared by a one shot method or a prepolymer method, for example. The weight-average molecular weight of the urea-modified polyester (i) is preferably 10,000 or more, more preferably from 20,000 to 10,000,000, and further preferably from 30,000 to 1,000,000. If the weight-average molecular weight is less than 10,000, hot offset resistance may be degraded. Further, the number average molecular weight of urea-modified polyester (i) is not particularly limited when an unmodified polyester (ii), to be described later, is used. In such a case, the number average molecular weight of the urea-modified polyester (i) is set to a given value which can obtain the aforementioned weight-average molecular weight.

When the urea-modified polyester (i) is used alone, the number average molecular weight is preferably 20,000 or less, more preferably from 1,000 to 10,000, and further preferably from 2,000 to 8,000. If the number average molecular weight becomes too great, low-temperature fixability of the toner may deteriorate and glossiness of images may be deteriorated when used for full-color image forming.

In an exemplary embodiment, the urea-modified polyester (i) can be used alone, and the urea-modified polyester (i) can be used with unmodified polyester (ii) as binder resin component. By using the urea-modified polyester (i) with the unmodified polyester (ii), low-temperature fixability of the toner and glossiness of full color image can be preferably enhanced compared to a case using the urea-modified polyester (i) alone.

Examples of the unmodified polyester (ii) include, but are not limited to, polycondensation products of the polyol (1) and polycarboxylic acid (2) as similar to the urea-modified polyester (i), and preferred compounds are the same as urea-modified polyester (i). Further, the unmodified polyester (ii) may not be limited to unmodified polyester, but may also include compounds modified by chemical bonds other than urea bonds, such as an urethane bond. From a viewpoint of low-temperature fixability of the toner and hot offset resistance, it is preferable that the urea-modified polyester (i) and the unmodified polyester (ii) are at least partially soluble in each other. Accordingly, it is preferable that polyester component of (i) and (ii) have similar compositions. When (ii) is mixed with (i), a weight ratio of (i) and (ii) is preferably from 5/95 to 80/20, more preferably from 5/95 to 30/70, further preferably from 5/95 to 25/75, and still further preferably from 7/93 to 20/80. If the weight ratio of (i) is too small, such as less than 5 wt %, hot offset resistance may be degraded, and a compatibility of thermostable preservability of the toner and low-temperature fixability of the toner may deteriorate.

The peak molecular weight of (ii) is preferably from 1,000 to 30,000, more preferably from 1,500 to 10,000, and further preferably from 2,000 to 8,000. If the peak molecular weight becomes too small, thermostable preservability of the toner may deteriorate. If the peak molecular weight becomes too great, low-temperature fixability of the toner may deteriorate.

A hydroxyl group value of (ii) is preferably 5 or more, more preferably from 10 to 120, and further preferably from 20 to 80. If the hydroxyl group value is too small, a compatibility of thermostable preservability of the toner and low-temperature fixability of the toner may deteriorate. An acid value of (ii) is preferably from 1 to 30, and more preferably from 5 to 20. By having such acid value, the unmodified polyester (ii) can be easily set to a negative charged condition.

A glass-transition temperature (Tg) of the binder resin is preferably from 50 to 70 degrees Celsius, and more preferably from 55 to 65 degrees Celsius. If the glass-transition temperature is too low, toner particles may be easily subjected to a blocking phenomenon at a higher temperature, which is not preferable. If the glass-transition temperature is too high, low-temperature fixability of the toner may deteriorate.

Under the existence of the urea-modified polyester resin, toner particles of an exemplary embodiment has a good level of thermostable preservability even if the glass-transition temperature is low compared to known polyester-based toner particles.

The temperature (TG') that the binder resin has a storage modulus of 10,000 dyne/cm$^2$ at a measurement frequency of 20 Hz is preferably 100 degrees Celsius or more, and more preferably from 110 to 200 degrees Celsius. If the temperature TG' is too low, hot offset resistance may be degraded.

The temperature (Tη) that the binder resin has a viscosity of 1,000 poises at a measurement frequency of 20 Hz is preferably 180 degrees Celsius or less, and more preferably from 90 to 160 degrees Celsius. If the temperature Tη becomes too high, low-temperature fixability of the toner may deteriorate. Accordingly, from a viewpoint of compatibility of low-temperature fixability of the toner and hot offset resistance, TG' is preferably set higher than Tη. In other words, a difference between TG' and Tη ("TG'−Tη") is preferably 0 degrees Celsius or more, more preferably 10 degrees Celsius or more, and further preferably 20 degrees Celsius or more. Such difference between TG' and Tη has no specific upper limit value. From a viewpoint of compatibility of thermostable preservability of the toner and low-temperature fixability of the toner, the difference between Tη and TG' is preferably 0 to 100 degrees Celsius, more preferably from 10 to 90 degrees Celsius, and further preferably from 20 to 80 degrees Celsius.

The binder resin can preferably be manufactured by the following method. Polyol (1) and polycarboxylic acid (2) are heated at a temperature of 150 to 280 degrees Celsius under the presence of a known esterification catalyst (e.g., tetrabutoxytitanate, dibutyltin oxide), and water is distilled under depressurized condition, as required, to obtain polyester having hydroxyl group. Then, the polyester is reacted with polyisocyanate (3) at a temperature of 40 to 140 degrees Celsius to obtain prepolymer (a) having isocyanate group. The prepolymer (a) is reacted with an amine (b) at a temperature of 0 to 140 degrees Celsius to obtain urea-modified polyester. When the polyester is reacted with the polyisocyanate (3) and when the prepolymer (a) is reacted with the amine (b), a solvent can be used, as required. Examples of solvent include, but are not limited to, aromatic solvents (e.g., toluene, xylene); ketones (e.g., acetone, methyl ethyl ketone, methyl isobutyl ketone); esters (e.g., acetic ether); amides (e.g., dimethyl formamide, dimethyl acetamide), and ethers (e.g., tetrahydrofuran), which are inactive to the polyisocyanate (3). When unmodified polyester (ii) is also used, unmodified polyester (ii) is prepared with a method similarly applied to polyester having hydroxyl group, and the unmodified polyester (ii) is dissolved and mixed with a solution having the modified polyester (i), reacted already.

Although the toner particles used in an exemplary embodiment can be manufactured by the following method, other methods can be used. As an aqueous medium, water may be used singly or in combination with a water-soluble solvent. Examples of the water-soluble solvent include, but are not limited to, alcohols (e.g., methanol, isopropanol, ethylene glycol), dimethyl formamide, tetrahydrofuran, cellosolves (e.g., methyl cellosolve), and lower ketones (e.g., acetone, methyl ethyl ketone).

The toner particles may be formed by reacting a dispersed prepolymer (a) having isocyanate group with amine (b) in the aqueous medium, or by using the urea-modified polyester (i) prepared in advance.

In the aqueous medium, a dispersion having the urea-modified polyester (i) and prepolymer (a) can be stably formed by adding compositions of toner materials having the urea-modified polyester (i) and prepolymer (a) in the aqueous medium, and by dispersing them by shear force. Toner materials including prepolymer (a) and other toner composition such as a colorant, a colorant master batch, a release agent, a charge control agent, an unmodified polyester resin, or the like can be mixed as a dispersion in the aqueous medium. However, it is more preferable to mix the toner materials in advance, and then to add such mixture in the aqueous medium to disperse such toner materials. Further, other toner materials such as a colorant, a release agent, a charge control agent, or the like are not necessarily mixed when toner particles are formed in the aqueous medium. Such other toner materials can be added after forming toner particles. For example, after forming toner particles having no colorant, a colorant can be added to the toner particles with known dyeing method.

The dispersion method includes known methods, such as a low-speed shearing method, a high-speed shearing method, a friction method, a high-pressure jet method, an ultrasonic wave method, for example, which can be selected depending on purpose. A high-speed shearing method is preferably used to obtain dispersed particles having a particle diameter of from 2 μm to 20 μm. Although a dispersing machine using high-speed shearing method can be rotated at any speed, the dispersing machine is preferably rotated at 1,000 rpm to 30,000 rpm (rotation per minute), and more preferably 5,000 rpm to 20,000 rpm. Although a dispersion time can be set any time, such dispersion time is usually set to 0.1 to 5 minutes for a batch method. The dispersion temperature is usually set to from 0 to 150 degrees Celsius (under pressurized condition), and more preferably from 40 to 98 degrees Celsius. A higher dispersion temperature is preferable because the urea-modified polyester (i) and prepolymer (a) can be easily dispersed when a dispersion solution has a lower viscosity.

The use amount of the aqueous medium with respect to 100 weight parts of toner composition having the urea-modified polyester (i) and prepolymer (a) is preferably 50 to 2,000 weight parts, and more preferably 100 to 1,000 weight parts. If the use amount of the aqueous medium is too small, toner compositions may not be dispersed effectively, by which toner particles having a given particle diameter cannot be obtained. If the use amount of the aqueous medium is too great, the manufacturing may not be conducted economically. Further, a dispersing agent can be used, as required. A dispersing agent is preferably used to obtain sharper particle-size distribution and stable dispersing condition.

In the process of synthesizing the urea-modified polyester (i) from the prepolymer (a), the amine (b) can be added and reacted in the aqueous medium before dispersing the toner compositions. Alternatively, the amine (b) can be added in the aqueous medium after dispersing the toner compositions to cause a reaction on an interface of particles. In this case, urea-modified polyester is formed preferentially on a surface of the toner particles prepared in the aqueous medium, by which a concentration gradient of urea-modified polyester may be set for a toner particle. For example, the concentration of urea-modified polyester may be set higher in a sub-surface portion of a toner particle and set lower in a center portion of a toner particle.

Dispersant for emulsifying or dispersing an oil phase having dispersed toner components to an aqueous phase may be anionic surfactant, cationic surfactant, nonionic surfactant, or zwitterionic surfactant. Examples of the anionic surfactant include, but are not limited to, alkyl benzene sulfonate salts, α-olefin sulfonate salts, alkyl salts, and phosphate ether salts. Examples of the cationic surfactant include, but are not limited to, amine salt surfactants, and quaternary ammonium salt cationic surfactants. Examples of the amine salt surfactant include, but are not limited to, alkylamine salts, amino alcohol fatty acid derivatives, polyamine fatty acid derivatives, and imidazolines. Examples of the quaternary ammonium salt cationic surfactant include, but are not limited to, alkyl trimethyl ammonium salts, dialkyldimethyl ammonium salts, alkyl dimethylbenzyl ammonium salts, pyridinium salts, alkyl isoquinolinium salts, and benzethonium chlorides. Examples of the nonionic surfactant include, but are not limited to, aliphatic acid amide derivatives, and polyalcohol derivatives. Examples of the zwitterionic surfactant include, but are not limited to, alanine, dodecyldi(aminoethyl)glycine, di(octylaminoethyl)glycine, and N-alkyl N,N-dimethylammonium betaines.

Among these, the surfactant having a fluoroalkyl group is preferably used to have favorable effect with a small amount. Examples of the anionic surfactant having the fluoroalkyl group include, but are not limited to, fluoroalkyl carboxylic acids having a carbon number of 2 to 10 or metal salt thereof, disodium perfluorooctane sulfonyl glutamic acid, sodium 3-[ω-fluoroalkyl (C6 to C11) oxy]-1-alkyl (C3 to C4) sulfonates, sodium 3-[ω-fluoroalkanoyl (C6 to C8)-N-ethylamino]-1-propane sulfonate, fluoroalkyl (C11 to C20) carboxylic acid or its metal salt, perfluoroalkyl carboxylic acids (C7 to C13) or its metal salt, perfluoroalkyl (C4 to C12) sulfonates or its metal salt, perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salts, perfluoroalkyl (C6 to C10)-N-ethylsulfonyl glycine salts, and mono perfluoroalkyl (C6 to C16) ethylphosphate esters.

Examples of trade names of surfactants having the fluoroalkyl group include SURFLON S-111, S-112, S-113 (manufactured by Asahi Glass Co., Ltd); FLUORAD FC-93, FC-95, FC-98, FC-129 (manufactured by Sumitomo 3M Co., Ltd); UNIDINE DS-101, DS-102 (manufactured by Daikin Industries, Ltd); MEGAFACE F-110, F-120, F-113, F-191, F-812, F-833 (manufactured by Dainippon Ink & Chemicals, Inc.); EKTOP EF-102, 103, 104, 105, 112, 123A, 123B, 306A, 501, 201, 204 (manufactured by Tochem Products Co., Ltd); and FTERGENT F-100, F150 (manufactured by Neos Co., Ltd).

Examples of the cationic surfactant include, but are not limited to, aliphatic primary, secondary, or tertiary amines having fluoroalkyl group, aliphatic quaternary ammonium salts, such as perfluoroalkyl (C6 to C10) sulfonamide propyl trimethyl ammonium salts, benzalkonium salts, benzethonium chlorides, pyridinium salts, and imidazolinium salts. Trade names of the cationic surfactant include SURFLON S-121 (manufactured by Asahi Glass Co., Ltd); FLUORAD FC-135 (manufactured by Sumitomo 3M Co., Ltd); UNIDINE DS-202 (manufactured by Daikin Industries, Ltd), MEGAFACE F-150, F-824 (manufactured by Dainippon Ink & Chemicals, Inc.); EKTOP EF-132 (manufactured by Tochem Products Co., Ltd); and FTERGENT F-300 (manufactured by Neos Co., Ltd).

Examples of the inorganic compound dispersing agent having lower water solubility include, but are not limited to, tricalcium phosphate, calcium carbonate, titanium oxide, colloidal silica, and hydroxyapatite.

Further, a high polymer protective colloid can be used to stabilize a dispersion droplet. Examples of the high polymer protective colloid include, but are not limited to, acids, (meth) acrylic monomers having hydroxyl group, vinyl alcohols or vinyl alcohol ethers, ester compounds having vinyl alcohol and carboxyl group, amide compounds or its methylol compound, chlorides, homopolymers or copolymers having nitrogen atom or heterocyclic ring of nitrogen atom, polyoxyethylenes, and cellulose.

Examples of the acids include, but are not limited to, acrylic acid, methacrylic acid, α-cyanoacrylic acid, α-cyanomethacrylic acid, itaconic acid, crotonic acid, fumaric acid, maleic acid, and maleic anhydride. Examples of the (meth) acrylic monomer having hydroxyl group include, but are not limited to, β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl acrylic acid, 3-chloro-2-hydroxypropyl methacrylic acid, dieethylene glycol monoacrylic ester, diethylene glycol monomethacrylic acidester, glycerin monoacrylic ester, glycerin monomethacrylic ester, N-methylol acrylamide, and N-methylol methacrylamide. Examples of the vinyl alcohol or vinyl alcohol ether include, but are not limited to, vinyl methyl ether, vinyl ethyl ether, and vinyl propyl ether. Examples of the ester compound having vinyl alcohol and carboxyl group include, but are not limited to, vinyl acetate, propionic acidvinyl, and vinyl butyrate. Examples of the amide compound or its methylol compound include, but are not limited to, acrylamide, methacrylamide, diacetone acrylamide acid, or methylol compound thereof. Examples of the chloride include, but are not limited to, acrylic acid chloride, and methacrylic acid chloride. Examples of the homopolymer or copolymer having nitrogen atom or heterocyclic ring of nitrogen atom include, but are not limited to, polymers of vinylpyridine, vinylpyrrolidone, vinylimidazole, or ethyleneimine. Examples of the polyoxyethylene include, but are not limited to, polyoxyethylene, polyoxypropylene, polyoxyethylene alkylamine, polyoxypropylenealkylamine, polyoxyethylene alkylamide, polyoxypropylenealkylamide, polyoxyethylene nonyl phenyl ether, polyoxyethylene lauryl phenyl ether, polyoxyethylene stearyl phenyl ester, and polyoxyethylene nonyl phenyl ester. Examples of the cellulose include, but are not limited to, methyl cellulose, hydroxyethyl cellulose, and hydroxypropyl cellulose.

When preparing the aforementioned dispersion solution, a dispersion stabilizer can be used, as required. Suitable dispersion stabilizers include, but are not limited to, compounds such as calcium phosphate salt, which can be dissolved in acid or alkali. When such dispersion stabilizer is used, calcium phosphate salt may be removed from fine particles by dissolving calcium phosphate salt using an acid, such as hydrochloric acid, and then washing the dispersion solution, or calcium phosphate salt may be removed from fine particles through decomposition by enzyme. If the dispersion agent is used, the dispersion agent can be retained on the surface of toner particles. However, the dispersion agent is preferably washed and removed from toner particles after an elongation and/or cross-linking reaction to set preferable toner charge performance.

Further, to decrease the viscosity of toner composition, a solvent, which can dissolve the urea-modified polyester (i) and prepolymer (a), can be used. Such a solvent is preferably used to obtain a sharper particle-size distribution. The solvent may be preferably volatile, by which the solvent can be removed easily. Examples of the solvent include, but are not limited to, toluene, xylene, benzene, tetrachloride carbon, dichloromethane, 1,2-dichloroethane, 1,1,2-trichloroethane, trichloroethylene, chloroform, monochlorobenzene, dichloroethylidene, methyl acetate, acetic ether, methyl ethyl ketone, and methyl isobutyl ketone. These can be used alone or in combination. Among these, aromatic solvents such as toluene and xylene, halogenated hydrocarbons such as dichloromethane, 1,2-dichloroethane, chloroform, and tetrachloride carbon are preferably used, and aromatic solvents such as toluene and xylene are more preferably used. The use amount of the solvent with respect to the prepolymer (a) of 100 weight parts is preferably from 0 to 300 weight parts, more preferably from 0 to 100 weight parts, and further preferably from 25 to 70 weight parts. When the solvent is used, the solvent is heated and removed under a normal or reduced pressure condition after an elongation and/or cross-linking reaction.

An elongation and/or cross-linking reaction time is determined based on reactivity of the isocyanate group of the prepolymer (a) and the amine (b). Such reaction time is usually 10 minutes to 40 hours, and preferably from 2 hours to 24 hours. The reaction temperature is preferably from 0 to 150 degrees Celsius, and more preferably from 40 to 98 degrees Celsius. Further, a known catalyst, such as dibuthyltin laurate and dioctyltin laurate, can be used, as required.

To remove an organic solvent from the emulsified dispersion solution, the emulsified dispersion solution is gradually heated to a higher temperature to vaporize and remove the organic solvent from the solution. Alternatively, an emulsified dispersion solution may be sprayed in a dry atmosphere to remove an organic solvent from droplets to form fine toner particles, and aqueous dispersing agent is also vaporized and removed. The dry atmosphere may be a heated gas atmosphere using air, nitrogen, carbon dioxide, combustion gas, or the like. The heated gas atmosphere may be heated to a temperature greater than a boiling point of solvent to be used. Targeted quality of toner particles can be obtained by a spray dryer, a belt dryer, or a rotary kiln with a shorter time.

When an emulsified dispersion solution has a broader particle-size distribution, the broader particle-size distribution can be segmented in a plurality of sizes after washing and drying the emulsified dispersion solution to obtain uniformly sized particles. The segmentation process for separating fine particles size by size can be conducted on the dispersion solution by a cyclone method, a decanter method, or a centrifugal separation method or the like. Although the segmentation process can be conducted on dried particles, obtained by drying the dispersion solution, the segmentation process is preferably conducted on the dispersion solution from a viewpoint of efficiency. Fine particles, obtained by the segmentation process but not used for product, or not so fine particles may be reused in a kneading process to form particles. In such a case, unnecessary fine particles or not so fine particles may be wet. It is preferable to remove the dispersing agent from the obtained dispersion solution as much as possible, and the removal of dispersing agent is preferably conducted when the segmentation process is conducted, for example.

The obtained dried toner particles may be mixed with other particles, such as a release agent, a charge control agent, a plasticizer, and a colorant, and then an impact force may be applied to the mixed particles to fix or fuse other particles on the surface of the toner particles. The fixed other particles may not be separated from the surface of toner particles so easily. Specifically, a mixture of particles is applied with an impact force using an impeller vane rotating at a high speed, or a mixture of particles is introduced in a high speed air stream for accelerating particles, and accelerated particles are impacted into one another or impacted against an impact plate. Examples of such machines are Ong Mill (manufactured by Hosokawa Micron Corp.), a modified I-type Mill (manufactured by Nippon Pneumatic Mfg. Co., Ltd) using reduced pulverization air pressure, Hybridization System (manufactured by Nara Kikai Seisakusho), Cryptron System (manufactured by Kawasaki Heavy Industries, Ltd), and an automatic mortar, for example.

Further, conventional colorants such as pigment and dye can be used as a colorant for the toner particles. Suitable colorants include, but are not limited to, carbon black, Nigrosine dyes, black iron oxide, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, LITHOL RUBINE GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

Further, if magnetic property is to be provided to toner particles, toner particles may be contained with a magnetic component such as ferric oxide (e.g., ferrite, magnetite, maghemite) or a metal or metal alloy of iron, cobalt, nickel, or the like. These magnetic components may be used alone or in combination. Further, such magnetic component may be used as a colorant component.

Further, the colorant used with the toner particles preferably has a number average particle diameter of 0.5 μm or less, more preferably 0.4 μm or less, and further preferably 0.3 μm or less. If the number-average particle diameter becomes too large, pigments may not be dispersed at an adequate level, and a preferable transparency may not be obtained. If the number average particle diameter becomes smaller, such fine colorant particles have a diameter effectively smaller than a half-wave length of visible light, by which such fine colorant particles may not affect reflection and absorption of light. Accordingly, such fine colorant particles may be useful for attaining a good level of color reproducibility and transparency of an OHP (overhead projector) sheet having an image.

If particles having a larger particle diameter are included in colorant in a large amount, the larger particles may block transmission of incident light or scatter incident light, by which brightness and vividness of a projected image of OHP sheet may become lower. Further, if the larger particles are included in colorant in a large amount, colorant may drop from the surface of toner particles, and thereby cause problems such as fogging, drum contamination, or defective cleaning. Specifically, an amount of colorant having a particle diameter greater than 0.7 μm is preferably 10% or less, and more preferably 5% or less of all colorant.

Further, colorant may be mixed with a binding resin and a moistening agent, and kneaded with the binding resin to adhere the colorant to the binding resin. When the colorant is mixed with the binding resin, the colorant may be dispersed more effectively, and thereby a particle diameter of colorant dispersed in toner particles can be set smaller. Accordingly, a better transparency of an OHP (overhead projector) sheet having an image can be obtained. The binding resin used for kneading may include resin used as a binding resin for toner, but not limited thereto.

A mixture of the binding resin, colorant, and moistening agent can be mixed by using a blending machine, such as HENSCHEL mixer, and then the mixture is kneaded by a kneading machine having two or three rolls at a temperature set lower than a melting temperature of the binding resin, by which kneaded mixture of the binding resin and colorant can be obtained. Further, the moistening agent may be water, an organic solvent, such as acetone, toluene, butanone in view of solubility of a binding resin and wet-ability with a colorant, and water is preferably used in view of dispersion performance of colorant. Water is preferable from a viewpoint of environmental load, and keeping dispersion stability of colorant in the following toner manufacturing process. The process may preferably decrease a particle diameter of colorant particles included in toner particles, and colorant particles can be dispersed more uniformly. Accordingly, color reproducibility of a projected image of OHP sheet can be enhanced.

Further, the toner particles may preferably include a release agent in addition to the binder resin and the colorant. Examples of the release agent include, but are not limited to, polyolefin waxes (e.g., polyethylene wax, polypropylene wax); long-chain hydrocarbons (e.g., paraffin wax, southall wax); and waxes having a carbonyl group. Among these, waxes having a carbonyl group are preferable.

Examples of the wax having a carbonyl group include, but are not limited to, polyalkanoic acid esters (e.g., carnauba wax, montan wax, trimethylolpropane tribehenate, pentaerythritol tetraibehenate, pentaerythritol diacetate dibehenate, glycerin tribehenate, 1,18-octadecanediol distearate); polyalkanol esters (e.g., trimellitic acid tristearyl, distearyl maleate); polyalkanoic acid amides (e.g., ethylenediamine dibehenylamide); polyalkylamides (e.g., tristearylamide trimellitate); and dialkyl ketones (e.g., distearyl ketone). Among these, polyalkanoic acid esters are preferable. The melting point of the release agent is preferably from 40 to 160 degrees Celsius, more preferably from 50 to 120 degrees Celsius, and further preferably from 60 to 90 degrees Celsius. If the melting point of the release agent is too low, such release agent may affect thermostable preservability of the toner. If the melting point of the release agent is too high, the release agent may more likely cause cold offset when a fixing process is conducted under low temperature.

The viscosity of the melted release agent measured at a temperature higher than the melting point for 20 degrees Celsius preferably has a value of from 5 to 1,000 cps, and more preferably from 10 to 100 cps. If the melted viscosity becomes too great, the release agent may not improve hot offset resistance and low temperature fixability of the toner. A content of the release agent in the toner particles is preferably 0 wt % to 40 wt %, and more preferably from 3 wt % to 30 wt %.

Further, toner particles may include a charge control agent to enhance charge amount and charging speed of toner particles, as required. If the charge control agent is a color material, the charge control agent may change the color of toner particles. Accordingly, colorless material or whitish material is preferably used. Examples of the charge control agent include, but are not limited to, triphenylmethane dyes, chelate molybdate pigments, rhodamine dyes, alkoxy amines, quaternary ammonium salts (including fluorine modified quaternary ammonium salt), alkylamides, phosphorus alone or phosphorus compounds, tungsten alone or tungsten compounds, fluorine-based activators, salicylic acid metal salts, and metal salts of salicylic acid derivatives.

Example trade names of the charge control agent include Bontron P-51 as quaternary ammonium salt, E-82 as oxynaphthoic acid metal complex, E-84 as salicylic acid metal complex, E-89 as phenol condensate (manufactured by Orient Chemical Industries, Ltd.); TP-302, TP-415 as quaternary ammonium salt molybdenum complex (manufactured by Hodogaya Chemical Industries, Ltd.); Copy Charge PSY VP2038 as quaternary ammonium salt, Copy Blue PR as triphenyl methane derivative, Copy Charge NEG VP2036 and Copy Charge NX VP434 as quaternary ammonium salt (manufactured by Hoechst Co., Ltd.); LRA-901, LR-147 as boron complex (both manufactured by Japan Carlit Co., Ltd.), quinacridone, azo pigment, and polymer compound having functional group such as sulfonic acid group, carboxyl group, quaternary ammonium salt, or the like.

The adding amount of the charge control agent is determined based on toner manufacturing condition such as types of binder resins, presence or absence of additives, and a dispersion method, or the like. The charge control agent is preferably used in a range of from 0.1 to 10 weight parts, and more preferably from 0.2 to 5 weight parts with respect to the binder resin of 100 weight parts.

If the adding amount of the charge control agent becomes too great, the toner particles may be charged too high, by which an effect of charge control agent is reduced and the toner particles may be attracted to a developing roller with a greater electrostatic attraction force. Therefore, a developing agent may have a lower fluidity, and result in a lower image concentration. The charge control agent can be melted and kneaded with a resin in a master batch to disperse the charge control agent, or may be added to an organic solvent to dissolve and disperse the charge control agent, or may be solidified on the surface of toner particles after toner particles are formed.

Further, when dispersing toner compositions in an aqueous medium during a toner manufacturing process, fine resin particles may be added to a solution to stabilize dispersion condition. Suitable fine resin particles may be any resins, which can be used for dispersion in an aqueous medium, and may preferably be thermoplastic resin or thermosetting resin. Examples of the fine resin particles include, but are not limited to, vinyl resins, polyurethane resins, epoxy resins, polyester resins, polyamide resins, polyimide resins, silicone resins, phenol resins, melamine resins, urea resins, aniline resins, ionomer resins, and polycarbonate resins. These can be used alone or in combination. Among these, vinyl resins, polyurethane resins, epoxy resins, polyester resins or combinations of these are preferably used to obtain spherical fine particles in an aqueous dispersion. Examples of the vinyl resin include, but are not limited to, homopolymers or copolymers of vinyl monomers, and may be styrene (meth)acrylic acid ester resin, copolymer of styrene/butadiene, copolymer of (meth)acrylic acid-acrylic acid ester, copolymer of styrene/acrylonitrile, copolymer of styrenemaleic anhydride, and copolymer of styrene (meth)acrylic acid.

Further, inorganic fine particles may be preferably used as external additives to facilitate fluidity, developing performance, charged performance of toner particles. Suitable inorganic fine particles preferably have a primary particle diameter of 5 nm (nanometer) to 2 μm, and more preferably 5 nm to 500 nm. Further, inorganic fine particles preferably have a specific surface area of 20 $m^2/g$ to 500 $m^2/g$ measured by the BET method. The inorganic fine particles are preferably added to the toner particles in an amount of 0.01 wt % to 5 wt %, and more preferably from 0.01 wt % to 2.0 wt %. Examples of the inorganic fine particles include, but are not limited to, silica, alumina, titanium oxide, barium titanate, magnesium titanate, calcium titanate, strontium titanate, zinc oxide, tin oxide, silica sand, clay, mica isinglass, sand-lime, diatomite, chrome oxide, cerium oxide, colcothar, antimony trioxide, magnesium oxide, zirconium oxide, barium sulfate, barium carbonate, calcium carbonate, silicon carbide, and silicon nitride.

In addition, polymer fine particles obtained by, for example, a soap-free emulsion polymerization, a suspension polymerization, or a dispersion polymerization can be used. The polymer fine particles may be polystyrene, copolymers of methacrylic acid esters, copolymers of acrylic acid esters, polycondensation polymers of silicone, polycondensation polymers of benzoguanamine, polycondensation polymers of nylon, and polymer particles prepared from thermosetting resins, for example.

The external additives can be subjected to a surface treatment to enhance hydrophobicity, by which a deterioration of fluidity and charged performance of toner particles under high-humidity environment can be reduced. Examples of preferable surface treatment agents include, but are not limited to, silane coupling agents, silylating agents, silane coupling agents having fluorinated alkyl group, organic titanate coupling agents, aluminum coupling agents, silicone oils, and modified silicone oils.

Further, a cleaning improving agent may be added to toner composition, to facilitate removal of developing agent remaining on the photoconductor drum 1 or an intermediate transfer member after transfer process. Examples of the cleaning improving agent include, but are not limited to, aliphatic metal salts (e.g., zinc stearate, calcium stearate, stearic acid); and polymer fine particles manufactured by a soap-free emulsion polymerization (e.g., polymethyl methacrylate fine particles, polystyrene fine particles). These polymer fine particles have relatively narrower particle-size distribution, and particles having volume-average particle diameter of 0.01 μm to 1 μm are preferable.

By using such toner particles having a good level of developing performance, a higher quality toner image can be produced in a stable manner. However, toner particles, not transferred to a transfer member (or recording member) or an intermediate transfer member by a transfer unit but remaining on the photoconductor drum 1, may not be effectively removed by a cleaning unit because toner particles have a fine spherical shape, and such toner particles may not be recovered by the cleaning unit. Although toner particles can be removed from the photoconductor drum 1 by pressing a particle remover such as cleaning blade to the photoconductor drum 1 with a greater force, for example, such a configuration may shorten a lifetime of the photoconductor drum 1 or cleaning unit, and may not be preferable from a viewpoint of energy saving. However, if a pressure of the cleaning blade pressed against the photoconductor drum 1 is reduced, toner particles or small-sized carrier particles cannot be removed from the photoconductor drum 1 effectively, and particles may cause damage on the photoconductor drum 1, by which an image forming apparatus may not produce images effectively.

Although toner for producing higher quality image, prepared by a polymerization method is used for the above described image forming apparatus, toner prepared by another method, such as indefinite shaped toner prepared by a pulverization method, can also be used for the image forming apparatus. Such toner may be preferably used to enhance a lifetime of image forming apparatus.

Further, in an exemplary embodiment, in addition to the above-described toner particles used for obtaining high quality images, an image forming apparatus can be used with irregular shaped toner particles prepared by a pulverization method, which may be useful for extending a lifetime of apparatus. Materials for such toner particles may not be limited to any specific materials, but materials used commonly for electrophotography can be used.

Examples of binding resin used for the pulverized toner particles include, but are not limited to, styrenes or homopolymers of styrene derivative substitution (e.g., polystyrene, poly p-chlorostyrene, polyvinyl toluene); styrene copolymers (e.g., styrene/p-chlorostyrene copolymer, styrene/propylene copolymer, styrene/vinyl toluene copolymer, styrene/vinyl naphthalene copolymer, styrene/acrylic acid methyl copolymer, styrene/acrylic acid ethyl copolymer, styrene/acrylic acid butyl copolymer, styrene/acrylic acid octyl copolymer, styrene/methacrylic acid methyl copolymer, styrene/methacrylic acid ethyl copolymer, styrene/methacrylic acid buthyl copolymer, styrene/α-chloromethacrylic acid methyl copolymer, styrene/acrylonitrile copolymer, styrene/vinyl methyl ketone copolymer, styrene/butadiene copolymer, styrene/isoprene copolymer, styrene/maleic acid copolymer); homopolymers or copolymers of acrylic acid esters (e.g., polymethyl acrylate, polybuthyl acrylate, polymethyl methacrylate, polybuthyl methacrylate methacrylic acid); polyvinyl derivatives (e.g., polyvinyl chloride, polyvinyl acetate); polyester polymers, polyurethane polymers, polyamide polymers, polyimide polymers, polyol polymers, epoxy polymers, terpene polymers, aliphatic or alicyclic hydrocarbon resins, and aromatic petroleum resins. These can be used alone or in combination. Among these, styrene acrylic copolymer resins, polyester resins, and polyol resins are preferably used in view of electrical property and cost, and polyester resins and polyol resins are preferably used in view of a good level of fixing performance.

The surface layer of the charging member such as a charge roller may include a resin component used as binding resin of the toner particles, wherein such resin component may be a linear polyester resin composition, a linear polyol resin composition, a linear styrene acrylic resin composition or a cross-linking composition of these, and at least one of these may be used.

Pulverized toner particles may be prepared as follows: First, mix the aforementioned resin component and the aforementioned colorant component, a wax component, a charge control component, or the like, as required, then knead the mixture at a temperature slightly lower than a melting temperature of the resin component, and then cool the mixture. After segmenting toner particles size by size, toner particles can be prepared. The toner particles may be further added with the aforementioned external additives, as required.

In an image forming apparatus employing the above described configuration according to exemplary embodiments, a protective agent having compound, such as paraffin, as a main component can be effectively applied to a photoconductor, by which the photoconductor can be protected from electrical stress of AC charging, a reduction of frictional pressure between the photoconductor and a cleaning blade can be attained, and toner remaining on a photoconductor can be cleaned well, resulting into prevention of production of abnormal image.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined with each other and/or substituted for each other within the scope of this disclosure and appended claims.

What is claimed is:

1. A protective layer setting unit, comprising:

a protective agent comprising paraffin as a main component;

a layer adjusting unit comprising a blade; and an application unit configured to apply the protective agent to an image carrying member, in a manner sufficient to meet the following requirements:

a surface condition of the image carrying member determined by an applied-agent amount index "X" and an agent coating ratio "Y", wherein a ratio of "X/Y" is set to 0.020 or less when the protective agent has been applied for 120 minutes to the image carrying member, wherein the applied-agent amount index "X" is defined by the following equation (1), and the agent coating ratio "Y" is defined by the following equation (2);

$$\text{applied-agent amount index } X = Sb/Sa \quad (1)$$

$$\text{agent coating ratio } Y = (A_0 - A)/A_0 \times 100(\%) \quad (2)$$

wherein in the equation (1),

Sb represents a peak area of a peak Pb at a wavenumber, b, in an infrared (IR) spectrum of the surface of the image carrying member after applying the protective agent for 120 minutes, wherein the wavenumber b is a peak found in an IR spectrum of the protective agent alone, but not in an IR spectrum of the image carrying member alone, Sa represents a peak area of a peak Pa at a wavenumber, a, in an IR spectrum of the surface of the image carrying member after applying the protective agent for 120 minutes, wherein the wavenumber a is a peak found in an IR spectrum of the image carrying member alone, but not in an IR spectrum of the protective agent alone; and wherein in the equation (2), $A_0$(%) represents a first area value for a peak unique to a material from which the image carrying member is formed, in a C1s X-ray photoelectron spectroscopy (XPS) spectrum, with respect to a total area of the C1s spectrum of the image carrying member, before applying the protective agent, and A(%) represents a second area value for the peak of a C1s X-ray photoelectron spectroscopy (XPS) spectrum with respect to a total area of the C1s spectrum of the image carrying member, after applying the protective agent, wherein the protective agent is shaped as a protective agent bar, and the application unit comprises:

a brush roller having a metal core and a number of fibers formed on the metal core by an electrostatic implantation method with a fiber density of 50,000 to 600,000 fibers per square inch, each of the fibers having a diameter of from 28 μm to 42 μm, the protective agent bar is pressed against the fibers to scrape the protective agent, and the fibers are pressed against the image carrying member to apply the protective agent to the image carrying member; and a blade configured to be pressed against the image carrying member to form the protective agent layer on the image carrying member.

2. The protective layer setting unit according to claim 1, wherein the image carrying member comprises a polycarbonate and the peak unique to a material from which the image carrying member is formed is a peak obtained in a range of from 290.3 eV to 294 eV in the C1s XPS spectrum.

3. The protective layer setting unit according to claim 1, wherein the wavenumber a is 1770 $cm^{-1}$, and the wavenumber b is 2850 $cm^{-1}$.

4. The protective layer setting unit according to claim 1, wherein the agent coating ratio Y by the protective agent is 70% or more.

5. The protective layer setting unit according to claim 1, wherein the ratio X/Y is set from 0.0002 to 0.020.

6. The protective layer setting unit according to claim 5, wherein the ratio X/Y is set from 0.0002 to 0.016.

7. A process cartridge, comprising:

an image carrying member; and the protective layer setting unit according to claim 1.

8. The process cartridge according to claim 7, wherein the image carrying member comprises a polycarbonate and the peak unique to a material from which the image carrying member is formed is a peak obtained in a range of from 290.3 eV to 294 eV in the C1s XPS spectrum.

9. The process cartridge according to claim 7, wherein the agent coating ratio Y by the protective agent is 70% or more.

10. The process cartridge according to claim 7, wherein the ratio X/Y is set from 0.0002 to 0.020.

11. The process cartridge according to claim 10, wherein the ratio X/Y is set from 0.0002 to 0.016.

12. An image forming apparatus, comprising:

an electrostatic latent image carrying member configured to bear an electrostatic latent image;

an electrostatic latent image forming device configured to form an electrostatic latent image on the electrostatic latent image bearing member;

the protective layer setting unit according to claim 1;

a developing device configured to develop the electrostatic latent image with a toner to form a toner image;

a transfer device configured to transfer the toner image onto a recording medium; and a fixing device configured to fix the toner image on the recording medium.

13. The image forming apparatus according to claim 12, wherein the image carrying member comprises a polycarbonate and the peak unique to a material from which the image carrying member is formed is a peak obtained in a range of from 290.3 eV to 294 eV in the C1s XPS spectrum.

14. The image forming apparatus according to claim 12, wherein the agent coating ratio Y by the protective agent is 70% or more.

15. The image forming apparatus according to claim 12, wherein the ratio X/Y is set from 0.0002 to 0.020.

16. The image forming apparatus according to claim 15, wherein the ratio X/Y is set from 0.0002 to 0.016.

17. A method for determining a surface condition of an image carrying member to which a protective agent is being applied, comprising:

determining an applied-agent amount index "X" and an agent coating ratio "Y", the applied-agent amount index "X" being defined by an equation (1), and the agent coating ratio "Y" being defined by an equation (2), and setting a ratio of "X/Y" to 0.020 or less when the protective agent has been applied for 120 minutes to the image carrying member;

$$\text{applied-agent amount index } X=Sb/Sa \quad (1)$$

$$\text{agent coating ratio } Y=(A_0-A)/A_0\times 100(\%) \quad (2)$$

wherein the equation (1),

Sb represents a peak area of a peak Pb at a wavenumber, b, in an IR spectrum of the surface of the image carrying member after applying the protective agent for 120 minutes, wherein the wavenumber b is a peak found in an IR spectrum of the protective agent alone, but not in an IR spectrum of the image carrying member alone, Sa represents a peak area of a peak Pa at a wavenumber, a, in an IR spectrum of the surface of the image carrying member after applying the protective agent for 120 minutes, wherein the wavenumber a is a peak found in an IR spectrum of the image carrying member alone, but not in an IR spectrum of the protective agent alone; and wherein in the equation (2), $A_0$(%) represents a first area value for a peak unique to a material from which the image carrying member is formed, in a C1s X-ray photoelectron spectroscopy (XPS) spectrum, with respect to a total area of the C1s spectrum of the image carrying member, before applying the protective agent, and A(%) represents a second area value for the peak of a C1s X-ray photoelectron spectroscopy (XPS) spectrum with respect to a total area of the C1s spectrum of the image carrying member, after applying the protective agent.

18. A method of forming an image carrying member on which a latent image is to be firmed, and a protective agent comprising paraffin as a main component applied to the surface of the image carrying member in a particular surface condition, comprising applying said protective agent to the surface of said image carrying member, and determining an applied-agent amount index "X" and an agent coating ratio "Y", the applied-agent amount index "X" being defined by an equation (1), and the agent coating ratio "Y" being defined by an equation (2), and setting a, ratio of "X/Y" to 0.020 or less when the protective agent has been applied for 120 minutes to the image carrying member;

$$\text{applied-agent amount index } X=Sb/Sa \quad (1)$$

$$\text{agent coating ratio } Y=(A_0-A)/A_0\times 100(\%) \quad (2)$$

wherein the equation (1),

Sb represents a peak area of a peak Pb at a wavenumber, b, in an IR spectrum of the surface of the image carrying member after applying the protective agent for 120 minutes, wherein the wavenumber b is a peak found in an IR spectrum of the protective agent alone, but not in an IR spectrum of the image carrying member alone, Sa represents a peak area of a peak Pa at a wavenumber, a, in an IR spectrum of the surface of the image carrying member after applying the protective agent for 120 minutes, wherein the wavenumber a is a peak found in an IR spectrum of the image carrying member alone, but not in an IR spectrum of the protective agent alone; and wherein in the equation (2), $A_0$(%) represents a first area value for a peak unique to a material from which the image carrying member is formed, in a C1s X-ray photoelectron spectroscopy (XPS) spectrum, with respect to a total area of the C1s spectrum of the image carrying member, before applying the protective agent, and A(%) represents a second area value for the peak of a C1s X-ray photoelectron spectroscopy (XPS) spectrum with respect to a total area of the C1s spectrum of the image carrying member, after applying the protective agent.

19. The method according to claim 18, wherein the image carrying member comprises a surface layer which comprises a polycarbonate.

* * * * *